US010113829B2

(12) United States Patent
Nachefski

(10) Patent No.: US 10,113,829 B2
(45) Date of Patent: Oct. 30, 2018

(54) EFFICIENT HIGH-VELOCITY COMPRESSED GAS-POWERED GUN

(71) Applicant: William S. Nachefski, Katy, TX (US)

(72) Inventor: William S. Nachefski, Katy, TX (US)

( * ) Notice: Subject to any disclaimer, the term of this patent is extended or adjusted under 35 U.S.C. 154(b) by 0 days.

(21) Appl. No.: 15/593,467

(22) Filed: May 12, 2017

(65) Prior Publication Data

US 2017/0299323 A1 Oct. 19, 2017

Related U.S. Application Data

(63) Continuation-in-part of application No. 15/340,681, filed on Nov. 1, 2016, now Pat. No. 9,739,564, which is a continuation of application No. 14/551,833, filed on Nov. 24, 2014.

(51) Int. Cl.
*F41B 11/721* (2013.01)
*F41B 11/62* (2013.01)

(52) U.S. Cl.
CPC ..... *F41B 11/721* (2013.01); *F41B 11/62* (2013.01)

(58) Field of Classification Search
CPC ..... F41B 11/723; F41B 11/721; F41B 11/72; F41B 11/73; F41B 11/62; F41B 11/68; F41B 11/60; F41B 11/00
See application file for complete search history.

(56) References Cited

U.S. PATENT DOCUMENTS 2,288,891 A * 7/1942 Dreyer ..... F41A 9/15 124/76
2,818,056 A 12/1957 Martin
3,177,863 A * 4/1965 Spack ..... F41B 11/51 124/74
3,612,026 A * 10/1971 Vadas ..... F41B 11/54 124/31
4,936,282 A 6/1990 Dobbins et al.
5,078,118 A * 1/1992 Perrone ..... F41B 11/723 124/73
5,257,614 A * 11/1993 Sullivan ..... F41B 11/00 124/73
5,265,582 A * 11/1993 Bhogal ..... F41B 11/723 124/73
5,280,778 A * 1/1994 Kotsiopoulos ..... F41A 19/02 124/31
5,339,791 A * 8/1994 Sullivan ..... F41B 11/00 124/73
5,349,939 A * 9/1994 Perrone ..... F41B 11/00 124/74
5,383,442 A * 1/1995 Tippmann ..... F41A 29/02 124/73
5,487,233 A 1/1996 Jewell
(Continued)

*Primary Examiner* — Derrick R Morgan
(74) *Attorney, Agent, or Firm* — Howard L. Speight, PLLC

(57) ABSTRACT

A lower receiver has a trigger assembly. An upper receiver is coupled to the lower receiver. The lower receiver has a bolt assembly and an L-shaped slot. The L-shaped slot has a long leg, a junction, and a short leg. The bolt assembly interacts with the L-shaped slot. The upper receiver has a rear end to which a compressed gas power source can be coupled. The upper receiver has a gas path from the compressed gas power source for firing a projectile through a barrel and for cocking the bolt assembly. The gas path is entirely contained by the upper receiver.

21 Claims, 46 Drawing Sheets

(56) References Cited

U.S. PATENT DOCUMENTS 5,494,024 A * 2/1996 Scott ..... F41B 11/52 124/72
5,497,758 A * 3/1996 Dobbins ..... F41B 11/62 124/71
5,503,137 A * 4/1996 Fusco ..... F41B 11/62 124/56
5,505,188 A * 4/1996 Williams ..... F41B 11/52 124/49
5,515,838 A * 5/1996 Anderson ..... F41B 11/721 124/73
5,586,545 A 12/1996 McCaslin
5,634,456 A 6/1997 Perrone
5,673,679 A * 10/1997 Walters ..... F41B 11/52 124/49
5,722,383 A * 3/1998 Tippmann, Sr. ..... F41A 9/61 124/48
5,724,954 A * 3/1998 Smith ..... F41B 11/642 124/66
5,771,875 A * 6/1998 Sullivan ..... F41B 11/54 124/72
5,778,868 A 7/1998 Shepherd
5,813,392 A * 9/1998 McCaslin ..... F41B 11/723 124/73
5,913,303 A * 6/1999 Kotsiopoulos ..... F41B 11/723 124/31
6,024,077 A * 2/2000 Kotsiopoulos ..... F41B 11/724 124/71
6,276,354 B1 * 8/2001 Dillon ..... F41B 11/724 124/31
6,286,497 B1 * 9/2001 Levkov ..... F41B 11/724 124/73
6,343,599 B1 * 2/2002 Perrone ..... F41B 11/724 124/70
6,622,714 B2 * 9/2003 Liang ..... F41B 11/723 124/74
6,763,822 B1 * 7/2004 Styles ..... F41A 7/08 124/32
7,836,872 B2 * 11/2010 Tseng ..... F41B 11/62 124/31
7,882,830 B1 * 2/2011 Gabrel ..... F41B 11/62 124/73
7,926,408 B1 * 4/2011 Kley ..... F41A 33/02 124/73
7,931,018 B1 * 4/2011 Lai ..... F41B 11/721 124/71
8,322,329 B1 * 12/2012 Sikes ..... F41B 11/724 124/73
9,605,924 B1 * 3/2017 McCaslin ..... F41B 11/70
9,797,678 B2 * 10/2017 Tseng ..... F41B 11/723
9,835,404 B2 * 12/2017 Shen ..... F41B 11/642
2002/0002785 A1 * 1/2002 Tippmann, Jr. ..... F41A 21/00 42/76.01
2003/0047175 A1 * 3/2003 Farrell ..... F41A 11/06 124/76
2004/0065310 A1 * 4/2004 Masse ..... F41B 11/57 124/75
2005/0188977 A1 * 9/2005 Wygant ..... A63B 69/409 124/73
2006/0000510 A1 * 1/2006 Henley ..... F16K 1/305 137/495
2006/0011186 A1 * 1/2006 Jones ..... F41B 11/00 124/73
2006/0162712 A1 * 7/2006 Yeh ..... F41B 11/68 124/73
2007/0012214 A1 * 1/2007 Yeh ..... F41B 11/62 102/502
2007/0062509 A1 * 3/2007 Campo ..... F41B 11/57 124/73
2007/0119988 A1 * 5/2007 Sheng ..... F41B 11/721 239/525
2007/0181117 A1 * 8/2007 Tippmann, Jr. ..... F41B 11/00 124/74
2007/0209650 A1 * 9/2007 Jones ..... F41B 11/73 124/73
2008/0127960 A1 * 6/2008 Gan ..... F41B 11/62 124/75
2008/0135031 A1 * 6/2008 Gan ..... F41B 11/721 124/75
2008/0173291 A1 * 7/2008 Halmone ..... F41B 11/73 124/77
2009/0145413 A1 * 6/2009 Li ..... F41B 11/721 124/73
2009/0194088 A1 * 8/2009 Tippmann, Jr. ..... F41A 11/00 124/74
2009/0241931 A1 * 10/2009 Masse ..... F41B 11/62 124/76
2010/0101550 A1 * 4/2010 Carnall ..... F41A 3/12 124/76
2010/0199963 A1 * 8/2010 Liao ..... F41B 11/723 124/75
2010/0212648 A1 * 8/2010 Tseng ..... F41B 11/73 124/39
2010/0224180 A1 * 9/2010 Tippmann, Jr. ..... F41A 35/00 124/74
2010/0282231 A1 * 11/2010 Chen ..... F41B 11/72 124/73
2010/0282324 A1 * 11/2010 Page ..... F41B 11/62 137/1
2010/0326414 A1 * 12/2010 Maeda ..... F41B 11/51 124/74
2011/0048395 A1 * 3/2011 Maeda ..... F41B 11/62 124/76
2011/0120437 A1 * 5/2011 Tippmann, Jr. ..... F41B 11/55 124/74
2011/0186026 A1 * 8/2011 Tippmann, Sr. ..... F41B 11/00 124/73
2011/0232618 A1 * 9/2011 Gabrel ..... F41B 11/723 124/73
2012/0180772 A1 * 7/2012 St. Phillips ..... F41B 11/62 124/73
2012/0227724 A1 * 9/2012 Soueidan ..... F41B 11/723 124/73
2012/0255534 A1 * 10/2012 Cole ..... F41B 11/52 124/77
2012/0318251 A1 * 12/2012 Tseng ..... F41B 11/721 124/73
2013/0298892 A1 * 11/2013 Hou ..... F41B 11/62 124/73
2014/0026878 A1 * 1/2014 Jones ..... F41B 11/721 124/75
2014/0060509 A1 * 3/2014 Tseng ..... F41A 9/67 124/40
2014/0060512 A1 * 3/2014 Macy ..... F41B 11/62 124/73
2014/0096757 A1 * 4/2014 Larmer ..... F41B 11/52 124/73
2014/0096758 A1 * 4/2014 Gardner, Jr. ..... F41B 11/721 124/73
2014/0305419 A1 * 10/2014 Liao ..... F41B 11/721 124/73
2014/0338649 A1 * 11/2014 Williams ..... F41B 11/721 124/73
2015/0020787 A1 * 1/2015 Tseng ..... F41B 11/00 124/73
2015/0253102 A1 * 9/2015 Macy ..... F41B 11/643 124/76
2016/0033230 A1 * 2/2016 Lort ..... F41B 11/723 124/77
2016/0047620 A1 * 2/2016 Tseng ..... F41B 11/721 124/65
2016/0363414 A1 * 12/2016 Tseng ..... F41B 11/723
2017/0160046 A1 * 6/2017 Shen ..... F41B 11/723
2017/0176133 A1 * 6/2017 Sullivan ..... F41B 11/70
2018/0120051 A1 * 5/2018 Hague ..... F41B 11/723
2018/0142984 A1 * 5/2018 Harvey ..... F41B 11/723

* cited by examiner

EFFICIENT HIGH-VELOCITY COMPRESSED GAS-POWERED GUN

CROSS-REFERENCE TO RELATED APPLICATIONS

This application is a continuation-in-part of U.S. patent application Ser. No. 15/340,681, entitled "Efficient High-Velocity Compressed Gas-Powered Gun," filed Nov. 1, 2016, incorporated by reference, which is a continuation of U.S. application Ser. No. 14/551,833, entitled "Efficient High-Velocity Compressed Gas-Powered Gun," filed Nov. 24, 2014, incorporated by reference.

BACKGROUND

A compressed gas-powered gun that has the same form factor as an AR-15, one of the most common automatic rifles on the market, is useful because it allows a user to practice with an AR-15-like gun without the need to purchase AR-15 ammunition or the need to go to a gun range for practice. It is challenging to build an accurate, efficient, compressed gas-powered gun that has the form factor of an AR-15.

BRIEF DESCRIPTION OF THE DRAWINGS

FIG. 10A is a plan view of the bolt assembly.

FIG. 10B is a plan view of the bolt assembly of FIG. 10A with a bolt carrier removed.

FIG. 10C is a plan view of the bolt assembly of FIG. 10A with the bolt carrier removed and a bolt lock regulator body and a bolt lock bushing transparent.

FIG. 11A shows a first step in the operation of the bolt assembly of FIG. 10A.

FIG. 11B shows a second step in the operation of the bolt assembly of FIG. 10A.

FIG. 11C shows a third step in the operation of the bolt assembly of FIG. 10A.

FIG. 11D shows a fourth step in the operation of the bolt assembly of FIG. 10A.

DETAILED DESCRIPTION

Figures 1A, 1B, 1C, 1D:
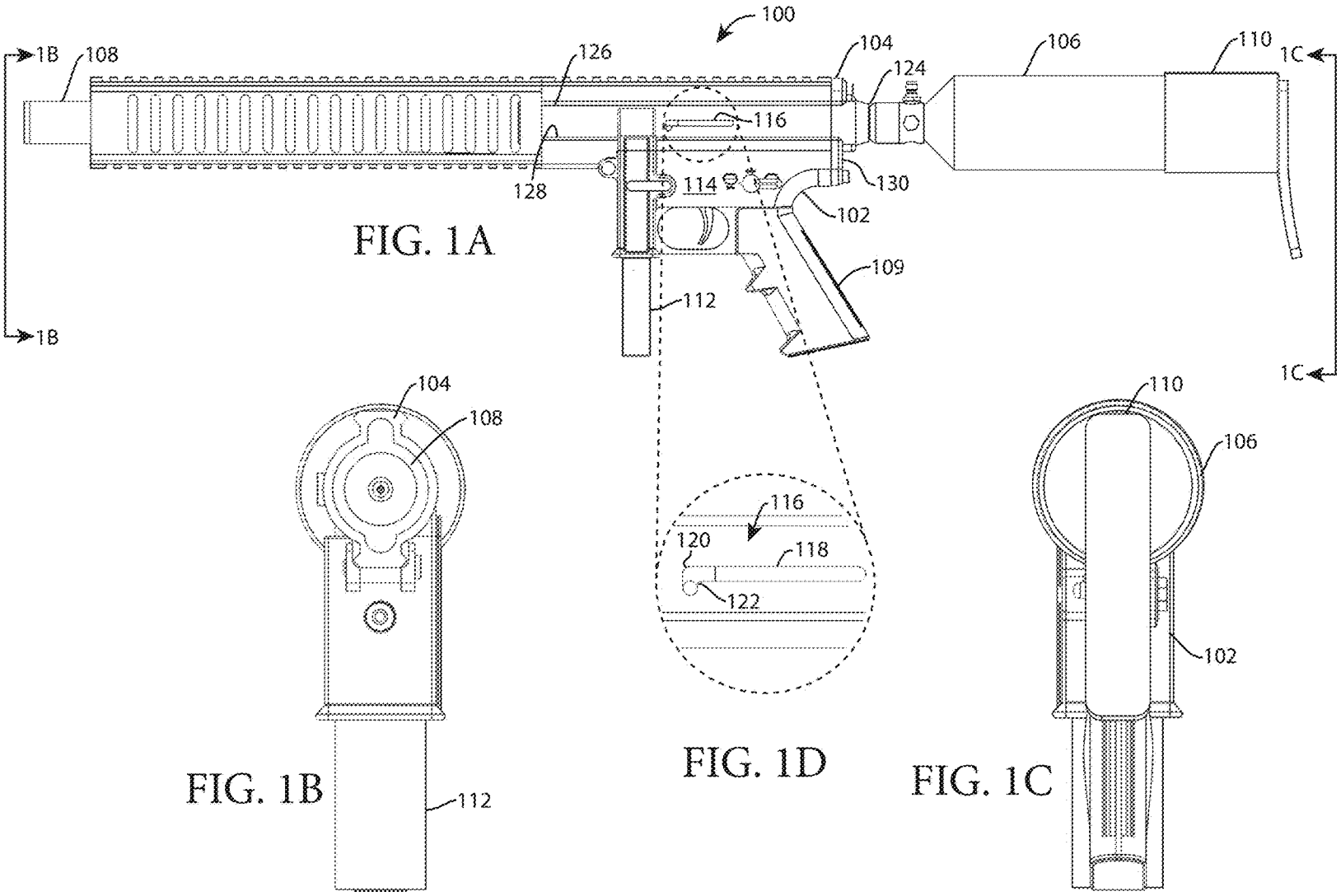
FIG. 1A is a side view diagram illustrating one embodiment of an efficient high-velocity compressed gas-powered gun.
FIG. 1B is an end view of the gun of FIG. 1A along sight lines 1B.
FIG. 1C is an end view of the gun of FIG. 1A along sight lines 1C.
FIG. 1D is an expanded view of a portion of the gun of FIG. 1A as indicated by the dashed circle.

FIG. 1A is a side view diagram illustrating one embodiment of an efficient high-velocity compressed gas-powered gun 100. FIG. 1B is an end view of the gun 100 along sight lines 1B. FIG. 1C is an end view of the gun 100 along sight lines 1C. FIG. 1D is an expanded view of a portion of the gun 100 as indicated by the dashed circle. In one or more embodiments, the gun 100 includes a lower receiver 102 coupled to an upper receiver 104. Additionally, the gun 100 may include a compressed gas power source (such as a gas bottle) 106 and a barrel 108. Optionally, the gun 100 may include a grip 109, a hand guard (not shown) a butt stock 110, and other optional components, such as a magazine 112, flashlight (not shown), optics (not shown), etc.

The lower receiver 102 includes a trigger assembly 114 (designated in FIG. 1A but hidden by a cover on the lower receiver 102). The upper receiver 104 includes a bolt assembly (discussed below in connection with FIGS. 12A-C and 13A-D) and an L-shaped slot 116, which has a long leg 118, a junction 120, and a short leg 122, as shown in FIG. 1D.

The upper receiver 104 has a rear end 124 to which the compressed gas power source 106 can be coupled, and a front end 126 from which the barrel 108 extends. The upper receiver 104 also includes a gas path (discussed below in connection with FIGS. 2, 3A-E, 4A-F, 5A-C, and 6A-C) for firing a projectile through a barrel and for cocking the bolt assembly. In one or more embodiments, the gas path is entirely contained by the upper receiver. The lower receiver 102 has a top 128 and a rear end 130.

Figure 2:
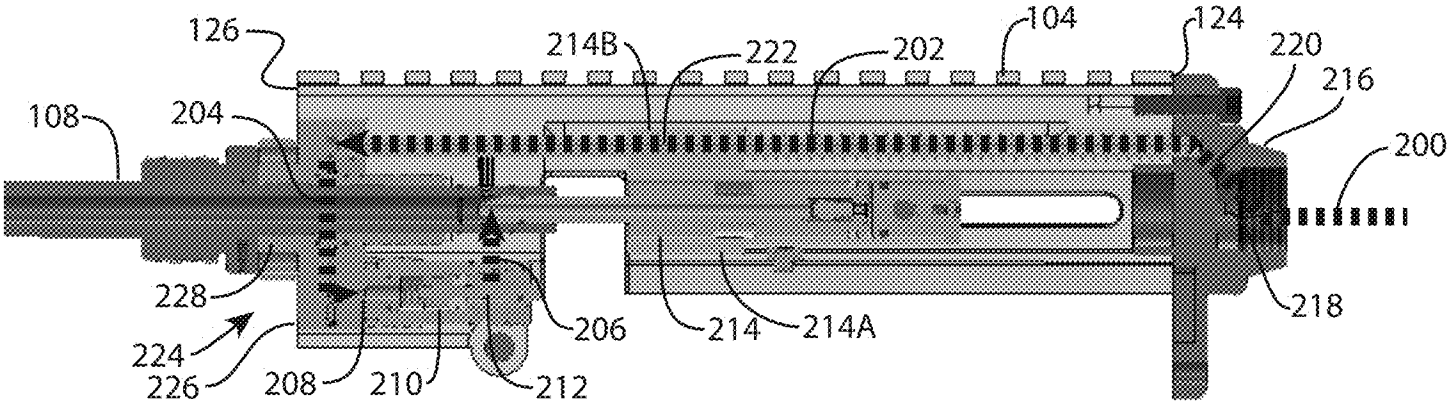
FIG. 2 illustrates a gas path overlaid on a cross-section of an upper receiver.

FIG. 2 illustrates the gas path 200 overlaid on a cross-section of the upper receiver 104. The gas path 200 includes a first segment 202, a second segment 204, and a third segment 206. The first segment provides a path for gas through the upper receiver 104 toward a front end 126 of the upper receiver. The second segment 206 is coupled to the first segment 204 and provides a path for gas toward the rear end 124 of the upper receiver 104 to an input side 208 of a valve 210 that is actuatable by the trigger assembly 114. The third segment is coupled to an output side 212 of the valve 210 and provides a path for gas into the barrel 108 and into the bolt assembly 214, which includes a cocking boss 214A and a spring compression boss 214B.

The first segment 202 of the gas path 200 includes an air source adapter 216 to which the gas bottle 106 can be coupled.

Figure 3A:
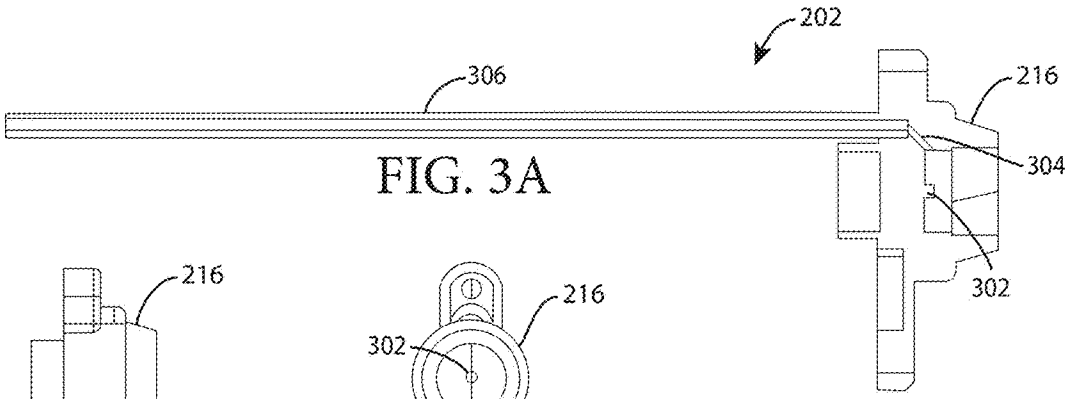
FIG. 3A shows details of a first segment of the gas path of FIG. 2.
Figure 3C:
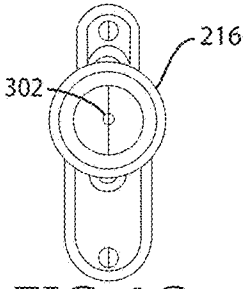
FIG. 3C shows an end view of the air source adapter of FIG. 3B.
Figure 3B:
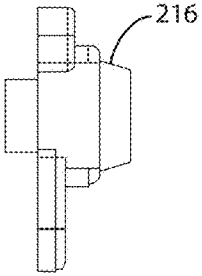
FIG. 3B shows a side view of an air source adapter.
Figure 3D:
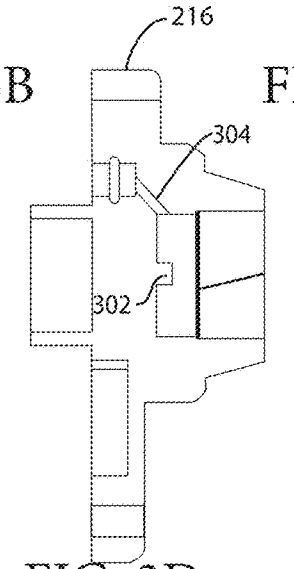
FIG. 3D shows a cross-sectional view of the air source adapter of FIG. 3B.
Figure 3E:
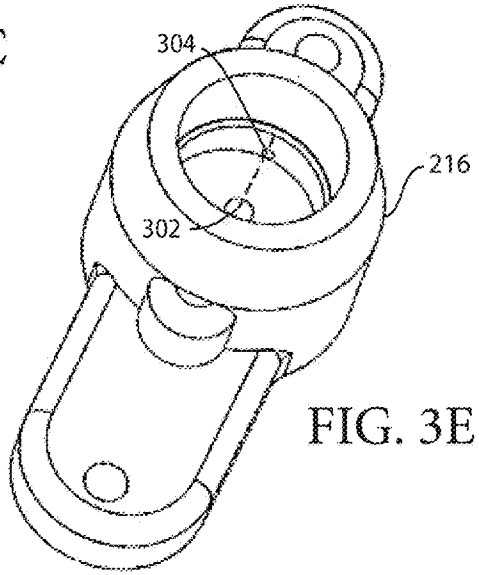
FIG. 3E shows a perspective view of the air source adapter of FIG. 3B.

FIG. 3A shows details of the first segment 202 of the gas path 200. FIG. 3B shows a side view of the air source adapter 216. FIG. 3C shows an end view of the air source adapter 216. FIG. 3D shows a cross-sectional view of the air source adapter 216. FIG. 3E shows a perspective view of the air source adapter 216.

The air source adapter 216 has a boss 302 to release gas from the gas bottle 106 coupled to the air source adapter 216 and an outlet port 304 through which the released gas can flow.

The first segment 202 includes a transfer tube 306 coupled to the outlet port 304 of the air source adapter 216. The transfer tube 306 extends through the upper receiver 104 toward the front end 126 of the upper receiver 104. The transfer tube 306 is hollow.

As can be seen, the first segment 202 provides a gas path through the upper receiver 104 from the compressed gas power source 106, through the outlet port 304 of the air source adapter 216, and through the transfer tube 306 toward the front end of the upper receiver 126.

Returning to FIG. 2, the second segment 204 of the gas path 200 is through a transfer block 224, which includes a transfer bushing 226 and a transfer bushing screw 228.

Figure 4C:
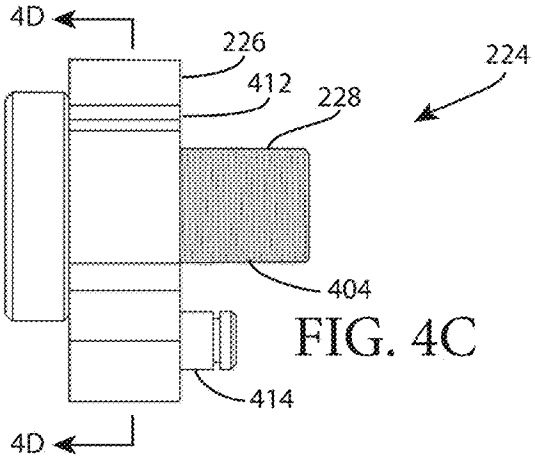
FIG. 4C shows a plan view of a transfer block.
Figure 4F:
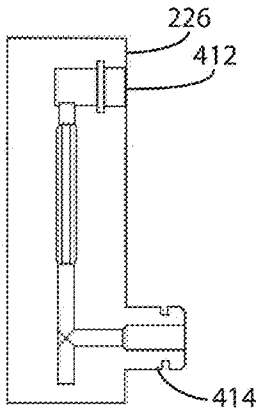
FIG. 4F is a cross-sectional view of the transfer bushing of FIG. 4E.
Figure 4B:
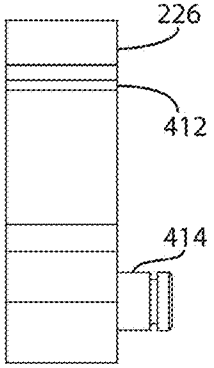
FIG. 4B shows a plan view of a transfer bushing.
Figure 4E:
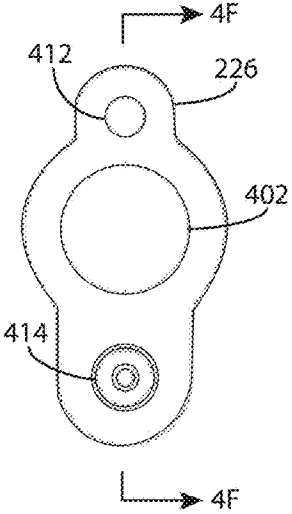
FIG. 4E is an end view of a transfer bushing.
Figure 4A:
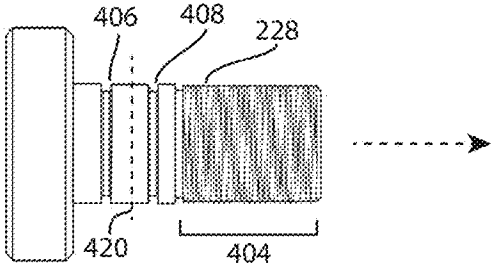
FIG. 4A shows a plan view of a transfer bushing screw.

FIG. 4A shows a plan view of the transfer bushing screw 228. FIG. 4B shows a plan view of the transfer bushing 226.

Figure 4D:
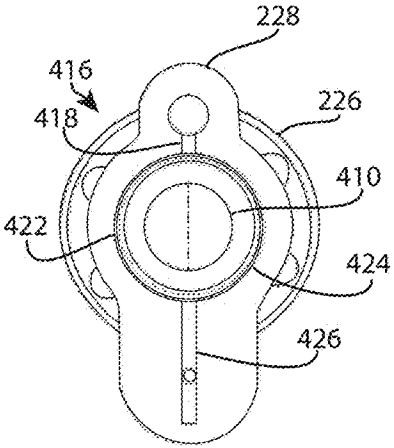
FIG. 4D is a cross-sectional view of the transfer block of FIG. 4C along sight line 4D shown in FIG. 4C.

FIG. 4C shows a plan view of the transfer block 224. FIG. 4D is a cross-sectional view of the transfer block 224 along sight line 4D shown in FIG. 4C. FIG. 4E is an end view of the transfer bushing. FIG. 4F is a cross-sectional view of the transfer bushing 226.

The transfer bushing screw 228 fits through a channel 402 in the transfer bushing 226, as shown by the dashed arrow between FIGS. 4A and 4B, to form the transfer block 224. The transfer bushing screw 228 has a threaded area 404 that mates with a threaded receptacle (not shown) in the upper receiver 104, which secures the transfer bushing 226 to the upper receiver 104. The transfer bushing screw 228 has two O-ring grooves 406, 408 into which O-rings (not shown) fit. The barrel 108 fits through a channel 410 in the transfer bushing screw 228.

The transfer bushing 226 includes an inlet port 412 into which the transfer tube 306 can be inserted, providing the connection between the first segment 202 and the second segment 204 of the gas path 200. The transfer bushing 226 includes an outlet port 414 that mates with the valve 210, described in connection with FIGS. 5A-5C.

The transfer bushing 226 includes a transfer groove 416. The transfer groove 416 has an inlet tube 418 that is in fluid communication with the inlet port 412 and proceeds through the transfer bushing 226 as shown in FIG. 4C along the line 420 shown in FIG. 4A. The inlet tube 418 is in fluid communication with a left barrel-traversing groove 422 and a right barrel-traversing groove 424 that proceed around the transfer bushing screw 228 and the barrel 108 (which passes through channel 410) to an outlet tube 426. The outlet tube 426 intersects the transfer bushing screw 228 along line 420 and is in fluid communication with the outlet port 414.

The left barrel-traversing groove 422 and the right barrel-traversing groove 424 are sealed by O-rings (not shown) that are installed in O-ring slots 406 and 408 when the transfer block 224 is assembled.

Thus, the second segment 204 of the gas path 200 begins at the input port 412, passes through the inlet tube 418, through the left barrel-traversing groove 424 and the right barrel-traversing groove 426, and through the outlet tube 426 to the outlet port 414 which provides a connection to the valve 210.

Figure 5B:
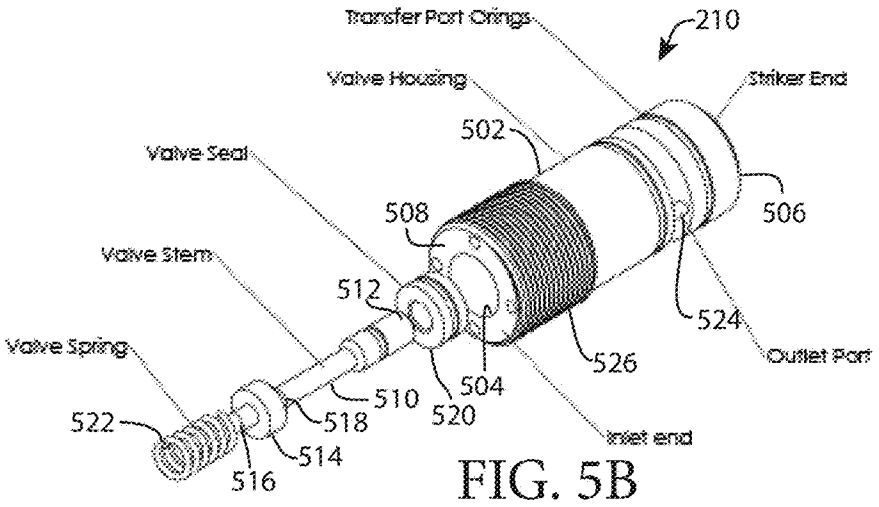
FIG. 5B shows an exploded perspective view of the valve of FIG. 5A.
Figure 5C:
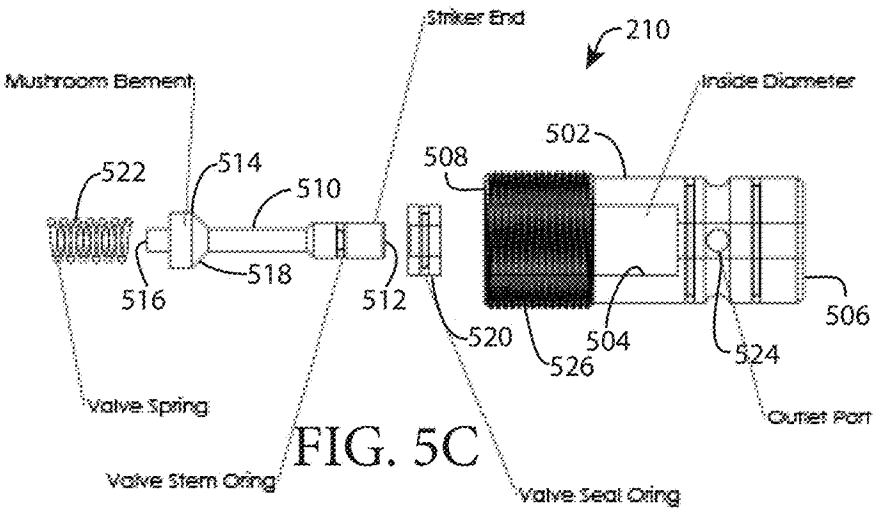
FIG. 5C shows an exploded plan view of the valve of FIG. 5A.
Figure 5A:
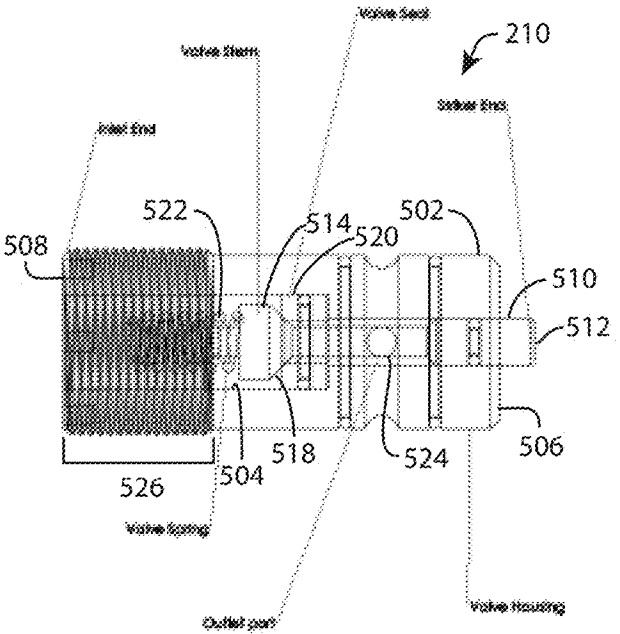
FIG. 5A shows a plan view of a valve.

FIG. 5A shows a plan view of the valve 210. FIG. 5B shows an exploded perspective view of the valve 210. FIG. 5C shows an exploded plan view of the valve 210.

The valve 210 has a valve body 502 having an inside diameter 504, a striker end 506, and an inlet end 508. Note that the valve body 502 is transparent in FIGS. 5A and 5C to allow the other components to be seen. The valve 210 includes a valve stem 510 having a striker end 512 protruding from the striker end 506 of the valve body 502. A mushroom-shaped element 514 is coupled adjacent an inlet end 516 of the valve stem 510. The mushroom-shaped element 514 has a curved surface 518 facing the striker end 512 of the valve stem 510. The valve 210 has a valve seal 520 (which includes a slot for an O-ring) slidably coupled to the valve stem 510 between the mushroom-shaped element 514 and the striker end 512 of the valve stem 510. In use, the valve seal 520 seals against the inside diameter 504 of the valve body 502. The valve 210 includes a valve spring 522 that engages the mushroom-shaped element 514 and urges it against the valve seal 520. The valve 210 includes an outlet port 524 through the valve body 502.

The valve 210 includes threads 526 that mate with corresponding threads (not shown) on the upper receiver 104 around the outlet port 414 on the transfer bushing 226. The outlet port 414 on the transfer bushing 226 compresses the spring 522 and urges the mushroom-shaped element 524 into sealing contact with the valve seal 520.

A path for gas through the valve 210 from the inlet end 508 to the outlet port 524 is created when pressure is exerted on the striker end 512 of the valve stem 510 of sufficient force to overcome the force of the valve spring 522 holding the mushroom-shaped element 514 against the valve seal 520. This valve-opening pressure is applied when the trigger is actuated, as described below.

Figure 6A:
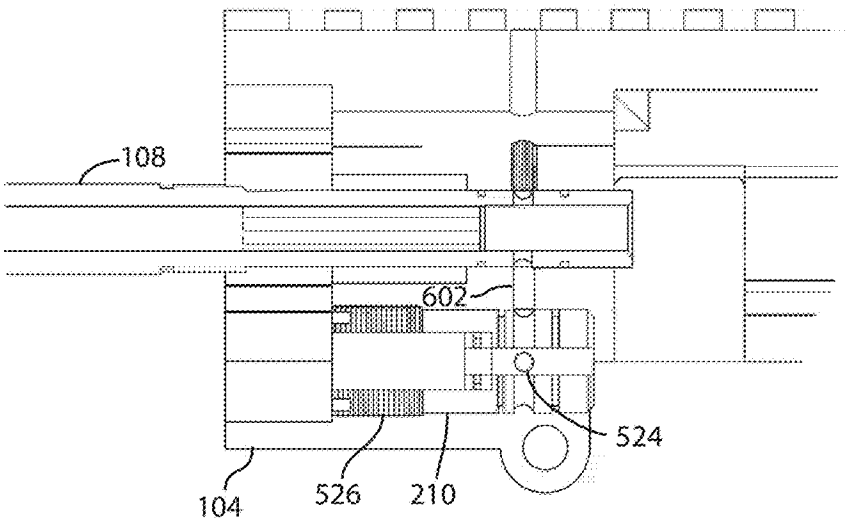
FIG. 6A illustrates a cross-sectional view of a third segment of the gas path of FIG. 2.
Figure 6B:
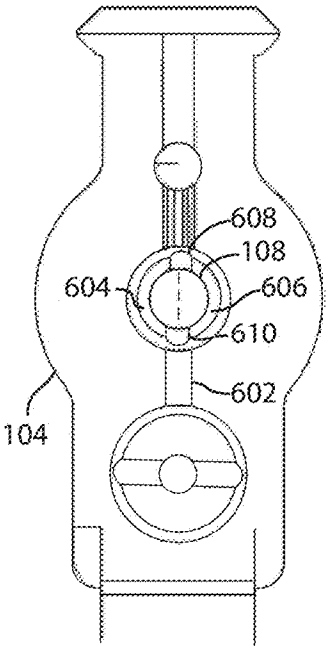
FIG. 6B illustrates a cross-sectional view perpendicular to the view of FIG. 6A of the third segment of the gas path of FIG. 2.
Figure 6C:
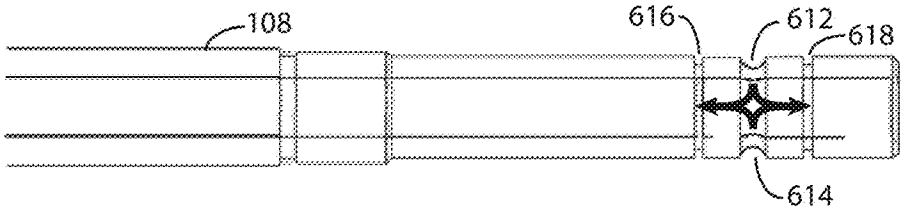
FIG. 6C illustrates the barrel portion of the third segment of the gas path of FIG. 2.

FIG. 6A illustrates a cross-sectional view of the third segment 206 of the gas path 200. FIG. 6B illustrates a cross-sectional view perpendicular to the view of FIG. 6A of the third segment 206 of the gas path 200. FIG. 6C illustrates the barrel portion of the third segment 206 of the gas path 200.

The third segment 206 of the gas path 200 includes a channel 602 through the upper receiver 104, around the barrel 108 through a left barrel-traversing outlet channel 604 and a right barrel-traversing outlet channel 606 to two barrel ports 608 and 610. The barrel 108 includes two input ports 612 and 614. The barrel 108 includes two O-ring grooves 616 and 618 that hold O-rings (not shown) to seal the gas path from the two barrel ports 608 and 610 in the upper receiver 104 to input ports 612 and 614 on the barrel. Gas that enters the barrel 108 through the two input ports 612 and 614 exits on either end of the barrel as shown by the heavy arrows in FIG. 6C. Gas exiting the barrel to the left on FIG. 6C propels a projectile (not shown) from the gun 100. Gas exiting the barrel to the right on FIG. 6C cocks the gun 100, as described in detail below.

Figure 7:
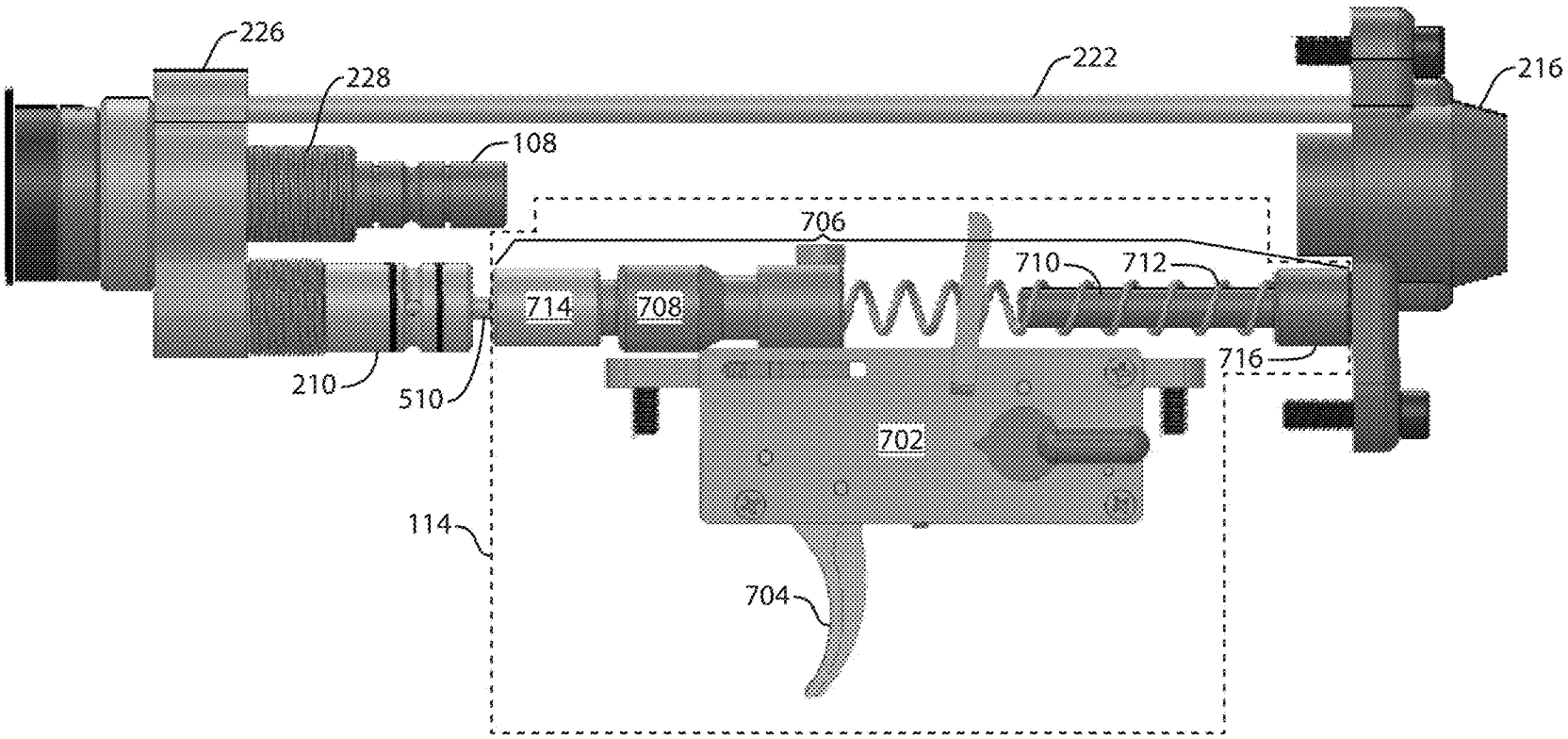
FIG. 7 is a plan view of a trigger assembly in context with elements of the gas path of FIG. 2.

FIG. 7 is a plan view of the trigger assembly 114 in context with elements of the gas path 200. The trigger assembly 114 includes a self-contained and independently removable trigger pack 702, actuatable by pulling a trigger element 704, and a striker assembly 706 that actuates the valve 210 upon actuation of the trigger pack 702.

The striker assembly 706 includes an intermediate striker 708, a cylindrical spring guide 710, a helical main spring 712, and a striker 714.

Figure 8A:
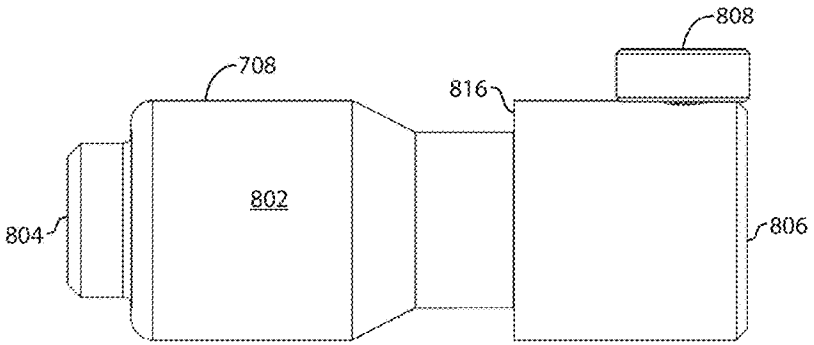
FIG. 8A is a plan view of an intermediate striker.
Figure 8B:
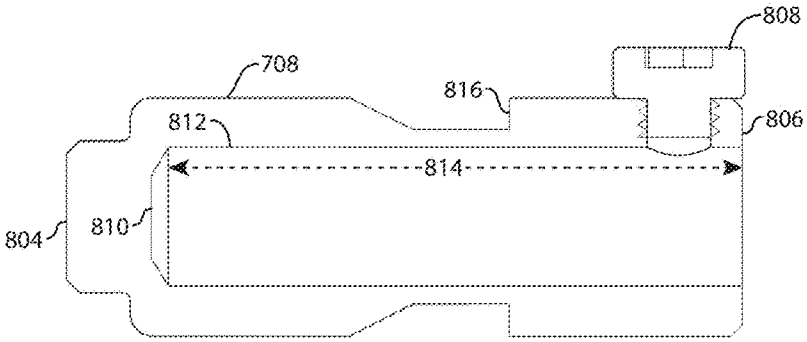
FIG. 8B is a cross-sectional view of the intermediate striker of FIG. 8A.

FIG. 8A is a plan view of the intermediate striker 708. FIG. 8B is a cross-sectional view of the intermediate striker 708. The intermediate striker 708 has longitudinal body 802 having a front end 804 and a rear end 806. The intermediate striker 708 includes a cocking cap screw 808 projecting from the longitudinal body 802 adjacent to the rear end 806 of the longitudinal body 802. The intermediate striker 708 has a longitudinal spring guide orifice 810 partially through the longitudinal body and a main spring compression cavity 812 coaxial with, and having a larger diameter than, the longitudinal spring guide orifice 810. The main spring compression cavity 812 extends a main spring compression depth 814 into the rear end of the longitudinal body 802.

The intermediate striker 708 includes a lock face 816 in the longitudinal body 802. The lock face 816 faces the front end 804 of the longitudinal body 802, is transverse to the longitudinal spring guide orifice 810, and is set back from the rear end 806 of the longitudinal body 802. The cylindrical spring guide 710 is inserted into the longitudinal spring guide orifice 810 (as can be seen in FIG. 7, in which the helical main spring 712 is not compressed). The helical main spring 712 is mounted on the spring guide 710 and is constrained on one end by an intermediate striker stop 716 and contained on the other end by the main spring compression cavity 812. The striker 714 is positioned between the intermediate striker 708 and the valve stem 510 on the valve 210. The striker 714 is contained within the magazine 112 and is used to move energy from the intermediate striker 708 through the magazine 112 and to the valve stem 510.

Figure 9A:
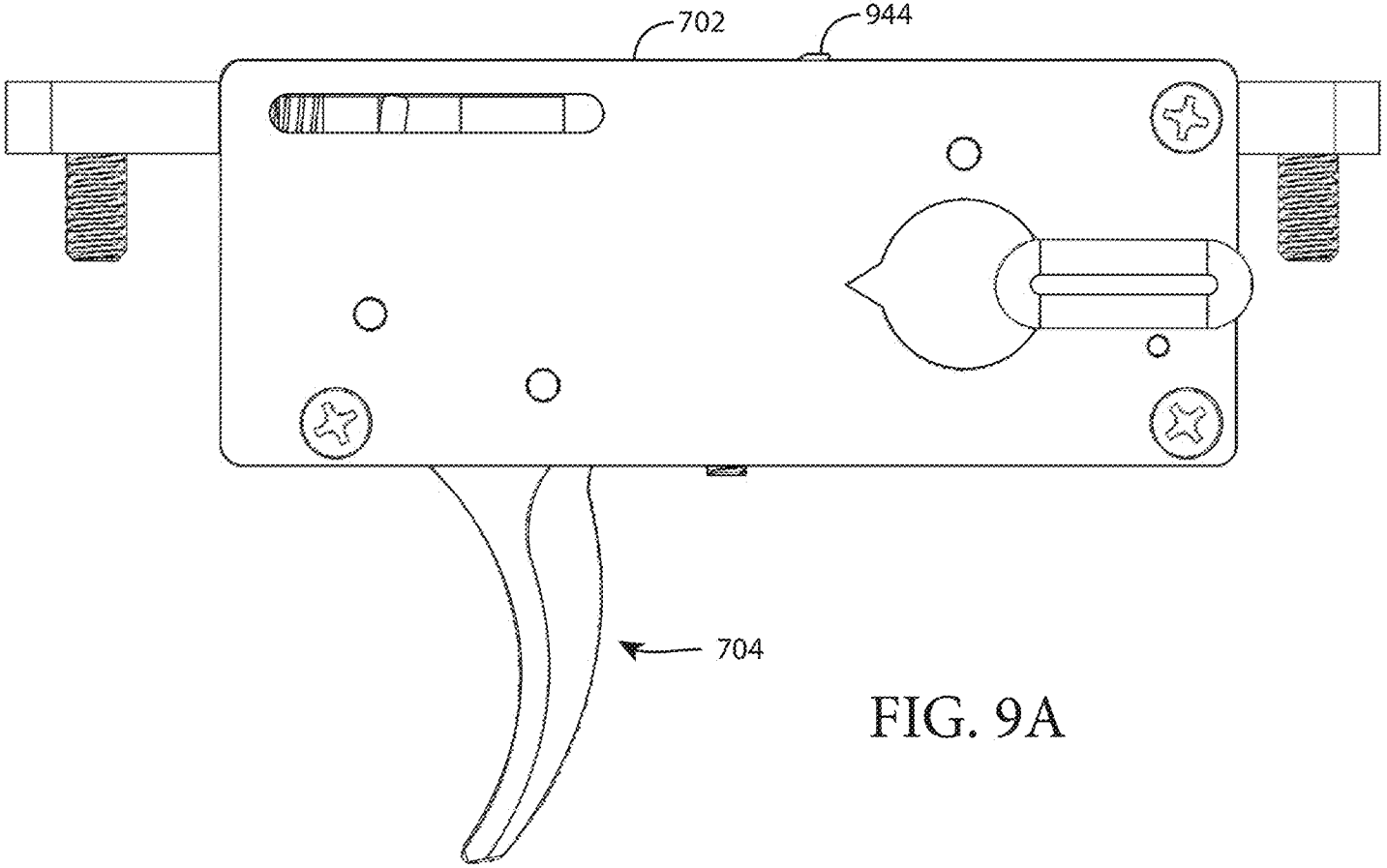
FIG. 9A shows a plan view of a trigger pack.
Figure 9B:
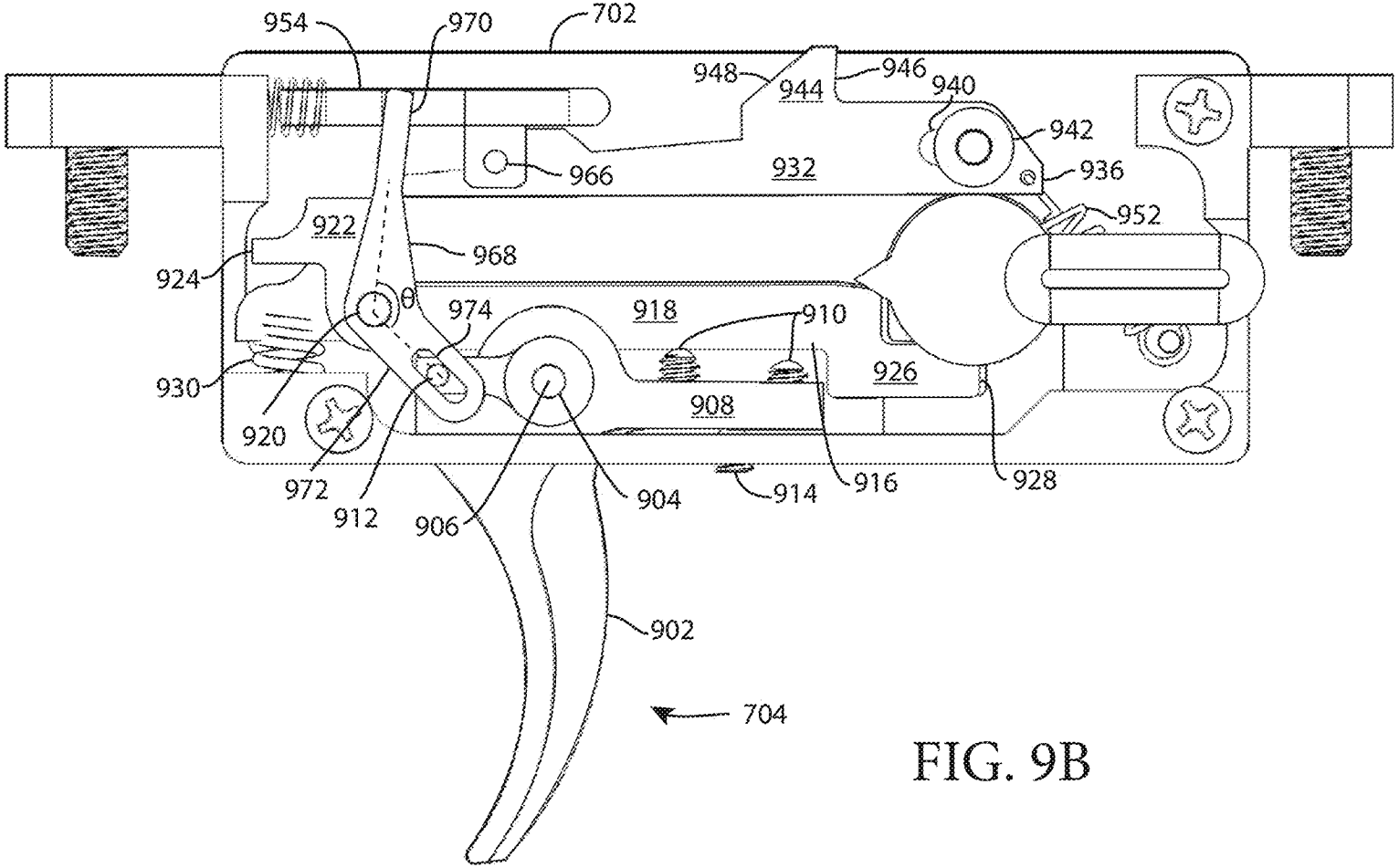
FIG. 9B shows a plan view of the trigger pack of FIG. 9A with its cover plate removed.
Figure 9C:
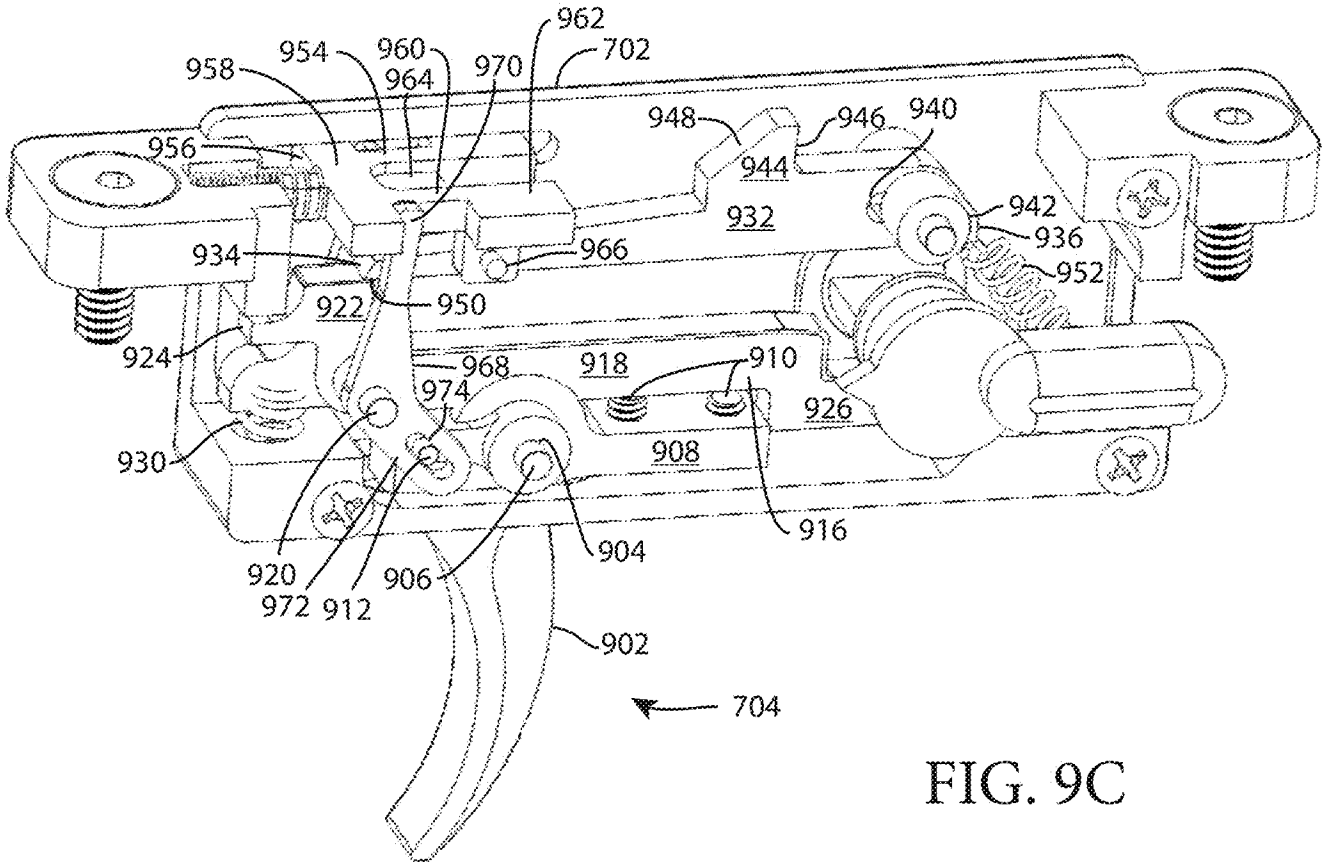
FIG. 9C shows a perspective view of the trigger pack of FIG. 9A with its cover plate removed.
Figure 9D:
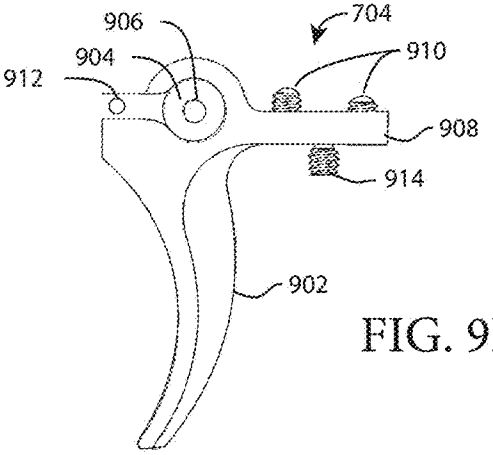
FIG. 9D shows a trigger element.
Figure 9E:
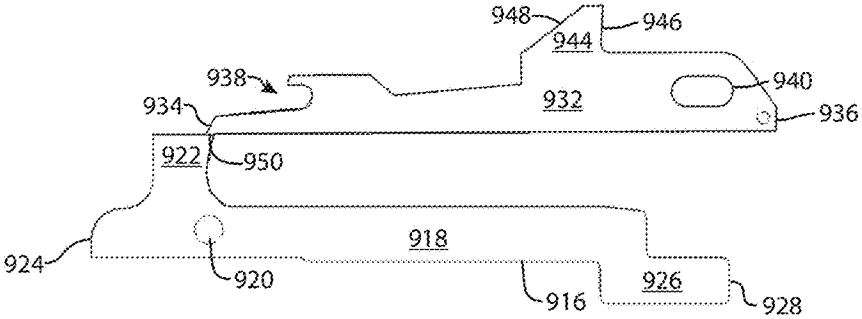
FIG. 9E shows a plan view of a main sear and a shelf sear.

FIG. 9A shows a plan view of the trigger pack 702. FIG. 9B shows a plan view of the trigger pack 702 with its cover plate removed. FIG. 9C shows a perspective view of the trigger pack 702 with its cover plate removed. FIG. 9D shows the trigger element 704. FIG. 9E shows a plan view of the main sear and the shelf sear.

The trigger pack 702 includes the trigger element 704. The trigger element 704 includes a trigger body 902 and a trigger slot 904 to engage a trigger pin 906 coupled to the lower receiver 102 about which the trigger element 704 rotates. The trigger element 704 further includes a shelf-sear engagement arm 908 extending from the trigger slot 904, an adjustment screw 910 (two are shown—one is adjusted to have effect) extending from the shelf-sear engagement arm 908, an auto-sear-linkage engagement pin 912 coupled to the trigger body 902 frontward of the trigger slot 904, and a trigger spring (typically a torsion spring, not shown) engaged with the trigger body 902 urging the trigger element 704 into a before-firing position illustrated in FIG. 9B. The trigger element 704 also includes a trigger pull adjustment screw 914.

FIG. 9E shows interaction between a shelf sear and a main sear. The trigger pack 702 includes a shelf sear 916. The shelf sear 916 has an elongated body 918 that rotates around an auto-sear-linkage pin 920 coupled to the lower receiver 102. The shelf sear 916 includes a main-sear-supporting arm 922 adjacent to a front end 924 of the shelf sear elongated body 918. The shelf sear 916 includes an L-shaped element 926 adjacent to a rear end 928 of the shelf sear elongated body 918. A shelf sear spring 930 is coupled to the front end 924 of the shelf sear elongated body 918. The shelf sear spring 930 urges the shelf sear 916 to rotate about the auto-sear-linkage pin 920.

The trigger pack 702 includes a main sear 932. The main sear 932 has a main sear front end 934 and a main sear rear end 936. The main sear 932 includes a hook-shaped cutout 938 adjacent the main sear front end 934. The main sear 932 includes a slot 940 engaged with a main sear pin 942 coupled to the lower receiver 102. The main sear 932 includes a tab 944 having a rearward facing flat face 946 that engages the lock face 816 of the intermediate striker 708 when the main sear 932 is in a before-firing position. The tab 944 includes a forward facing ramped face 948. The main sear 932 includes a main-sear shelf 950 that engages the main-sear-supporting arm 922 of the shelf sear 916 when the main sear 932 is in the before-firing position.

The trigger pack 702 includes a main sear spring 952 coupled adjacent to the main sear rear end 936 that urges the main sear 932 to move and rotate about the main sear pin 942 as constrained by the slot 940 in the main sear 932.

Figure 9G:
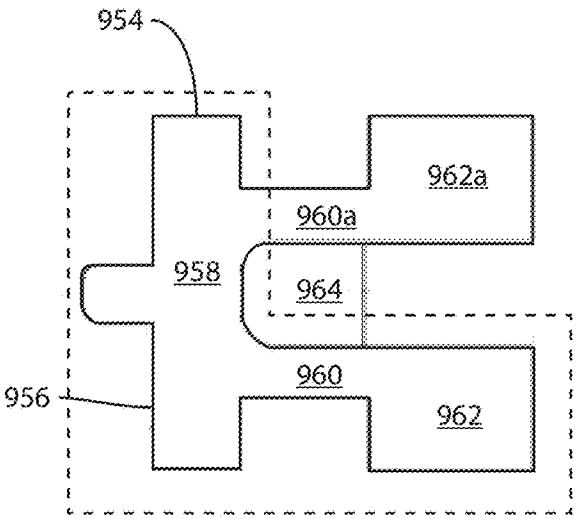
FIG. 9G is a top view of the auto sear of FIG. 9F.
Figure 9F:
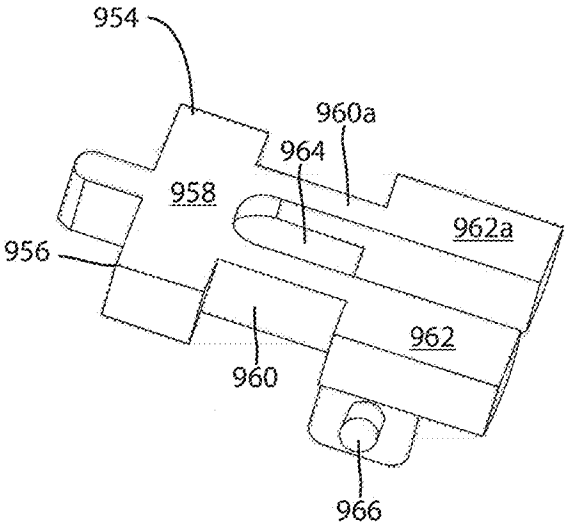
FIG. 9F is a perspective view of an auto sear.
Figure 9H:
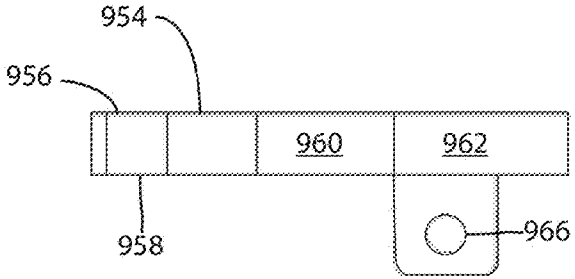
FIG. 9H is a plan view of the auto sear of FIG. 9F.

FIGS. 9F-H illustrate an auto sear. The trigger pack 702 includes an auto sear 954. The auto sear 954 includes a lower-case-h-shaped auto-sear body 956 (outlined by a dashed box in FIG. 9G) having a main body 958, a cross piece 960 extending from the main body 958, and an end piece 962 extending from the cross piece 960. The auto sear 954 includes a shelf 964 in an area between the main body 958 and the cross piece 960 and an auto-sear pin 966 coupled to the end piece 962.

The trigger pack 702 includes a trigger-to-auto-sear linkage 968 coupled to and rotatable around the auto-sear-linkage pin 920. The trigger-to-auto-sear linkage 968 includes a pusher arm 970 extending from the auto-sear-linkage pin 920 into an area between the main body 958 and the end piece 962 of the auto sear 954 and a pinned arm 972 from the auto-sear-linkage pin 920 at an obtuse angle θ from the pusher arm 970. The pinned arm 972 has a trigger-to-auto-sear-linkage slot 974 that engages with the auto-sear-linkage engagement pin 912.

In one or more embodiments, the auto sear 954 includes a second cross piece 960*a* and a second end piece 962*a* and the trigger pack 702 includes a second trigger-to-auto sear linkage (not shown) coupled to and rotatable around the auto-sear-linkage pin 920. The second trigger-to-auto sear linkage (not shown) is on the opposite side of the main sear 932 from the trigger-to-auto-sear linkage 968. The second trigger-to-auto sear linkage (not shown) engages the auto sear 954 between the second cross piece 960*a* and the second end piece 962*a* and engages the auto-sear-linkage engagement pin 912 in the same way that the trigger-to-auto-sear linkage 968. The interaction between the auto sear 954 and the trigger-to-auto sear linkage 968 and the second trigger-to-auto sear linkage (not shown) provides a balanced pull on the auto sear 954 when the trigger body 902 is pulled.

Figure 9I:
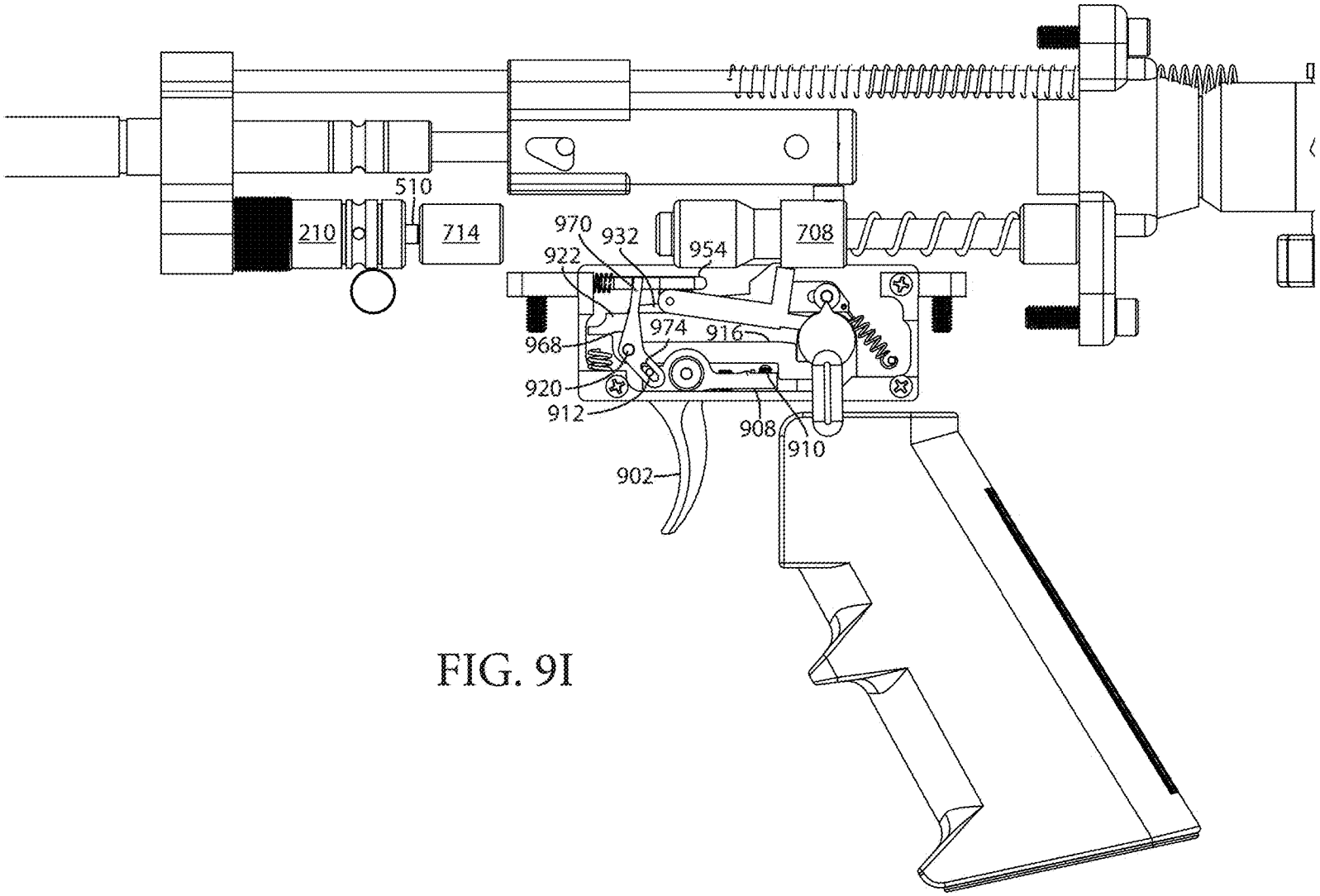
FIG. 9I shows a trigger assembly of FIGS. 9A-C in the before-firing position.
Figure 9J:
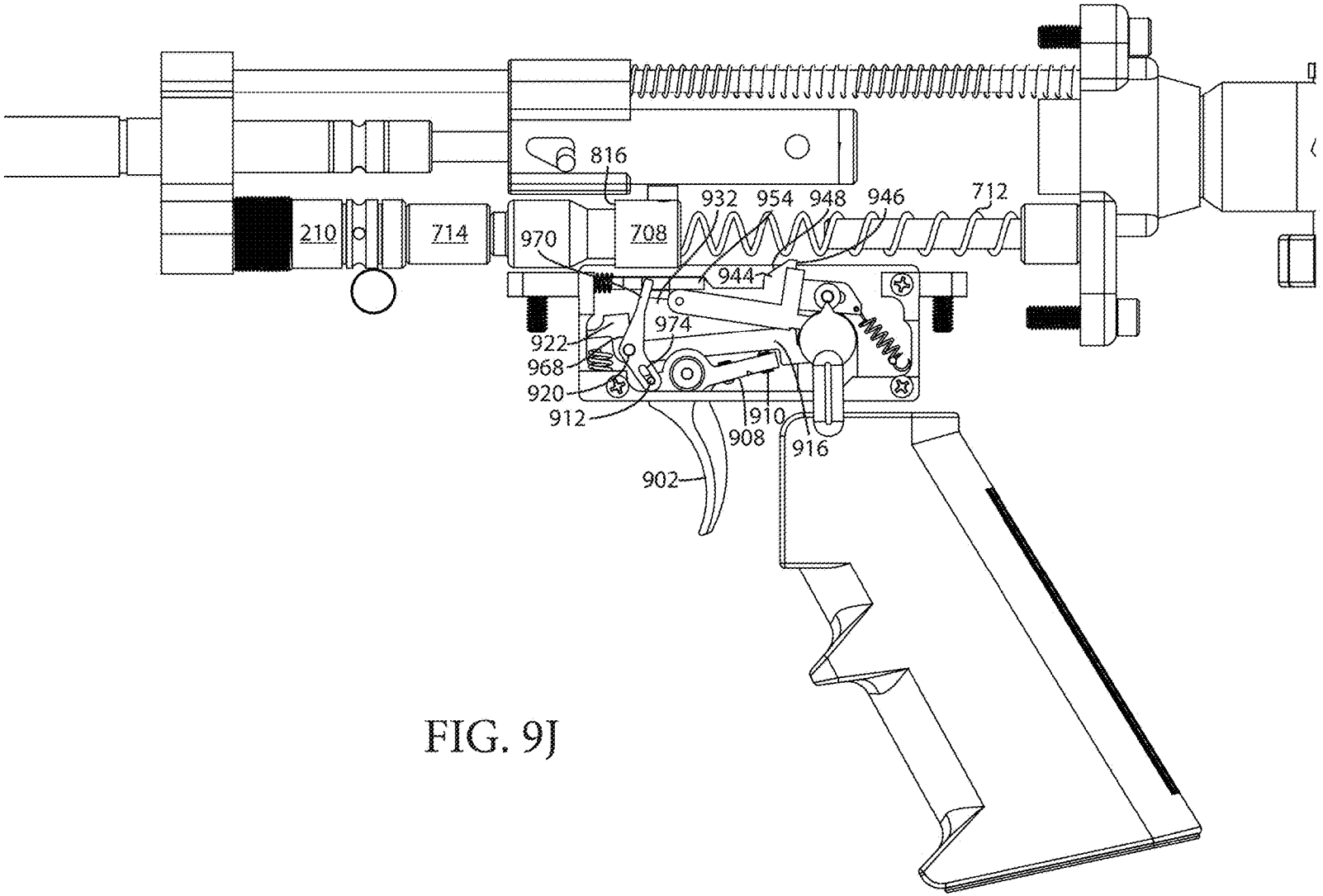
FIG. 9J shows the trigger assembly FIGS. 9A-C in an after-firing position.

FIG. 9I shows the trigger assembly 114 in the before-firing position. FIG. 9J shows the trigger assembly 114 in an after-firing position.

Moving the trigger body 902 from a before-firing position, shown in FIG. 9I, to an after-firing position, shown in FIG. 9J, causes the adjustment screw 910 extending from the shelf-sear engagement arm 908 to engage the shelf sear 916 and cause the shelf sear 916 to rotate about the auto-sear-linkage engagement pin 912 so that the main-sear-supporting arm 922 no longer supports the main sear 932 and the trigger-to-auto-sear linkage 968 to rotate around the auto-sear-linkage pin 920 as constrained by the trigger-to-auto-sear-linkage slot 974 such that the pusher arm 970 of the trigger-to-auto-sear linkage 968 pushes the auto sear 954 from a before-firing position, shown in FIG. 9I, to an after-firing position, shown in FIG. 9J.

As a result of the main-sear-supporting arm 922 no longer supporting the main sear 932, the intermediate striker 708 causes the main sear 932 to rotate such that the tab 944 on the main sear 932 no longer engages the lock face 816 of the intermediate striker 708, allowing the intermediate striker 708 to move to cause the striker 714 to engage the valve stem 510 to open the valve 210. After the intermediate striker 708 moves, the main sear spring 952 causes the main sear 932 to return to its before-firing position, illustrated in FIG. 9I.

The intermediate striker 708, upon being urged rearwardly by the bolt assembly 214 in a cocking action, engages the forward facing ramped face 948 of the main sear tab 944, causing the main sear 932 to deflect out of the path of the intermediate striker 708. The intermediate striker 708 compresses the main spring 712. The intermediate striker 708 then moves forwardly causing the lock face 816 of the intermediate striker 708 to engage the rearward facing flat face 946 of the main sear tab 944. This causes the main sear 932 to move forwardly, which causes the hook-shaped cutout 938 of the main sear 932 to engage with the shelf 964 of the auto sear 954.

Releasing the trigger causes the trigger body 902 to move from the after-firing position, illustrated in FIG. 9J, to the before-firing position, illustrated in FIG. 9I, causing the trigger-to-auto-sear linkage 968 to rotate and push the auto sear 954 from the after-firing position, illustrated in FIG. 9J, to the before-firing position, illustrated in FIG. 9I, which allows the main sear 932 to drop until the main sear 932 engages the main sear supporting arm 922 of the shelf sear 916.

Figure 9K:
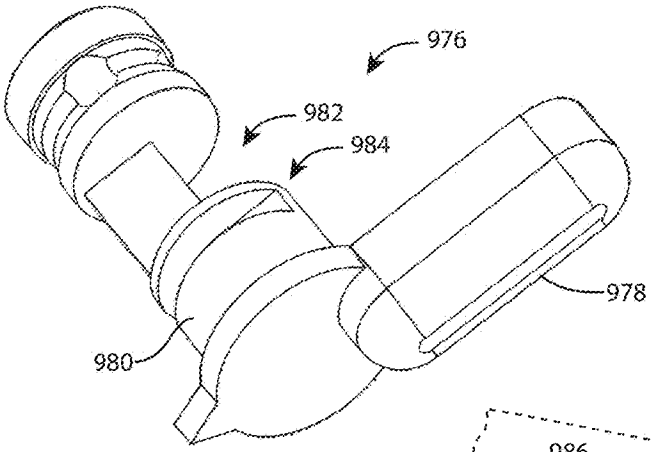
FIG. 9K is a perspective view of a selector switch.
Figure 9M:
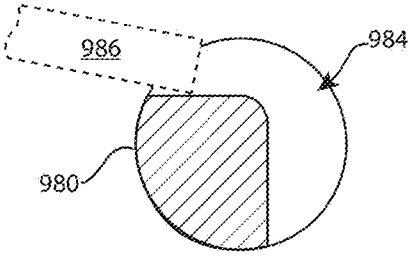
FIG. 9M is a cross sectional view of the selector switch of FIGS. 9K and 9L along sight line 9M.
Figure 9N:
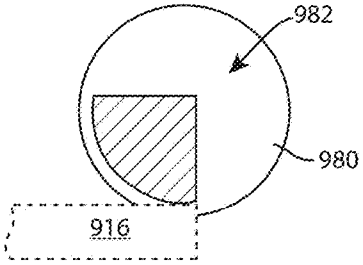
FIG. 9N is a cross sectional view of the selector switch of FIGS. 9K and 9L along sight line 9N.
Figure 9L:
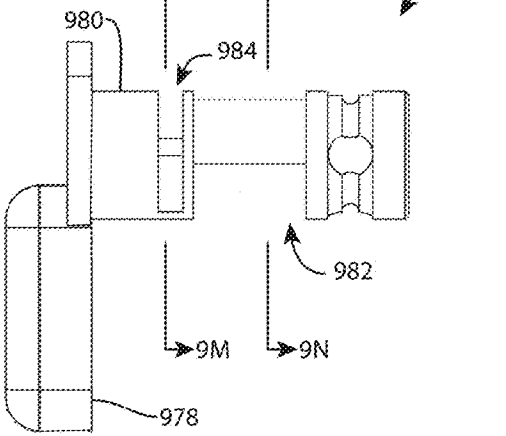
FIG. 9L is a plan view of the selector switch of FIG. 9K.
Figure 9O:
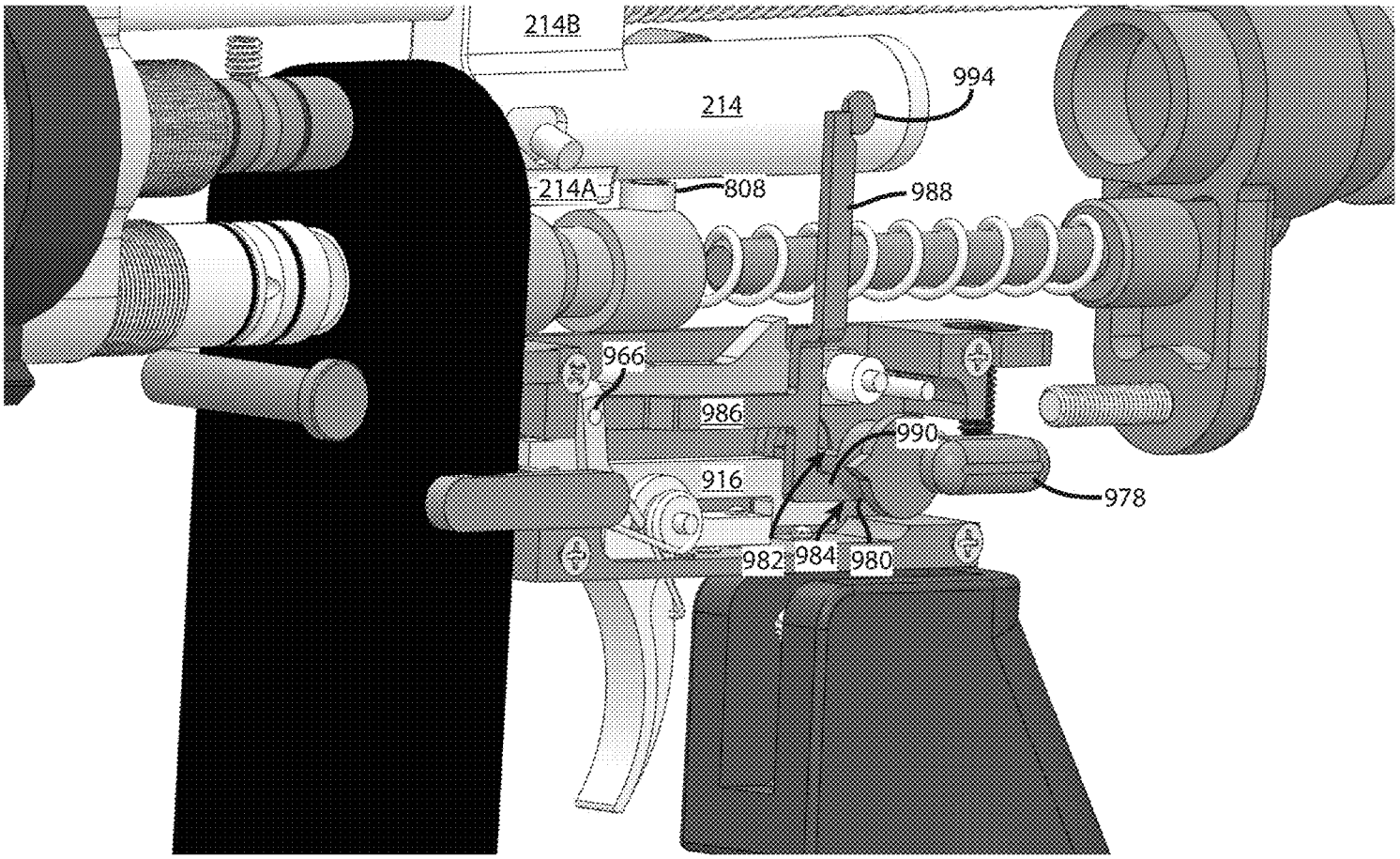
FIG. 9O is a perspective view of portions of the gun.

FIG. 9K is a perspective view of a selector switch. FIG. 9L is a plan view of a selector switch. FIG. 9M is a cross sectional view of the selector switch of FIGS. 9K and 9L along sight line 9M. FIG. 9N is a cross sectional view of the selector switch of FIGS. 9K and 9L along sight line 9N. FIG. 9O is a perspective view of portions of the gun.

The trigger assembly 114 includes a selector switch 976 having a lever element 978 coupled to a barrel element 980. The barrel element 980 has a shelf-sear detent 982 and a selector-switch-to-auto-sear-linkage detent 984. As can be seen in FIG. 9O, the shelf sear 916 rides within the shelf-sear detent 982 and a selector-switch-to-auto-sear linkage 986 (which for clarity of presentation was not shown in FIGS. 9A-C and I-J) rides within the selector-switch-to-auto-sear linkage detent 984.

The selector switch has three selectable positions. The first position is a safety position (the selector switch's position in FIGS. 9M-O), in which the shelf-sear detent 982 does not face the shelf sear 916 (shown as a dashed box in FIG. 9N). In the safety position, the shelf sear 916 is prevented from moving in response to movement of the trigger body 902.

The second position is a semi-automatic position in which the selector switch 976 is rotated counter-clockwise 90 degrees from the position shown in FIGS. 9M-O, the shelf-sear detent 982 faces the shelf sear 916, and the selector-switch-to-auto-sear-linkage detent 984 faces the selector-switch-to-auto-sear linkage 986 (shown as a dashed box in FIG. 9M). In the semi-automatic position, the shelf sear 916 can move in response to movement of the trigger body 902 and the selector-switch-to-auto-sear linkage 986 remains in the orientation shown in FIG. 9M and FIG. 9O.

The third position is an automatic position in which the selector switch 976 is rotated 180 degrees from the position shown in FIGS. 9M-O, the shelf-sear detent 982 faces the shelf sear, and the selector-switch-to-auto-sear-linkage detent 984 does not face the selector-switch-to-auto-sear linkage 986.

The selector-switch-to-auto-sear linkage 986 is rotatably coupled to the auto-sear pin 966 and has a bolt-engaging arm 988 and a selector-switch arm 990 that engages with the barrel element 980 of the selector switch 976. When the selector switch 976 is in the automatic position, the selector-switch-to-auto-sear linkage 986 is deflected upward from the position shown in FIG. 9O so that the bolt-engaging arm 988 is in the path of movement of an auto-actuator-to-bolt set screw 994 on the bolt assembly 214, as discussed in more detail in connection with FIGS. 10A-E.

Moving the selector switch 976 to the automatic position prevents the selector-switch-to-auto-sear-linkage detent 984 from engaging the selector-switch-to-auto-sear linkage 986 so that the bolt-engaging arm is in a bolt-engaging position.

Moving the selector switch 976 to the semi-automatic position causes the selector-switch-to-auto-sear-linkage detent 984 to engage the selector-switch-to-auto-sear linkage 986 so that bolt-engaging arm 988 is in a non-bolt-engaging position. In this position, the bolt assembly 214 engages the bolt-engaging arm 988 of the selector-switch-to-auto-sear linkage 984 after the bolt assembly 214 achieves a bolt lock condition causing the auto sear 954 to move from the after-firing-position, shown in FIG. 9J, to the before-firing position, shown in FIG. 9I.

Figure 10A:
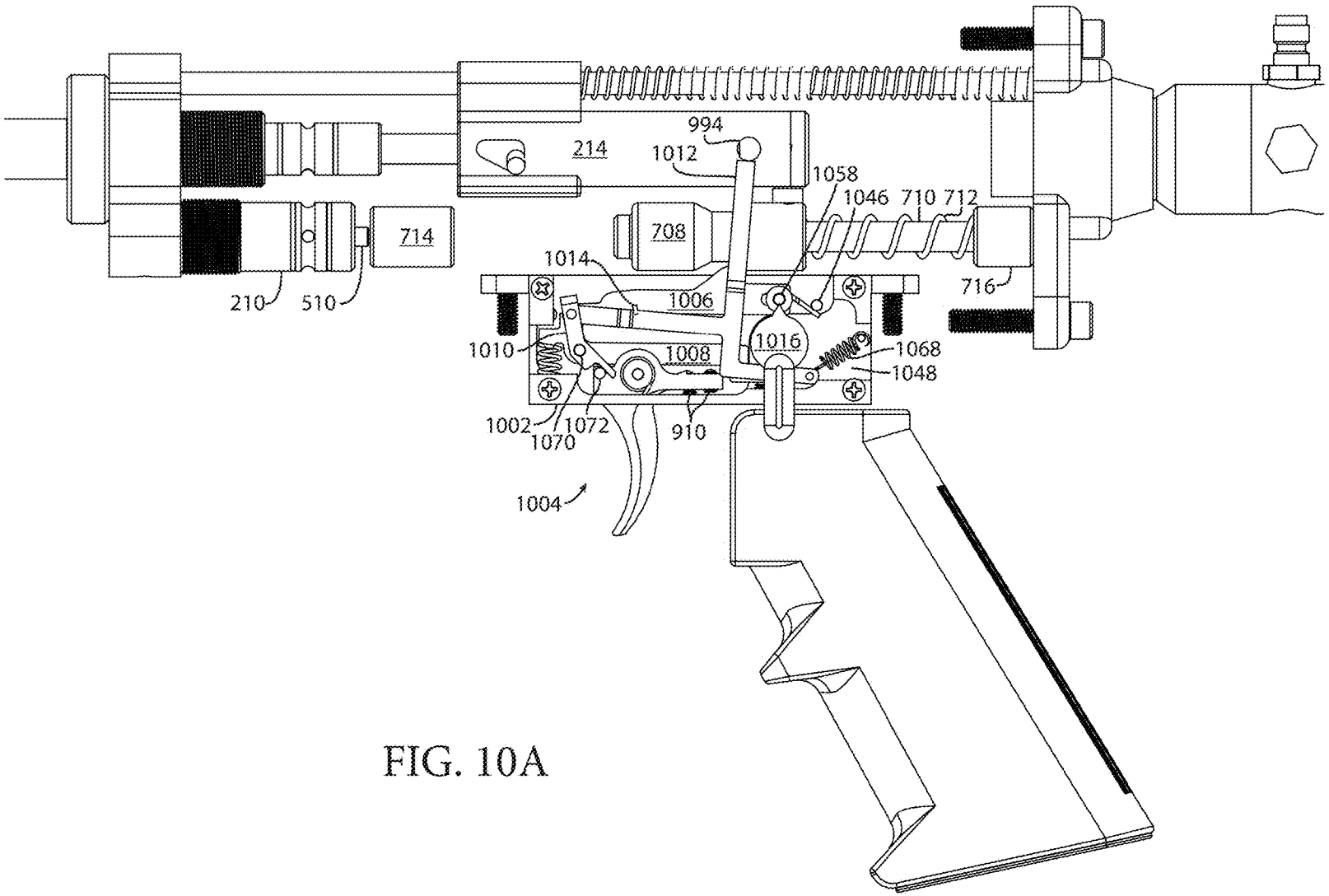
FIG. 10A shows an alternative trigger pack ready to fire in the semi-automatic mode.
Figure 10C:
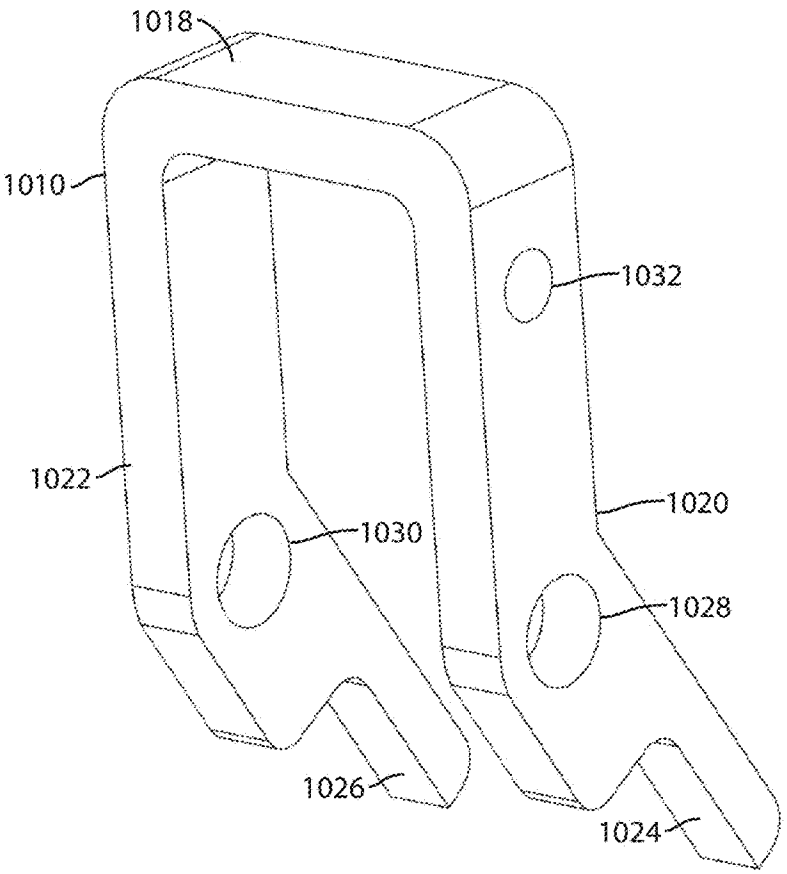
FIG. 10C shows a perspective view of an actuator for the alternative trigger pack of FIG. 10A.
Figure 10B:
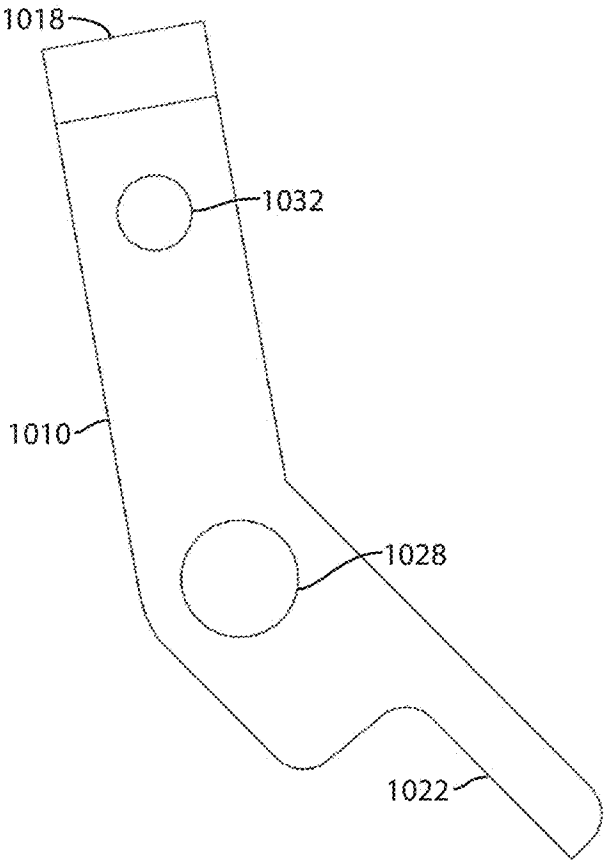
FIG. 10B shows a plan view of an actuator for the alternative trigger pack of FIG. 10A.
Figure 10E:
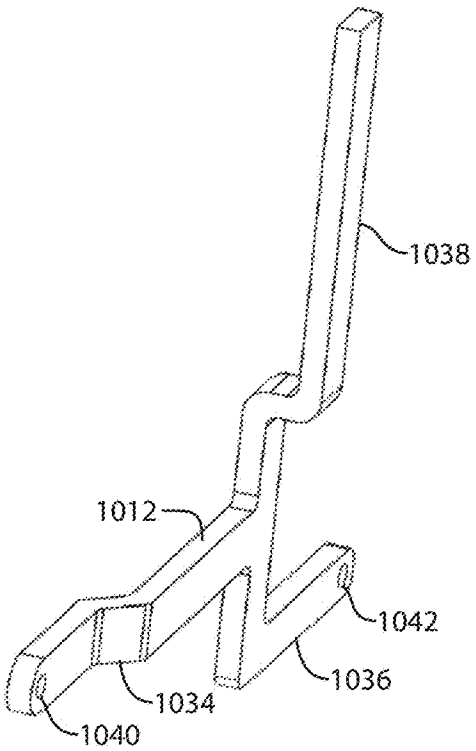
FIG. 10E shows a perspective view of an auto link connector for the alternative trigger pack of FIG. 10A.
Figure 10D:
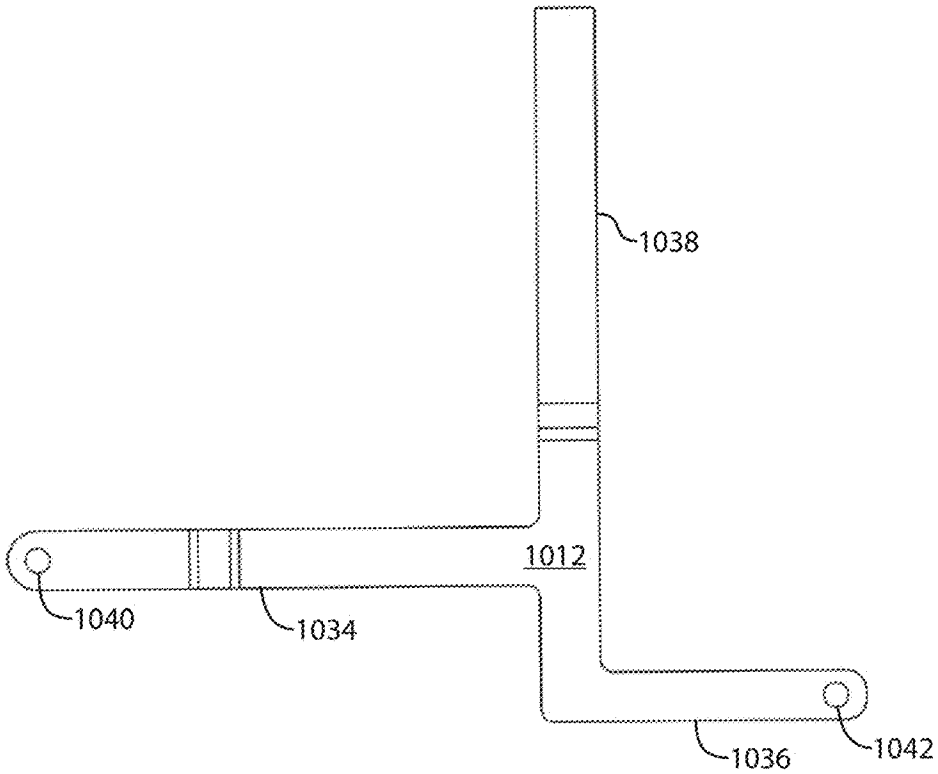
FIG. 10D shows a plan view of an auto link connector for the alternative trigger pack of FIG. 10A.
Figure 10G:
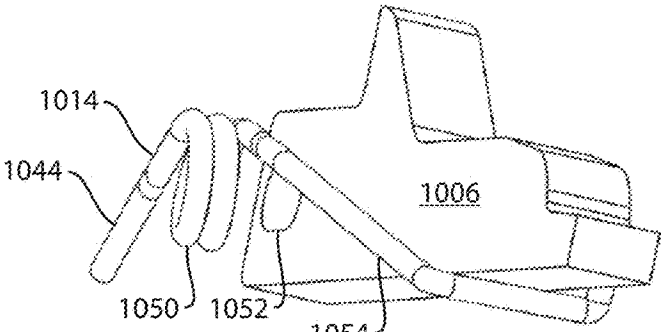
FIG. 10G shows a perspective view of a lift spring and a main sear for the alternative trigger pack of FIG. 10A.
Figure 10F:
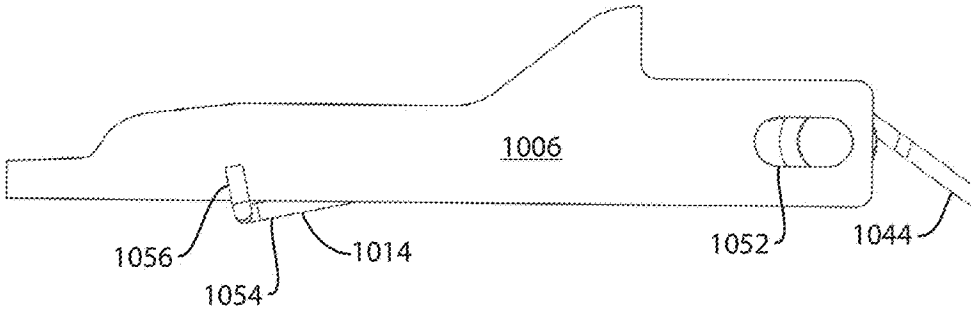
FIG. 10F shows a plan view of a lift spring and a main sear for the alternative trigger pack of FIG. 10A.
Figure 10H:
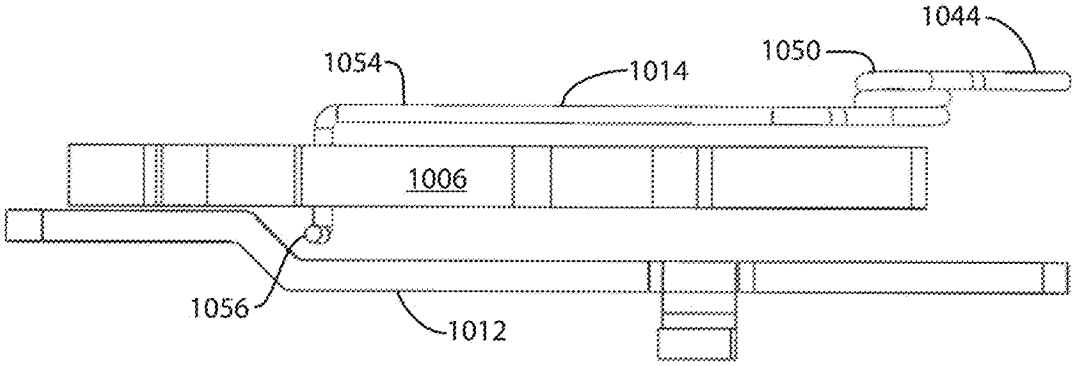
FIG. 10H shows a top view of a lift spring, a main sear, and an auto link connector for the alternative trigger pack of FIG. 10A.
Figure 10J:
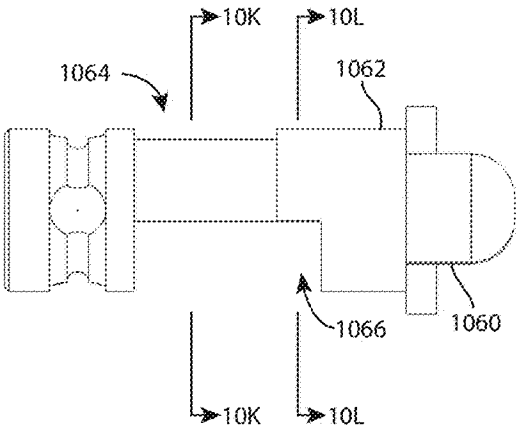
FIG. 10J shows a plan view of a selector switch for the alternative trigger pack of FIG. 10A.
Figure 10L:
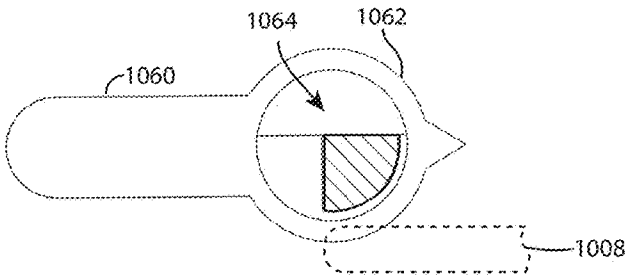
FIG. 10L shows a cross-sectional view of a selector for the alternative trigger pack of FIG. 10A.
Figure 10I:
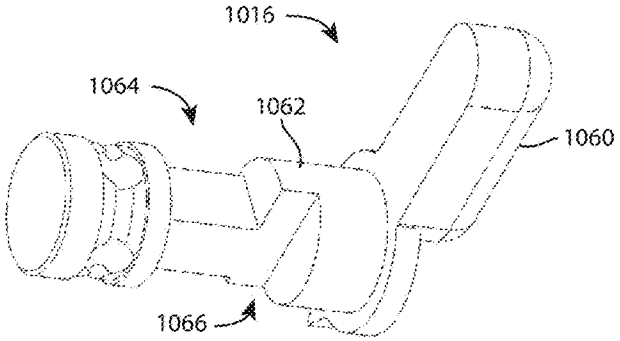
FIG. 10I shows a perspective view of a selector switch for the alternative trigger pack of FIG. 10A.
Figure 10K:
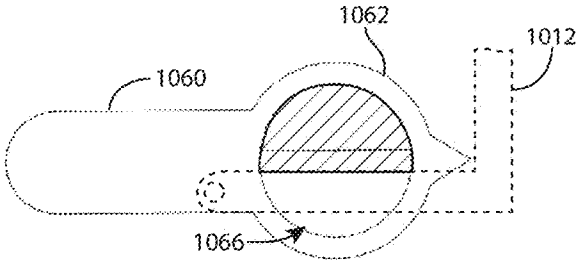
FIG. 10K shows a cross-sectional view of a selector for the alternative trigger pack of FIG. 10A.
Figure 10M:
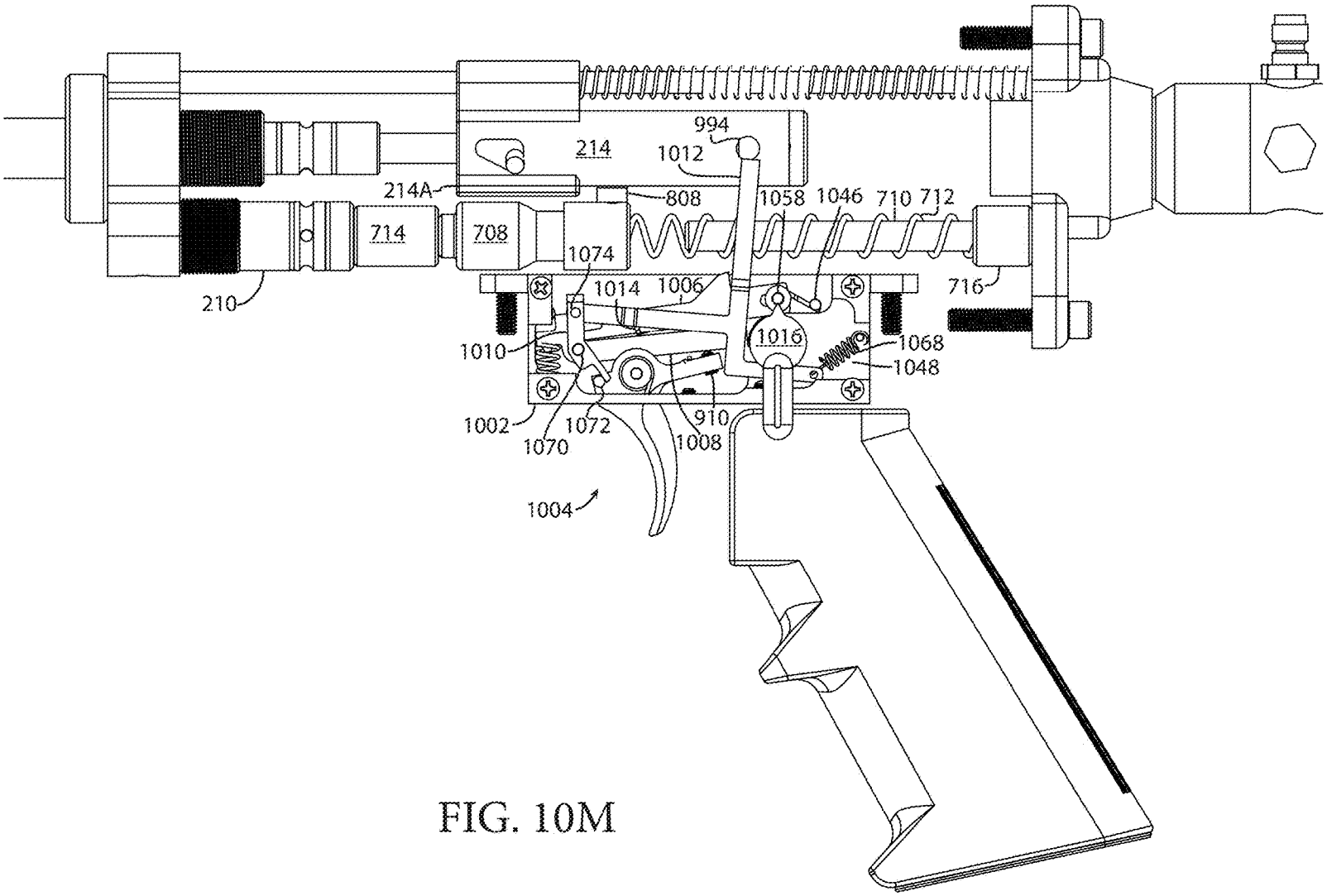
FIG. 10M shows the alternative trigger pack of FIG. 10A in the semi-automatic mode after the valve has been engaged.
Figure 10N:
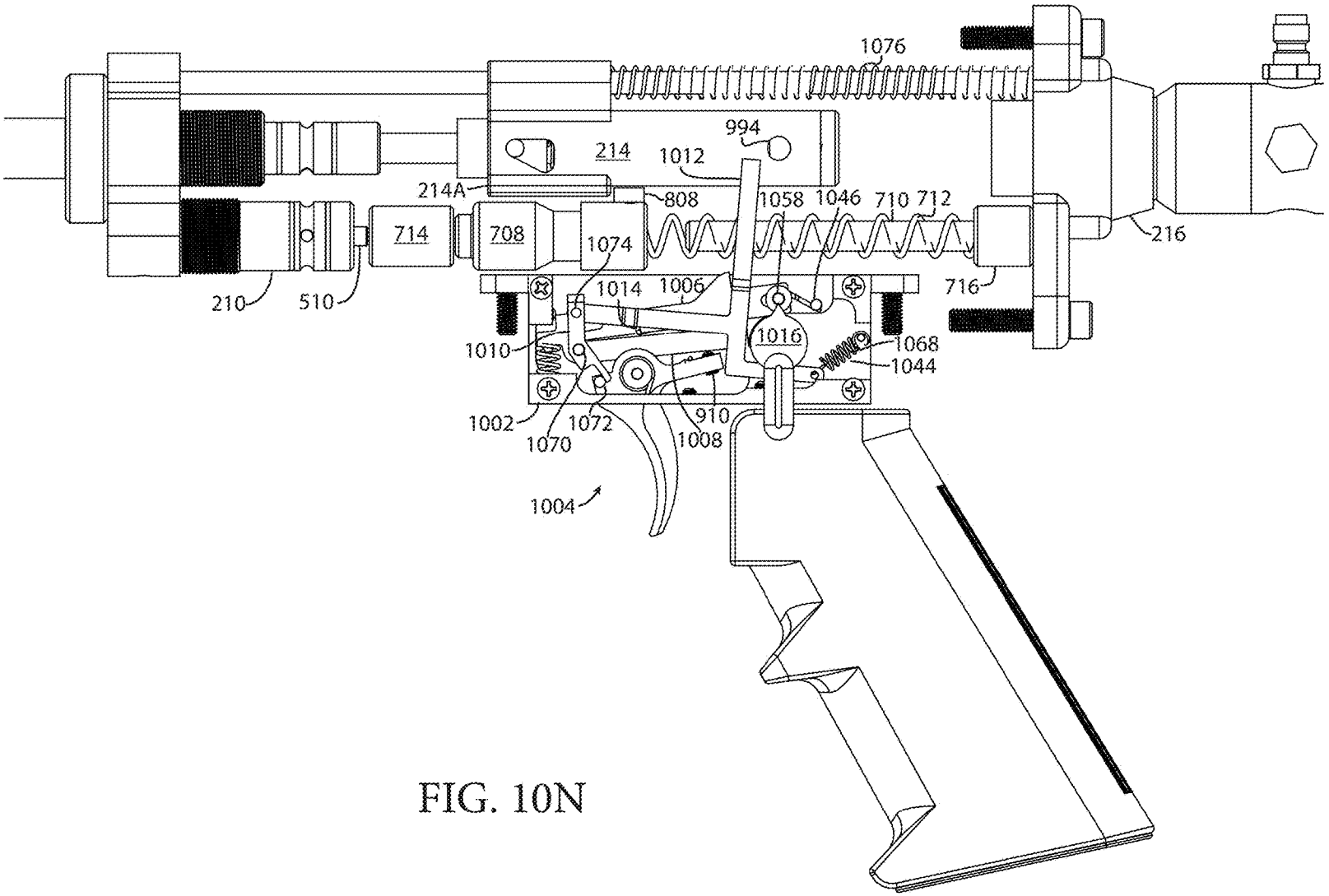
FIG. 10N shows the alternative trigger pack of FIG. 10A in the semi-automatic mode after the valve stem has returned to its original position and the bolt has been unlocked.
Figure 10O:
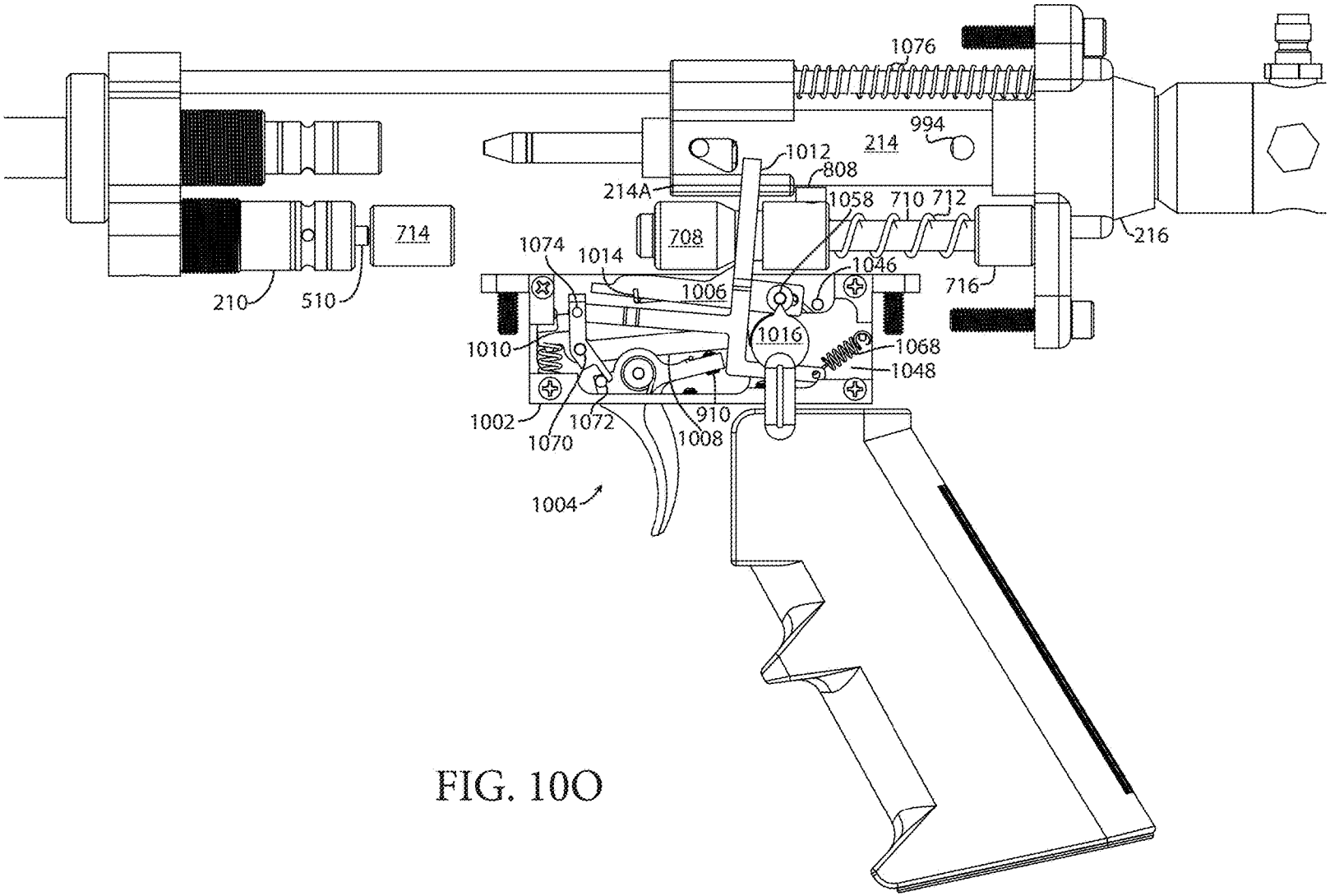
FIG. 10O shows the alternative trigger pack of FIG. 10A in the semi-automatic mode after the bolt has taken its full rearward travel.
Figure 10P:
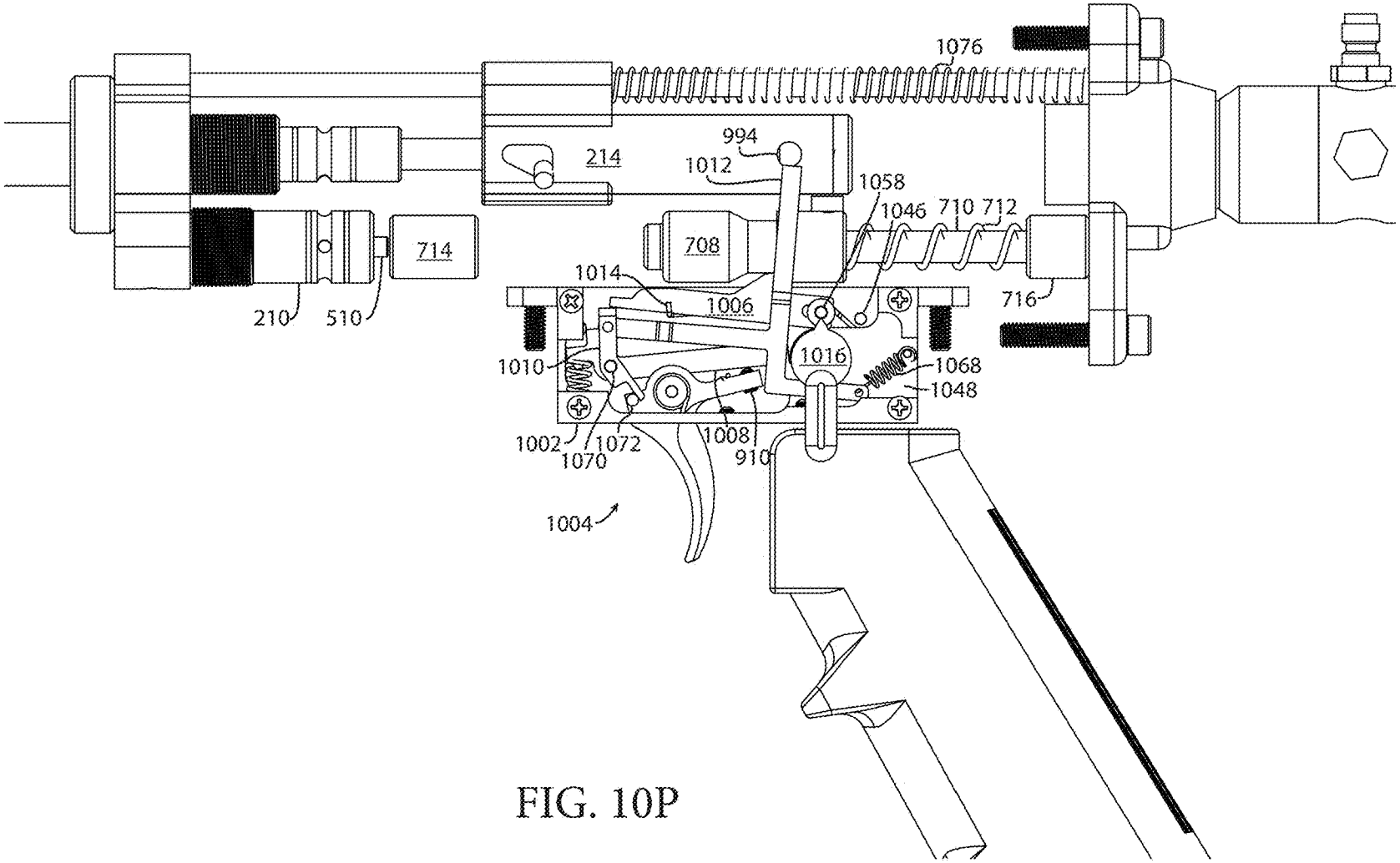
FIG. 10P shows the alternative trigger pack of FIG. 10A in the semi-automatic mode after the bolt has reached its locked position before sears are reset.
Figure 10Q:
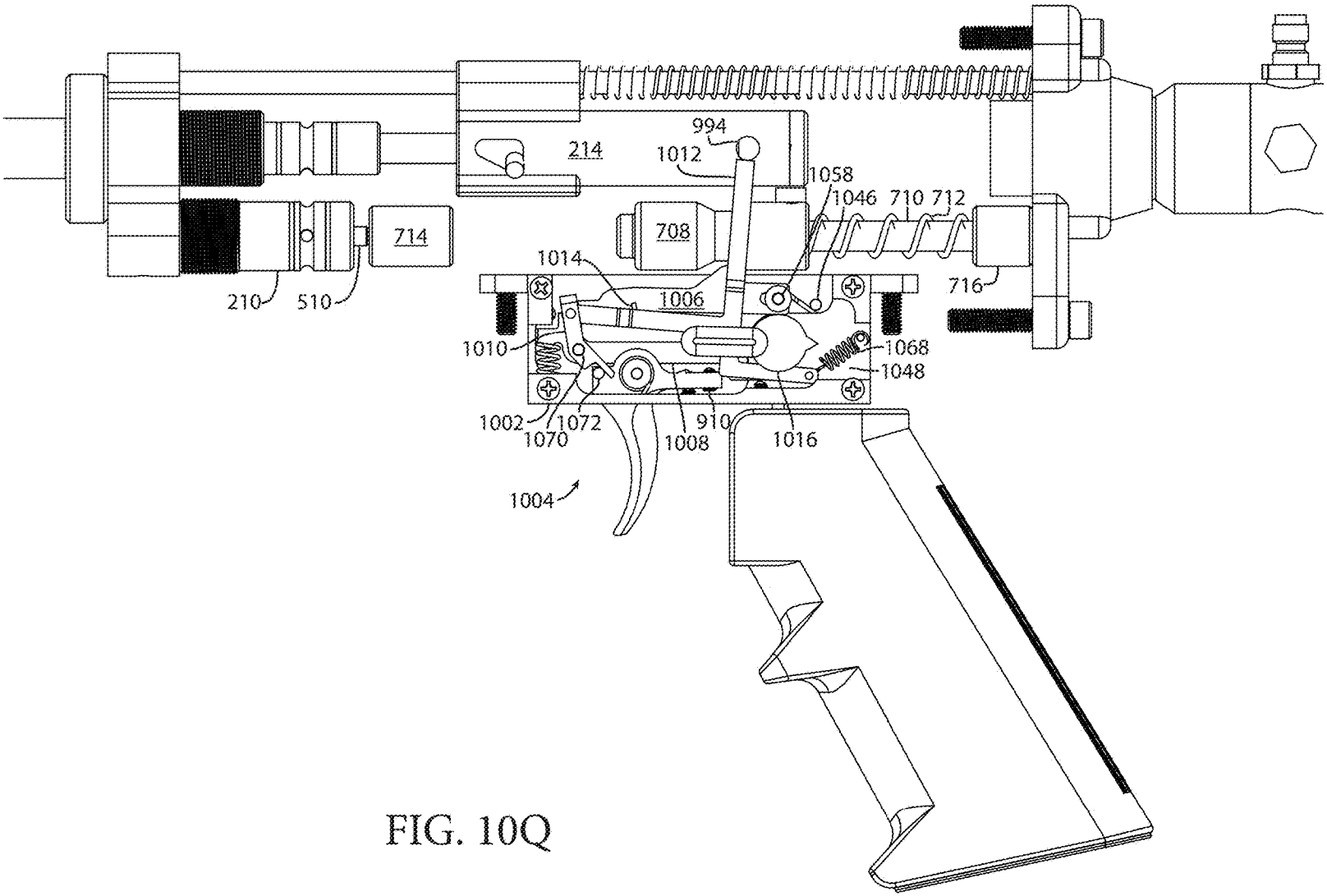
FIG. 10Q shows the alternative trigger pack of FIG. 10A ready to fire in a full automatic mode.
Figure 10R:
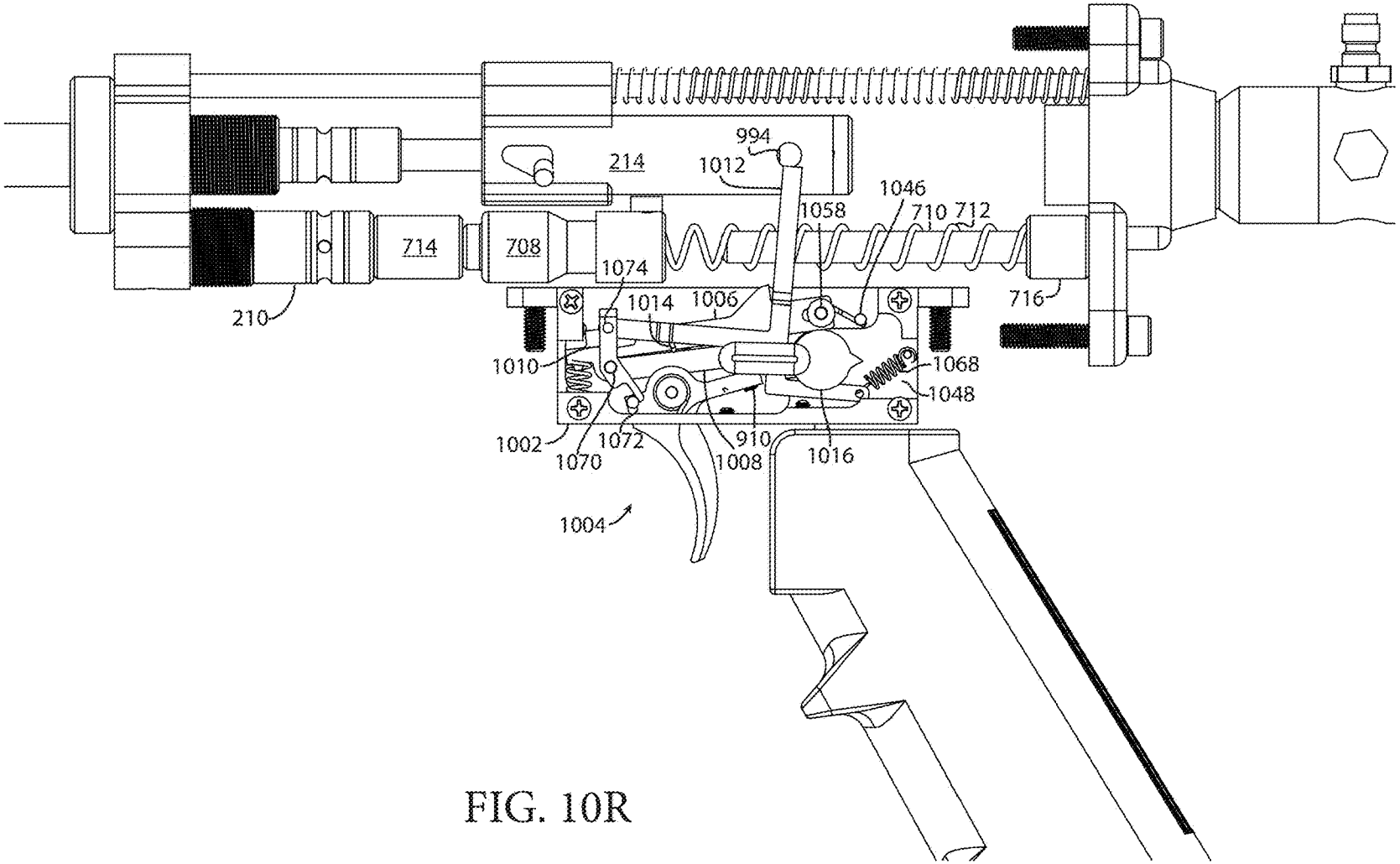
FIG. 10R shows the alternative trigger pack of FIGS. 10A and 10Q in the full automatic mode after a valve has been engaged.
Figure 10S:
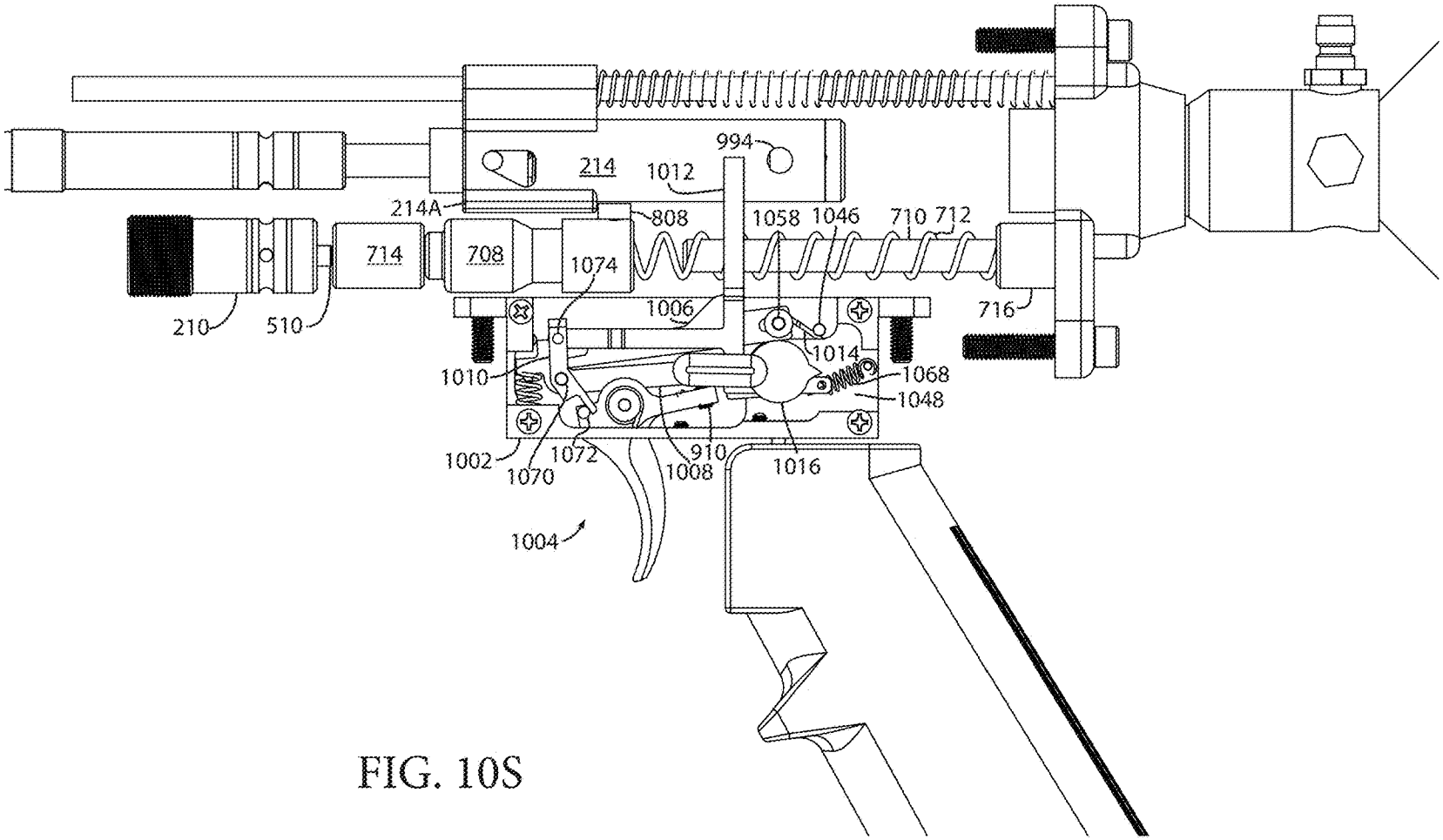
FIG. 10S shows the alternative trigger pack FIGS. 10A and 10Q in the full automatic mode after a valve stem has returned to its original position and a bolt has been unlocked.
Figure 10T:
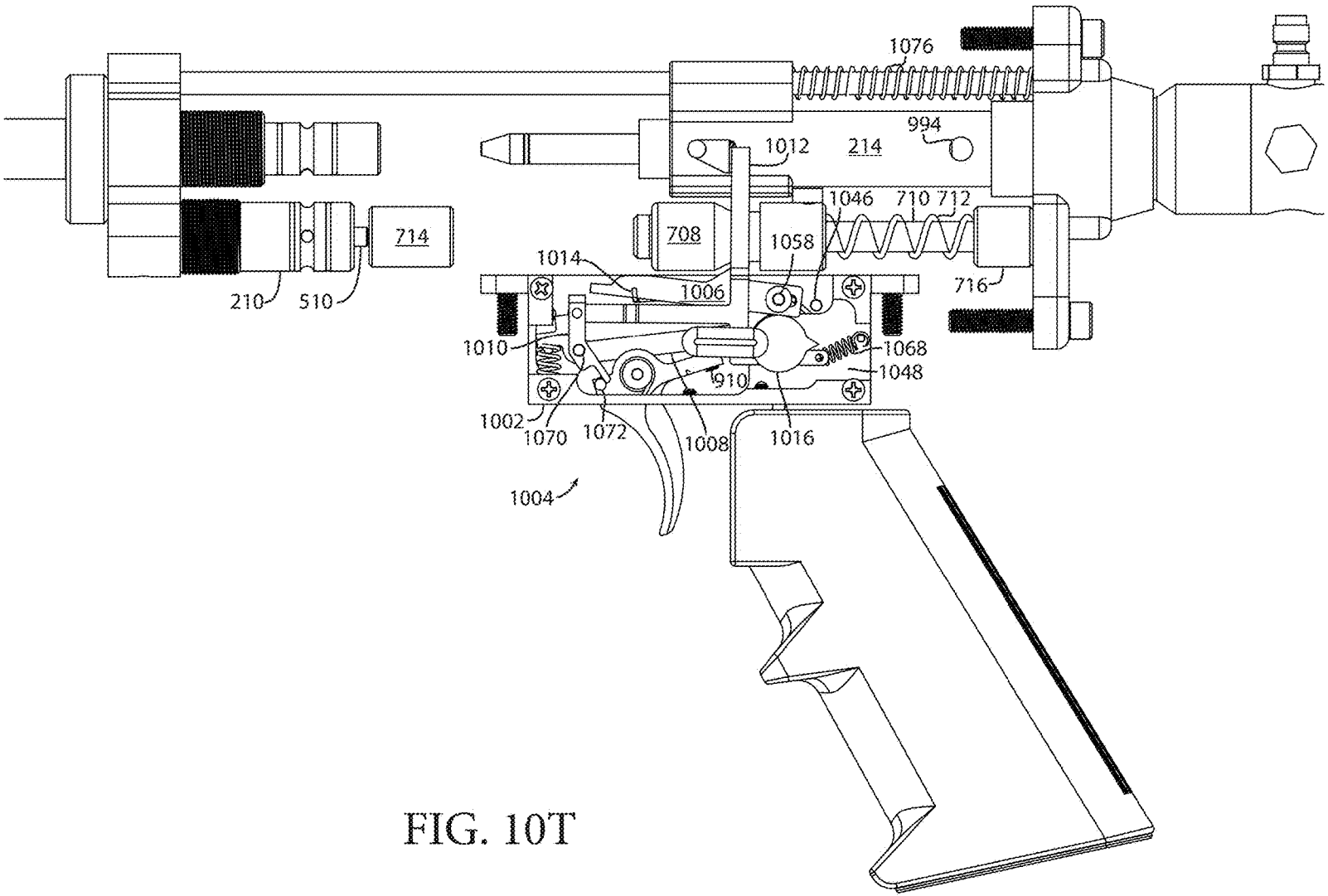
FIG. 10T shows the alternative trigger pack FIGS. 10A and 10Q in the full automatic mode after the bolt has taken its full rearward travel and an auto link connector is in its full upright position.
Figure 10U:
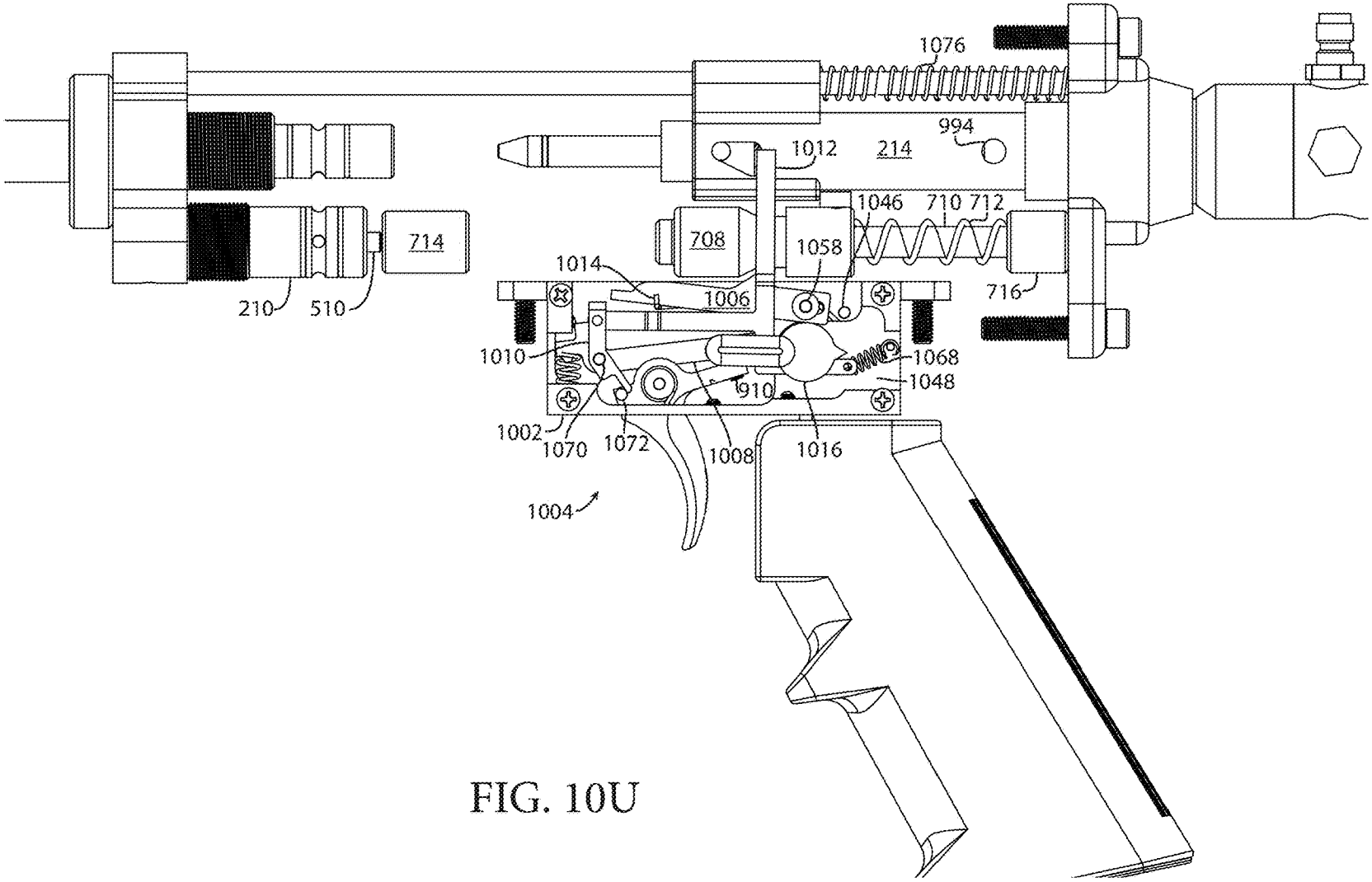
FIG. 10U shows the alternative trigger pack FIGS. 10A and 10Q in the full automatic mode after the bolt has taken its full rearward travel.
Figure 10V:
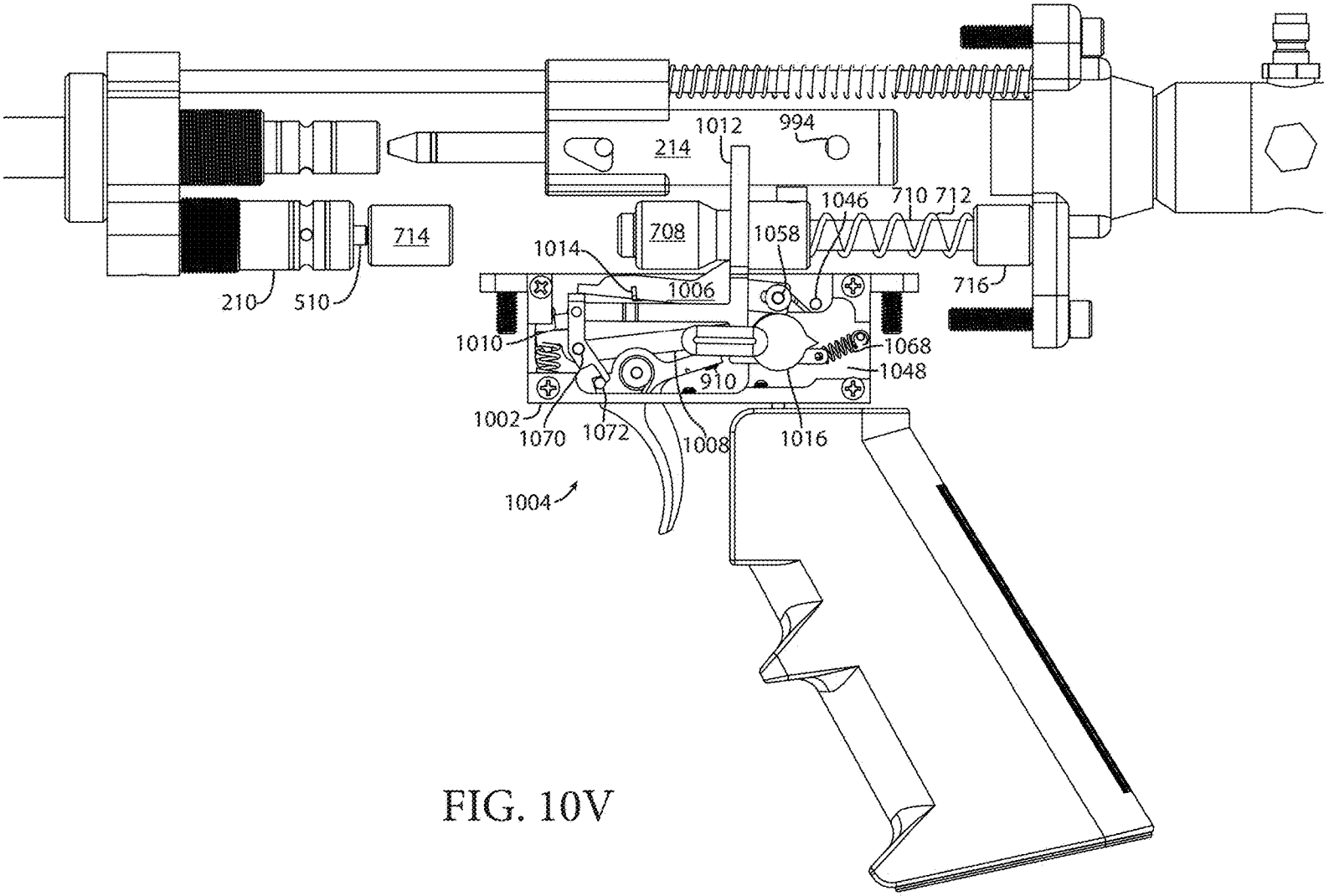
FIG. 10V shows the alternative trigger pack FIGS. 10A and 10Q in the full automatic mode after the bolt has moved forwardly and before triggering the auto link connector.
Figure 10W:
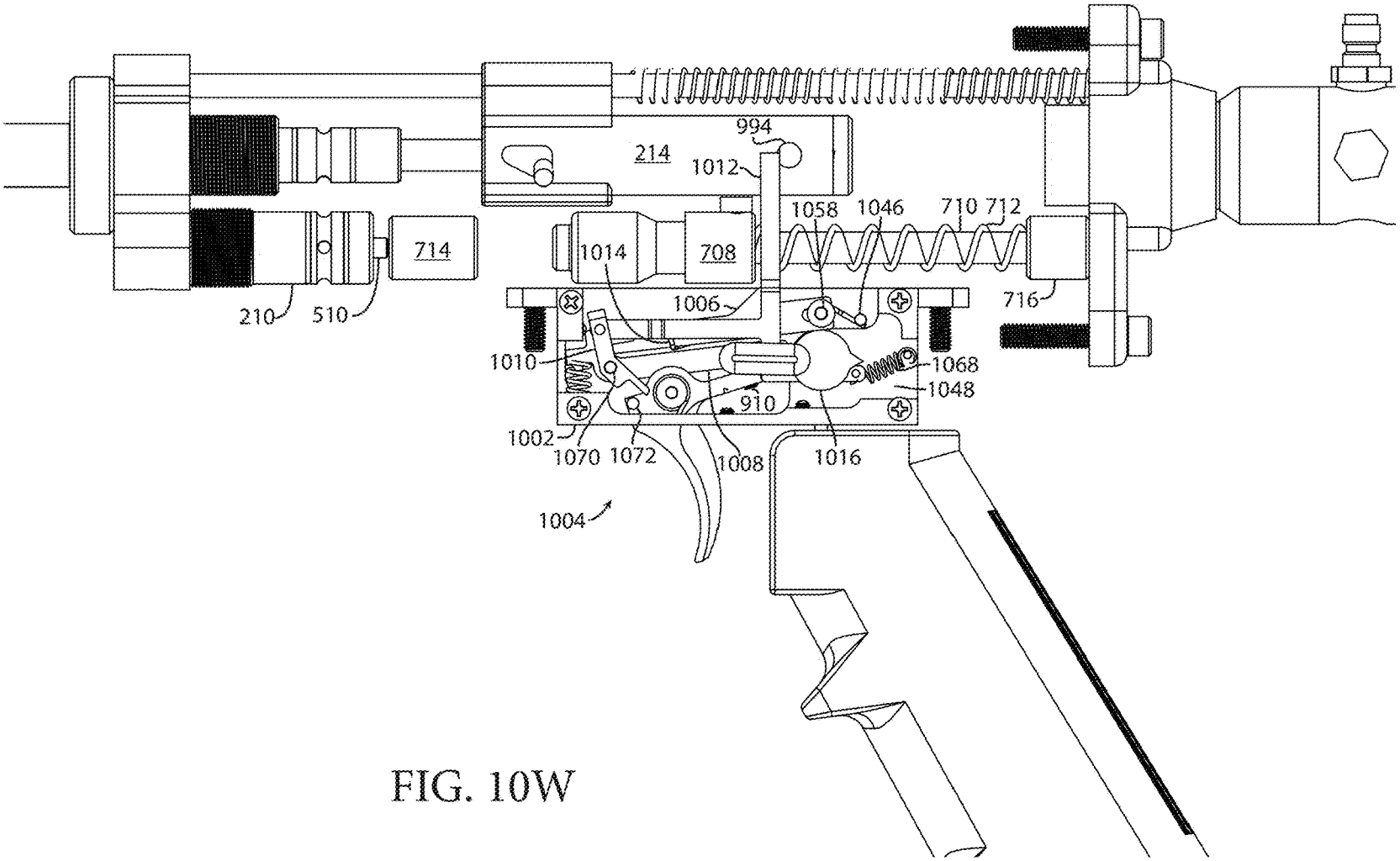
FIG. 10W shows the alternative trigger pack FIGS. 10A and 10Q in the full automatic mode after the auto link connector has fired and after the bolt is home and locked.
Figure 11A:
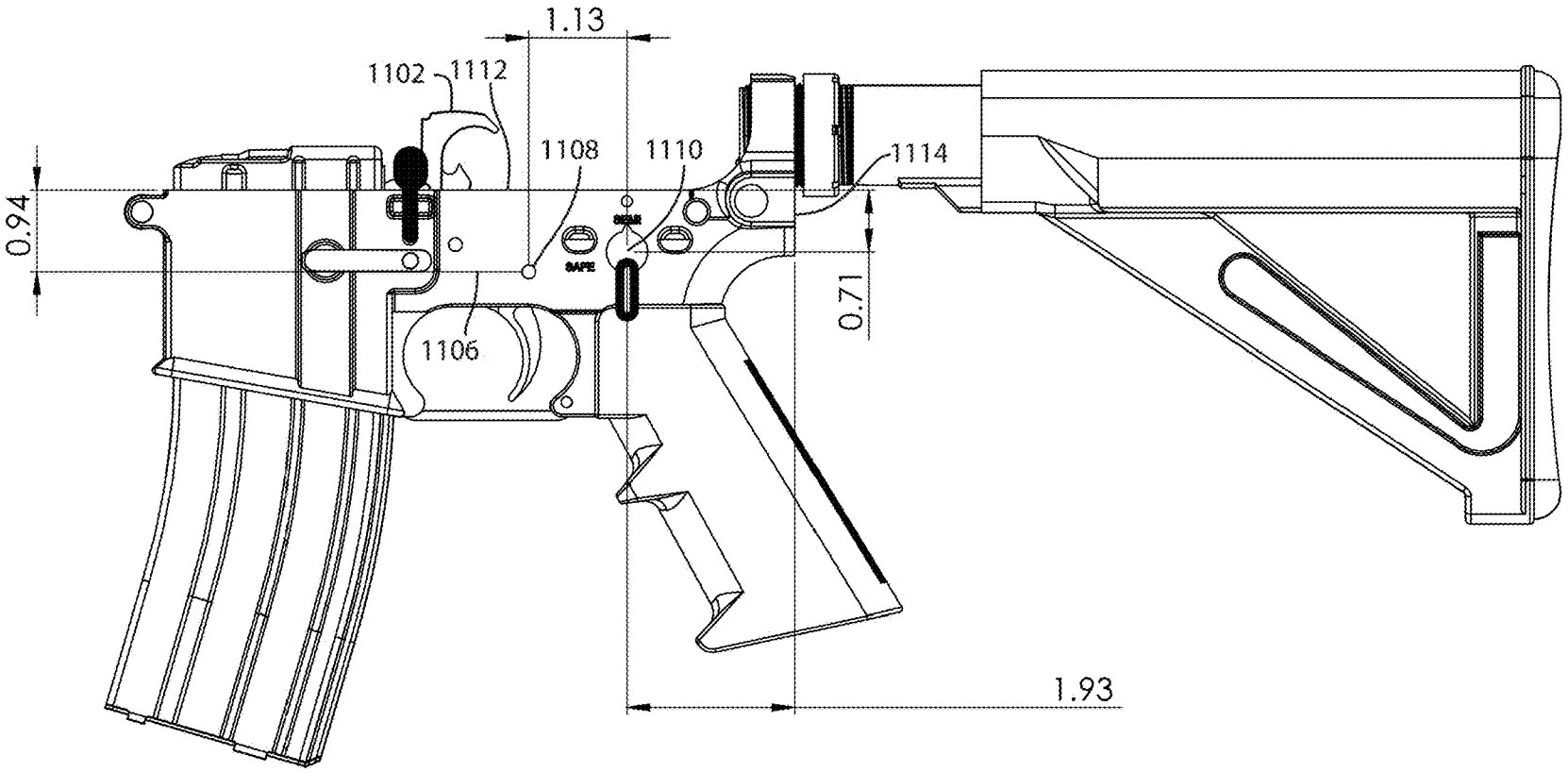
FIG. 11A (PRIOR ART)
FIGS. 11A-D illustrate the select-fire hammer-based trigger constraints (or "form factor") of the trigger assembly of the AR-15 rifle.
Figure 11B:
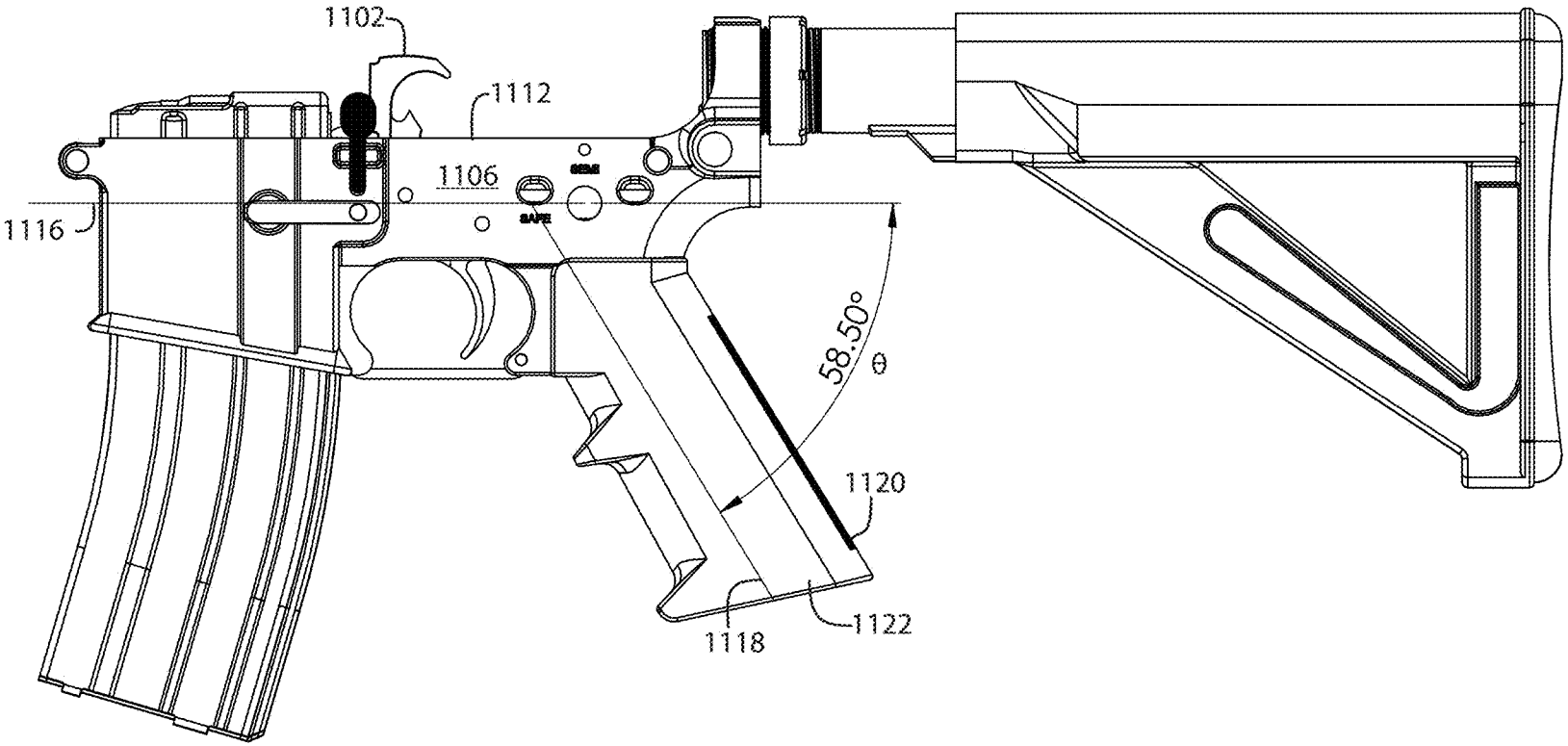
FIG. 11B (PRIOR ART)
Figure 11C:
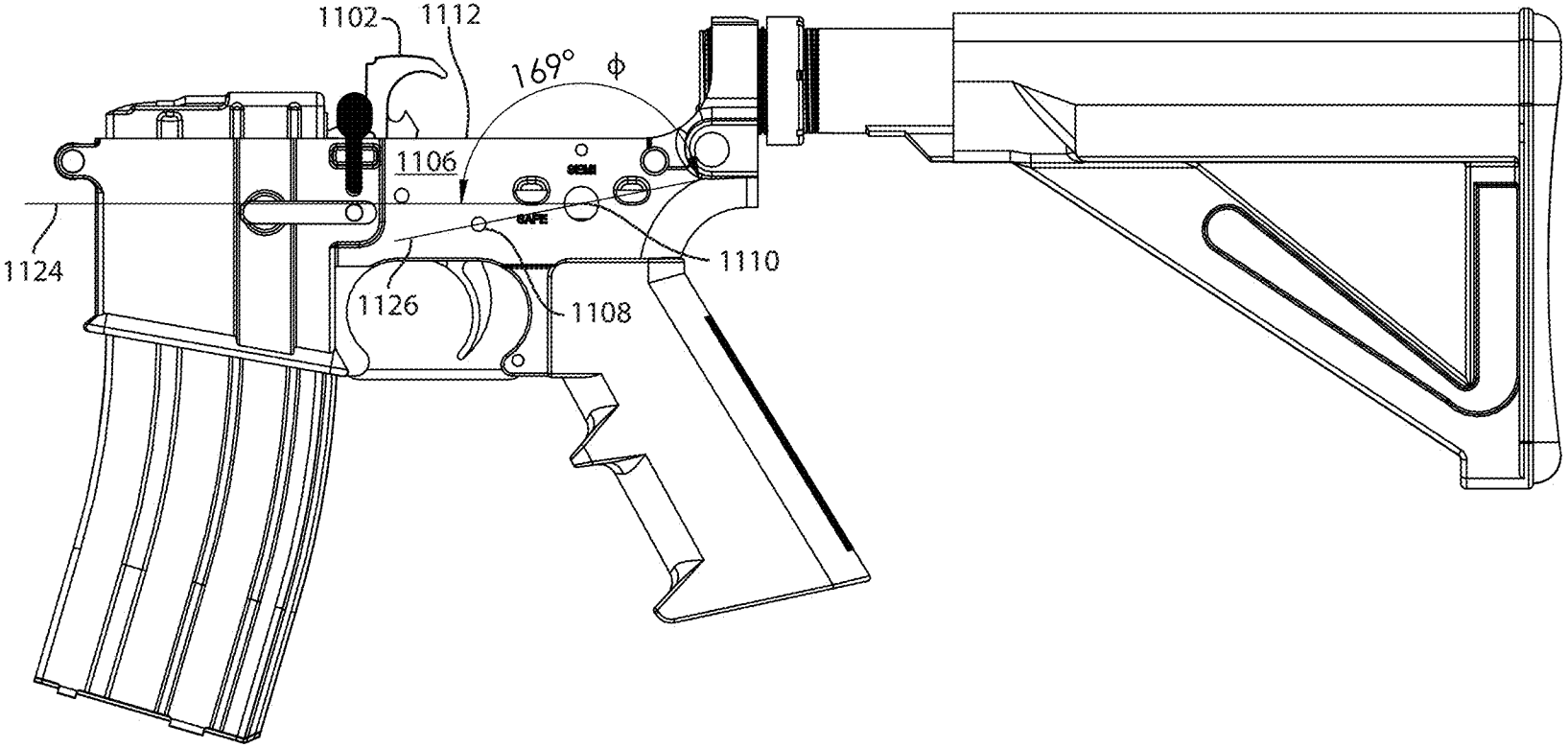
FIG. 11C (PRIOR ART)
Figure 11D:
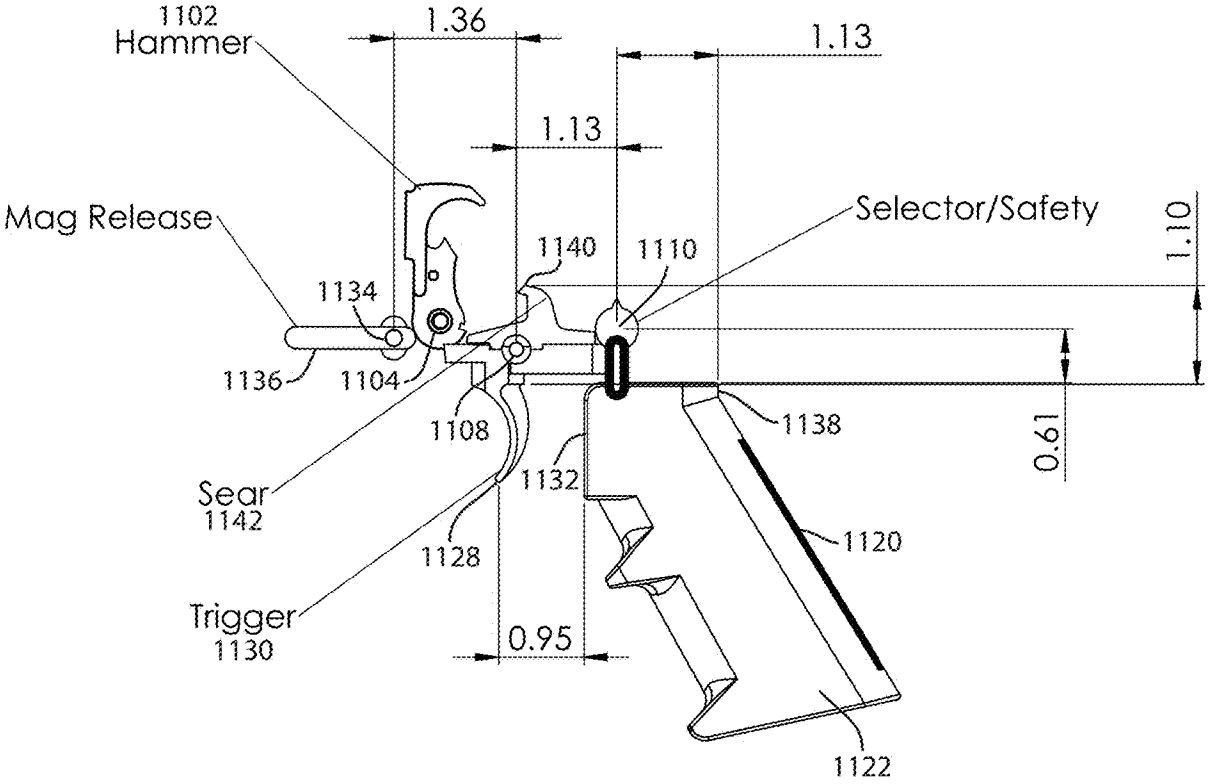
FIG. 11D (PRIOR ART)

FIGS. 10A-W illustrate an alternative embodiment of the trigger pack 702.

FIG. 10A shows the alternative trigger pack ready to fire in the semi-automatic mode. The alternative trigger pack 1002 is similar to the trigger pack 702 described above in connection with FIGS. 9A-O. The alternative trigger pack 1002 includes a trigger element 1004, a main sear 1006, and a shelf sear 1008, that are similar in form and function to the trigger element 704, main sear 932, and shelf sear 916 described above, except that the hook-shaped cutout 938 in the main sear 932 is not present in the main sear 1006. The trigger-to-auto sear linkage 968 is replaced by an actuator 1010, described in connection with FIGS. 10B and 10C. The selector-switch-to-auto-sear linkage 968 is replaced by an auto link connector (ALC) 1012, described in connection with FIGS. 10D and 10E. The main sear spring 952 is replaced by a lift spring 1014, described in connection with FIGS. 10F, 10G, and 10H. The selector switch 976 has been replaced with a selector switch 1016, described in connection with FIGS. 10I, 10J, 10K, and 10L.

FIG. 10B shows a plan view of an actuator for the alternative trigger pack. FIG. 10C shows a perspective view of an actuator for the alternative trigger pack. The actuator 1010 is generally shaped like the letter "U" having a curved crossbar 1018, a first bent arm 1020, and a second bent arm 1022. The first bent arm 1020 and second bent arm 1022 have narrow portions 1024 and 1026, respectively, and pivot holes 1028 and 1030, respectively. The first bent arm 1020 includes a ALC pin hole 1032. In one or more embodiments, there is no corresponding ALC pin hole on the second bent arm 1022.

FIG. 10D shows a plan view of an auto link connector for the alternative trigger pack. FIG. 10E shows a perspective view of an auto link connector for the alternative trigger pack. The auto link connector (ALC) 1012 includes a pinned arm 1034, a selector switch engagement arm 1036, and a bolt engagement arm 1038. The pinned arm 1034 includes a pin hole 1040. The selector switch engagement arm 1036 includes a spring connection hole 1042

FIG. 10F shows a plan view of a lift spring and a main sear for the alternative trigger pack. FIG. 10G shows a perspective view of the lift spring and the main sear for the alternative trigger pack. FIG. 10H shows a top view of the lift spring, the main sear, and an auto link connector for the alternative trigger pack. The lift spring 1014 includes a pinned section 1044 that engages with a lift spring pin 1046 (see FIG. 10A) that is coupled to a housing 1048 for the alternative trigger pack 1002. The pinned section 1044 of the lift spring 1014 is coupled to a coiled section 1050 of the lift spring 1014 that aligns with a main sear slot 1052 in the main sear 1006. The coiled section 1048 of the lift spring 1014 is coupled to a cradle portion 1054 of the lift spring 1014 that, when installed, fits below the main sear 1006 and has a retaining tip 1056 that fits between the main sear 1006 and the ALC 1012, as shown in FIG. 10H. The main sear 1006 and the lift spring 1014 are coupled to the housing 1048 of the alternative trigger pack 1002 by a main sear pin 1058.

FIG. 10I shows a perspective view of a selector switch for the alternative trigger pack. FIG. 10J shows a plan view of a selector switch for the alternative trigger pack. FIG. 10K shows a cross-sectional view of a selector for the alternative trigger pack. FIG. 10L shows a cross-sectional view of a selector for the alternative trigger pack. Note that FIGS. 10K and L show the opposite perspective (i.e., from the inside of the gun looking out) from that shown in FIG. 10A and FIGS. 10M-10W (discussed below).

The selector switch 1016 of the alternative trigger pack 1002 has a lever element 1060 coupled to a barrel element 1062. The barrel element 1062 has a shelf-sear detent 1064 and an ALC detent 1066. As can be seen in FIG. 10K, the ALC 1012 (shown as a dashed line in FIG. 10K) rides within the ALC detent 1066. As can be seen in FIG. 10L, the shelf sear 1008 (shown as a dashed line in FIG. 10K) rides within the shelf-sear detent 1064.

The selector switch 1016 has three selectable positions. The first position (the position shown in FIGS. 10K and 10L) is a safety position, in which the shelf-sear detent 1064 does not face the shelf sear 1008. In the safety position, the shelf sear 1008 is prevented from moving in response to movement of the trigger body 1004.

The second position is a semi-automatic position in which the selector switch 1016 is rotated counter-clockwise 90 degrees (as seen along the view lines 10K and 10L shown in FIG. 10J) from the position shown in FIGS. 10K-L, the shelf-sear detent 1064 faces the shelf sear 1008, and the ALC detent 1066 does not face the ALC 1012. In the semi-automatic position, the shelf sear 1008 can move in response to movement of the trigger element 1004 and the ALC 1012 is prevented from entering the ALC detent 1066.

The third position is an automatic position in which the selector switch 1016 is rotated 180 degrees from the position shown in FIGS. 10K-L, the shelf-sear detent 1064 faces the shelf sear 1008, and ALC detent 1066 faces the ALC 1012.

In the ready-to-fire position shown in FIG. 10A, the intermediate striker 708 is restrained by the main sear 1006, which itself is restrained from deflecting downward by the shelf sear 1008, in the same way that the shelf sear 916 restrains the main sear 932 as described above, causing the main spring 712 to be in tension. The striker 714 is against the valve stem 510 of the valve 210. The selector switch 1016 is in the semi-automatic position so that the ALC, which is pulled upward and rearwardly by ALC spring 1068, does not face the ALC detent 1066. As a result, the ALC 1012 is deflected downward and out of the path of the auto-actuator-to-bolt set screw 994.

When the trigger element 1004 is pulled, the adjustment screw 910 presses against the shelf sear 1008, causing the shelf sear 1008 to rotate around the shelf sear pivot pin 1070, which causes the shelf sear 1008 to fall out from under the main sear 1006, as described above. The energy stored in the main spring 712 against the intermediate striker 708 overcomes the force of the lift spring 1014 holding the main sear 1006 against the intermediate striker 708. As a result, the main sear 1006 is deflected out of the path of the intermediate striker 708, which moves forwardly and strikes the striker 714. The striker 714 depresses the valve stem 510, causing the valve 210 to open.

The shelf sear pin 1070, which extends from both sides of the shelf sear 1008, is coupled to the actuator 1010 through the pivot hole 1028 on the first bent arm 1020 and through the pivot hole 1030 on the second bent arm 1026 of the actuator 1010 (See FIGS. 10B-E). The actuator 1010 is coupled to the ALC 1012 by a ALC coupling pin 1074, which passes through the ALC pin hole 1032 in the actuator 1010 and into the pin hole 1040 on the ALC 1012. Pulling the trigger element 1004 causes the actuator 1010 to rotate which moves the ALC 1012 forwardly against the tension of the ALC spring 1068.

FIG. 10M shows the alternative trigger pack in the semi-automatic mode after the valve has been engaged. The opening of the valve 210 opens the gas path 200, which causes the bolt assembly 214 to move rearwardly until the cocking boss 214A on the bolt assembly 214 engages the cocking cap screw 808 coupled to the intermediate striker 708. The bolt assembly 214 is unlocked at this point.

FIG. 10N shows the alternative trigger pack in the semi-automatic mode after the valve stem has returned to its original position and the bolt has been unlocked. Pressure in the gas path 200 continues to cause the bolt assembly 214 and the intermediate striker 708, through engagement between the cocking boss 214A and the cocking cap screw 808, to move rearwardly until the bolt assembly 214 is stopped by the ASA 216. Rearward movement of the intermediate striker 708 compresses the main spring 712 and a bolt carrier return spring 1076.

FIG. 10O shows the alternative trigger pack in the semi-automatic mode after the bolt has taken its full rearward travel. When the pressure in the gas path 200 dissipates, the bolt carrier return spring 1076 returns the bolt assembly 214 to its original position and the intermediate striker 708 moves forwardly until the lock face 816 (see FIG. 8A) on the intermediate striker 708 engages the rearward facing flat face 916 on the main sear 932 (see FIG. 9E). The intermediate striker 708 pushes the main sear 1006 forwardly as constrained by the main sear slot 1052 until the main sear 1006 rests on the curved crossbar 1018 on the actuator 1010.

FIG. 10P shows the alternative trigger pack in the semi-automatic mode after the bolt has reached its locked position before sears are reset. The trigger element 1004 has not yet been released in FIG. 10P. The main sear 1006 rests on the curved crossbar 1018 of the actuator 1010. When the trigger element 1004 is released, the shelf sear 1008 returns to its original position and the actuator 1010 pivots counterclockwise around the actuator engagement pin 1070, which moves the actuator 1010 out from under the main sear 1006. That allows the main sear 1006 to drop down onto the shelf sear 1008, which places the alternative trigger pack 1002 back in the ready-to-fire position shown in FIG. 10A. The shelf sear 1008 and the actuator 1010 are designed to interact with the actuator engagement pin 1070 so that when the curved crossbar 1018 of the actuator 1010 releases the main sear 1006, the shelf sear 1008 is positioned to catch the main sear 1006.

FIG. 10Q shows the alternative trigger pack ready to fire in the full automatic mode. The selector switch 1016 is in the automatic position which causes the ALC detent 1066 to face the ALC 1012. The ALC 1012 has not risen into the ALC detent 1066 because it is blocked from doing so by the auto-actuator-to-bolt set screw 994. Otherwise, operation is similar to that described above in connection with FIG. 10A.

FIG. 10R shows the alternative trigger pack in the full automatic mode after the valve has been engaged. Operation is similar to that described above in connection with FIG. 10M.

FIG. 10S shows the alternative trigger pack in the full automatic mode after the valve stem has returned to its original position and the bolt has been unlocked. As can be seen, movement of the bolt assembly, as described above in connection with FIG. 10C, moves the auto-actuator-to-bolt set screw 994 so that the ALC 1012 is fully upright. Otherwise, operation is similar to that described above in connection with FIG. 10N.

FIG. 10T shows the alternative trigger pack in the full automatic mode after the bolt has taken its full rearward travel and the auto link connector is in its full upright position. Operation is similar to that described above in connection with FIG. 10O.

FIG. 10U shows the alternative trigger pack in the full automatic mode after the bolt has taken its full rearward travel. When the pressure in the gas path 200 dissipates, the bolt carrier return spring 1076 drives the bolt assembly 214 towards its original position and the intermediate striker 708 moves forwardly.

FIG. 10V shows the alternative trigger pack in the full automatic mode after the bolt has moved forwardly and before triggering the auto link connector. The bolt carrier return spring 1076 continues drives the bolt assembly 214 towards its original position. The intermediate striker 708 moves forwardly until the lock face 816 (see FIG. 8A) on the intermediate striker 708 engages the rearward facing flat face 916 on the main sear 932 (see FIG. 9E). The intermediate striker 708 pushes the main sear 1006 forwardly as constrained by the main sear slot 1052 until the main sear 1006 rests on the curved crossbar 1018 on the actuator 1010.

FIG. 10W shows the alternative trigger pack in the full automatic mode after the auto link connector has fired and after the bolt is home and locked. The bolt carrier 214 has returned to its original position. As it returns, the auto-actuator-to-bolt set screw 994 engages the ALC 1012 and pushes it forwardly. Force on the ALC 1012 causes the actuator 1010 to rotate counterclockwise about the shelf sear pivot pin 1070. That rotation causes the actuator 1010 to move out from under the main sear 1010. In this scenario, the trigger element 1004 is still pressed so the shelf sear 1008 is not present to catch the main sear 1010 when it falls from on top of the actuator 1010. The gun 100 returns to the state illustrated in FIG. 10R and another projectile is fired. This sequence is repeated until the trigger element 1004 is no longer pressed.

FIGS. 11A-D illustrate the select-fire hammer-based trigger constraints (or "form factor") of the trigger assembly of the AR-15 rifle. The trigger assembly 114 and the alternative trigger assembly 1002 are configured to conform to the form factor of the trigger assembly of the AR-15 rifle, illustrated in FIGS. 11A-D, so that an operator who is familiar with the operation of the AR-15 rifle will be immediately comfortable with the operation of the gun 100. One challenge in achieving this configuration is that the AR-15 uses a hammer 996 that rotates around a hammer pivot 998 rather than the striker assembly 706 illustrated in FIG. 7. Such a pivoting arrangement does not use the linear actuating mechanism illustrated in FIG. 7. It is a challenge to conform to the form factor of the trigger assembly of the AR-15 rifle while accommodating the linear actuating mechanism of the striker assembly 706.

Two of the constraints of the AR-15 trigger assembly form factor, illustrated in FIG. 9P, are the locations on the AR-15 lower receiver 102AR, which corresponds to the lower receiver 102, of the AR-15 trigger pin 906AR, which corresponds to the trigger pin 906, and the center of AR-15 selector switch 980AR, which corresponds to the center of the barrel element 980 of the selector switch 976. The following recitation of dimensions should be interpreted to include tolerances of 0.1 inches for linear dimensions and 0.5 degrees for angular dimensions. As can be seen in FIG. 9P: (a) the center of the AR-15 selector switch 980AR is 0.71 inches below the top 128AR of the AR-15 lower receiver 102AR and 1.93 inches from the back 130AR of the AR-15 lower receiver, (b) the AR-15 trigger pin 906AR is 1.13 inches forward of the center of the AR-15 selector switch 980AR and 0.94 inches below the top 128AR of the AR-15 lower receiver 102AR.

The AR-15 trigger assembly form factor is also constrained, as shown in FIG. 9Q, so that an angle θ between a line 998 parallel to the top 128AR of the AR-15 lower receiver 102AR and a line 999 parallel to a back edge 997 of a grip 109AR is 58.50 degrees.

The AR-15 trigger assembly form factor is also constrained, as shown in FIG. 9R, so that an angle ϕ between a line 995 parallel to the top 128AR of the AR-15 lower receiver 102AR and a line 993 through the center of the AR-15 selector switch 980AR and the trigger pin 906AR is 169 degrees.

The AR-15 trigger assembly form factor is also constrained by dimensions shown in FIG. 9S: (a) the distance from the tip 991 of the AR-15 trigger 989 to a front vertical edge 987 of the AR-15 grip 109AR is 0.95 inches, (b) the distance from an AR-15 mag release pin 985, about which an AR-15 mag release 983 pivots, to the AR-15 trigger pivot 906AR is 1.36 inches, (c) the distance from the center of the AR-15 selector switch 980AR to a rear vertical edge 981 of the AR-15 grip 109AR is 1.13 inches, (d) the distance from the top of the AR-15 sear 932AR, which corresponds to the top of the tab 944 on the main sear 932 (see FIG. 9B), to the top of the AR-15 grip 109AR is 1.10 inches, and (e) the distance from the center of the AR-15 selector switch 980AR to the top of the AR-15 grip 109AR is 0.61 inches.

Figure 12A:
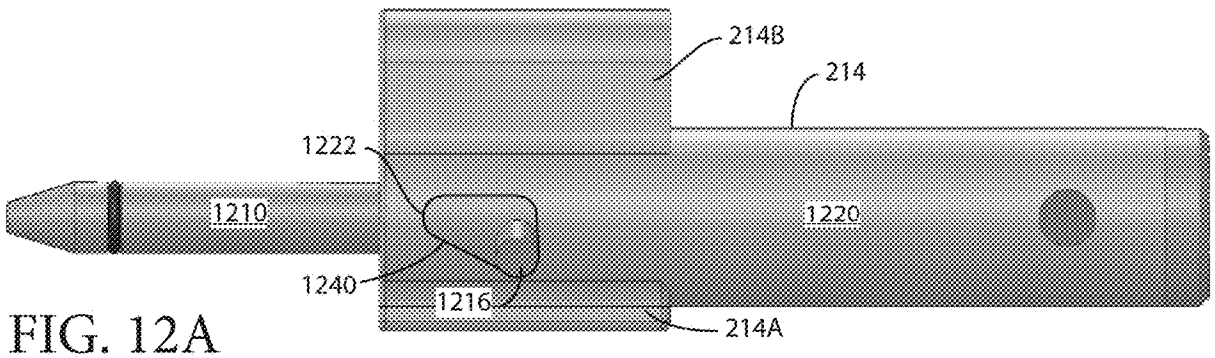
FIG. 12A is a plan view of the bolt assembly.
Figure 12B:
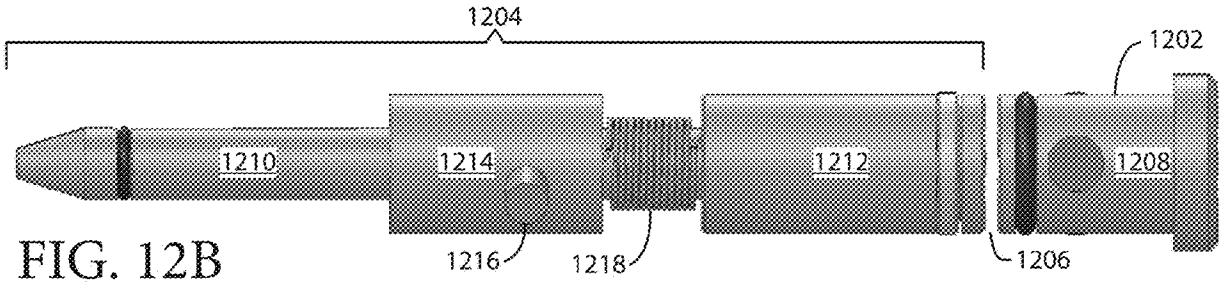
FIG. 12B is a plan view of the bolt assembly with the bolt carrier removed.
Figure 12C:
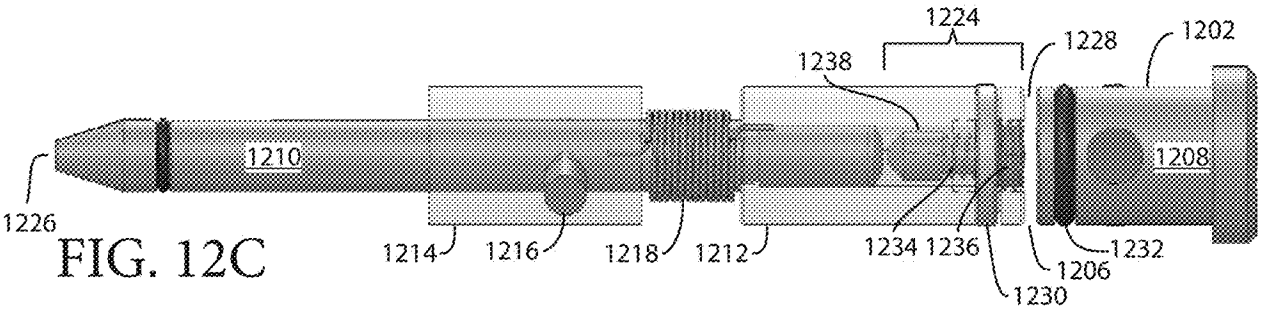
FIG. 12C is a plan view of the bolt assembly with the bolt carrier removed and the bolt lock regulator body and bolt lock bushing transparent.

FIG. 12A is a plan view of the bolt assembly. FIG. 12B is a plan view of the bolt assembly with the bolt carrier removed. FIG. 12C is a plan view of the bolt assembly with the bolt carrier removed and the bolt lock regulator body and bolt lock bushing transparent.

The bolt assembly 214 includes a first part 1202 and a second part 1204 that are separated by a small gap 1206 just prior to actuation of the trigger assembly 114. The first part 1202 and the second part 1204 become separated by a large gap, larger than the small gap, over a projectile-firing period of time immediately after the trigger assembly 114 is actuated. The increase in the gap size is caused by movement of the second part 1204 in response to gas entering the small gap 1206 from the output side 212 of the valve 210. The first part 1202 and the second part 1204 move together to cock the gun 100 once they are separated by the large gap.

The first part includes a bolt lock piston 1208.

The second part 1204 includes a bolt probe 1210. The second part 1204 includes a bolt lock regulator body 1212 coaxial to and fixedly coupled to the bolt probe 1210. The second part 1204 includes a bolt lock bushing 1214 coaxial to the bolt probe 1210, laterally fixed to the bolt probe 1210, and rotatable about the bolt probe 1210. The second part 1204 includes a cam pin 1216 fixedly coupled to the bolt lock bushing 1214. The second part 1204 includes a torsion spring 1218 coupled between the bolt lock regulator body 1212 and the bolt lock bushing 1214 that biases the bolt lock bushing 1214 to rotate about the bolt probe 1210.

The bolt assembly 214 further includes a cylindrical bolt carrier 1220 fixedly coupled to the bolt lock piston 1208. The cylindrical bolt carrier has a cam slot 1222. The cam pin 1216 extends through the cam slot 1222 and the L-shaped slot 116, as shown in FIGS. 13A-13D, discussed in more detail below. The cylindrical bolt carrier 1220 contains the bolt lock regulator body 1212, the bolt lock bushing 1214, and the bolt probe 1210.

The torsion spring 1218 biases the cam pin 1216 within cam slot 1222 and the L-shaped slot 116 along the long leg of the L-shaped slot 118, toward the junction 120, and, guided by the cam slot 1220, into the short leg 122.

The bolt probe 1210 is coupled to a source of pressurized gas, such as the gas path 200, at one end, and to a poppet valve 1224 within the bolt lock regulator body 1212 at the other end. The poppet valve 1224 separates a pressurized chamber 1226 in the bolt lock regulator body 1212 (inside the bolt probe 1210) from a pressurizable chamber 1228 between the bolt lock regulator body 1212 and the bolt lock piston 1208. The pressurizable chamber 1228 is sealed within the cylindrical bolt carrier 1220 by a valve spring 1230 and an O-ring 1232.

The poppet valve 1224 includes a spring 1234 and a hollow set screw 1236. Rotation of the hollow set screw 1236 adjusts a tension in the spring 1234 and a pressure required to open the poppet valve 1224 so that the pressurized chamber 1226 communicates with the pressurizable chamber 1228.

The hollow set screw 1236 provides gaseous communication from the pressurizable chamber 1226 to the gap 1206 between the bolt lock regulator body 1212 and the bolt lock piston 1208.

In operation, pressure from gas released from the gas path 200, indicated by the heavy arrow pointing to the right in FIG. 6C, pressurizes the pressurized chamber 1226 until the pressure against the poppet 1238 overcomes the pressure exerted on the poppet 1238 by the spring 1234, which causes the poppet 1238 to move and the gas within the pressurized chamber 1226 to pressurize the pressurizable chamber 1228.

Figure 13A:
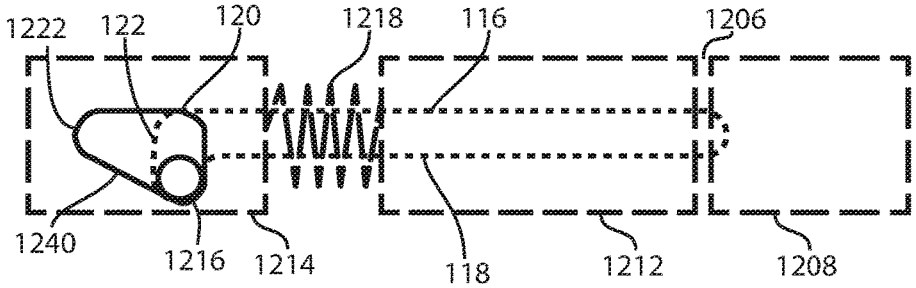
FIG. 13A shows a first step in the operation of the bolt assembly.
Figure 13B:
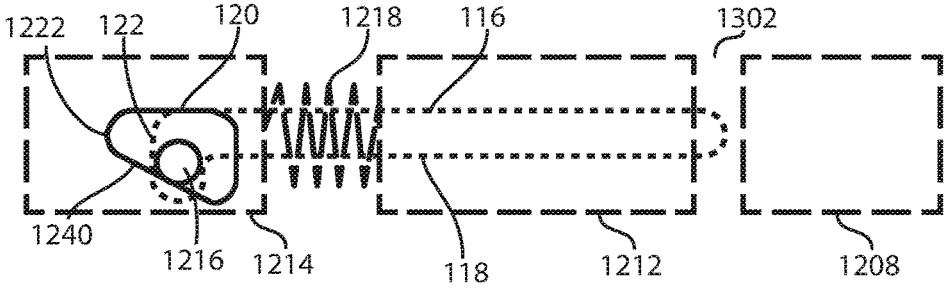
FIG. 13B shows a second step in the operation of the bolt assembly.
Figure 13C:
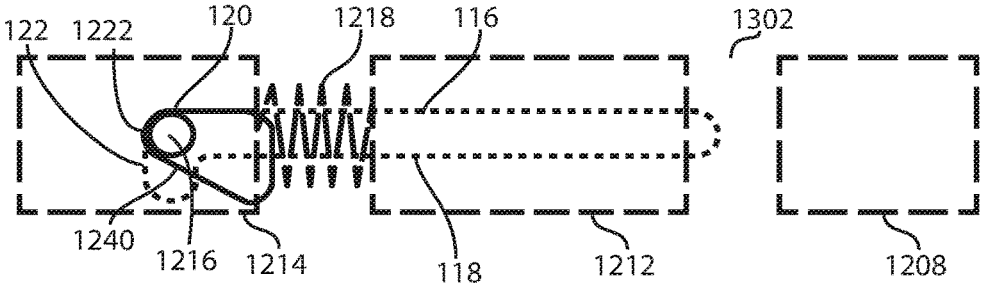
FIG. 13C shows a third step in the operation of the bolt assembly.
Figure 13D:
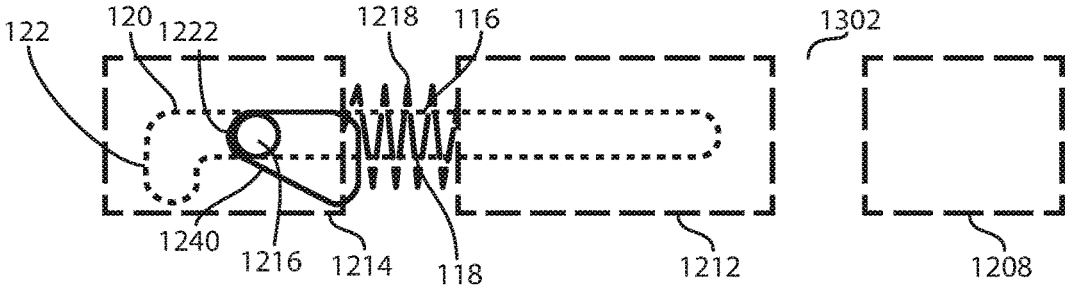
FIG. 13D shows a fourth step in the operation of the bolt assembly.

FIG. 13A shows a first step in the operation of the bolt assembly. FIG. 13B shows a second step in the operation of the bolt assembly. FIG. 13C shows a third step in the operation of the bolt assembly. FIG. 13D shows a fourth step in the operation of the bolt assembly. In FIGS. 13A-D, the cam slot 1222 is shown in solid lines. All other features of the cylindrical bolt carrier 1220 are omitted for clarity of presentation but it will be understood that the cam slot 1222 moves with the bolt lock piston 1208. The bolt lock piston 1208, the bolt lock regulator body 1212, the bolt lock bushing 1214 and the torsion spring 1218, all of which are inside the cylindrical bolt carrier 1220, are shown in dashed lines with large dashes. The L-shaped slot 116, which is part of the upper receiver 104, is shown in dashed lines with small dashes.

The pressurization of the pressurizable chamber 1228 causes the bolt lock piston 1208 to move relative to the bolt lock regulator body 1212. The cylindrical bolt carrier 1220 is secured to the bolt lock piston 1208 and moves with it. Movement of the cylindrical bolt carrier 1220 causes the cam pin 1216 (secured to the bolt lock bushing 1214, which is itself secured to the bolt probe 1210 in such a way that the bolt lock bushing 1214 can rotate around the bolt probe 1210 but cannot translate relative to the bolt probe 1210) to move following a ramped edge 1240 of the cam slot 1222. The rotation of the bolt lock bushing 1214 and movement of the cam pin 1216 along the ramped edge of the cam slot 1222 is resisted by the torsion spring 1218.

These movements can be seen by comparing FIG. 13A to FIG. 13B. In FIG. 13A, the cam pin is at the bottom of the short leg 122 of the L-shaped slot 116. In FIG. 13B, pressurization of the pressurizable chamber 1228 has caused the bolt lock piston 1208 to move relative to the bolt lock regulator body 1212 increasing the size of the small gap 1206 to a large gap 1302. Movement of the bolt lock piston 1208 causes the cam slot 1222 to move relative to the bolt lock bushing 1214 and the cam pin 1216, which causes the cam pin 1216 to ride up the ramped edge 1240 of the cam slot 1222 and to move up within the short leg 122 of the L-shaped slot 116. This movement of the cam pin 1216 causes the bolt lock bushing 1214 to rotate around the bolt probe 1210 and increase the tension in torsion spring 1218.

Further pressurization of the pressurizable chamber 1228 causes the bolt lock piston 1208 to move relative to the bolt lock regulator body 1212 increasing the size of the large gap 1302. These movements can be seen by comparing FIG. 13B to FIG. 13C. In FIG. 13B, the cam pin is partially up the short leg 122 of the L-shaped slot 116. In FIG. 13C, further pressurization of the pressurizable chamber 1228 has caused the bolt lock piston 1208 to continue to move relative to the bolt lock regulator body 1212 increasing the size of the large gap 1302. Movement of the bolt lock piston 1208 causes the cam slot 1222 to move relative to the bolt lock bushing 1214 and the cam pin 1216, which causes the cam pin 1216 to continue ride up the ramped edge 1240 of the cam slot 1222 and to move up to the junction 1220 of the L-shaped slot 116. This movement of the cam pin 1216 causes the bolt lock bushing 1214 to rotate around the bolt probe 1210 and further increase the tension in torsion spring 1218.

At this point, the cam pin 1216 can move down the long leg 118 of the L-shaped slot 116. Thus, any further pressurization of the pressurizable chamber 1228 will cause the bolt lock piston 1208, the entire bolt assembly, including the bolt lock regulator body 1212, the bolt lock bushing 1214, the cam pin 1216, and the cylindrical bolt carrier 1220, to move rearwardly, i.e., to the right in FIGS. 13A-D. This can be seen by comparing FIG. 13C to FIG. 13D. In the time between when the intermediate striker 708 causes the striker 714 to strike the valve stem 510, opening the valve 210, until the time when the cap pin 1216 reaches the junction 1220 of the L-shaped slot 116, i.e., the projectile-firing period of time, the gas released by the gas path 200 is used primarily to fire a projectile. That time can be adjusted using a number of factors, including the spring constant of the helical main spring 712, etc., and is typically designed to be a multiple of the transit time of a projectile through the barrel 108. For example, assuming that the barrel 108 is 16 inches long and the average velocity of the projectile through the barrel is approximately 900 feet/second, the transit time is approximately 1.5 milliseconds (ms). In one or more embodiments, the projectile firing period is adjusted to approximately 4 times the transit time, or 6 ms. It will be understood that the multiple can be any multiple greater than one and that the multiple need not be a whole number. After the projectile-firing period time, a greater portion of the pressure provided by the gas path 200 is used in the processes described below.

In the embodiment in FIGS. 9O, 12A-C, 13A-D, the cam pin 1216, the cam slot 1222, and the L-shaped slot 116 face left (as seen when facing in the direction the barrel 108 is pointing) from the gun 100. It will be understood that in other embodiments (not shown) those elements can have other orientations (e.g., facing right, up, or down) and achieve the same purpose.

Figure 14A:
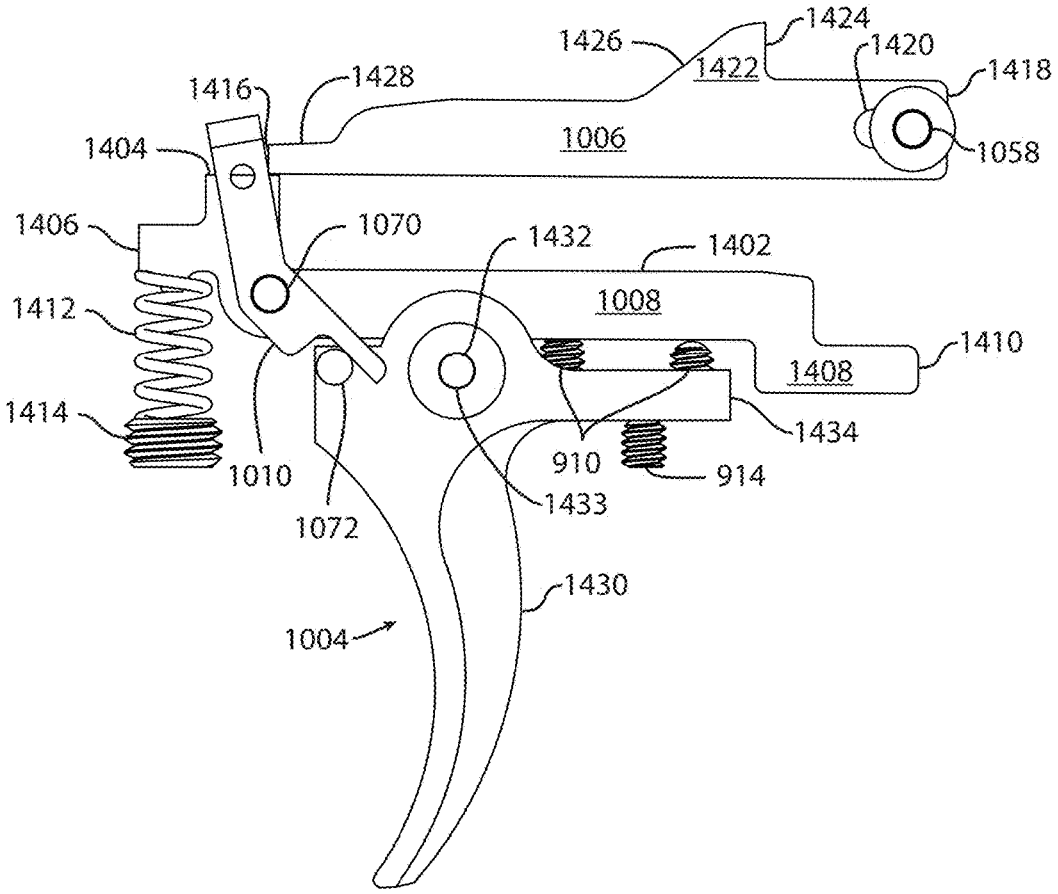
FIG. 14A shows the details of the alternative trigger pack in the ready-to-fire position.

FIGS. 14A-14G illustrate details of the alternative trigger pack 1002 in the embodiment of the gun 100 illustrated in FIGS. 10A-10V. FIG. 14A shows the details of the alternative trigger pack in the ready-to-fire position. The trigger pack 1002 includes the shelf sear 1008. The shelf sear 1008 has an elongated body 1402 that rotates around the shelf sear pivot pin 1070 coupled to the lower receiver 102. The shelf sear 1008 includes a main-sear-supporting arm 1404 adjacent to a front end 1406 of the shelf sear elongated body 1402. The shelf sear 1008 includes an L-shaped element 1408 adjacent to a rear end 1410 of the shelf sear elongated body 1402. A shelf sear spring 1412 is coupled to the front end 1406 of the shelf sear elongated body 1402. The shelf sear spring 1412 urges the shelf sear 1008 to rotate about the shelf sear pivot pin 1070. A shelf sear spring adjustment screw 1414 allows adjustment of the tension on the shelf sear spring 1412.

The alternative trigger pack 1002 includes the main sear 1006. The main sear 1006 has a main sear front end 1416 and a main sear rear end 1418. The main sear 1006 includes a main sear slot 1420 engaged with the main sear pin 1058 coupled to the lower receiver 102. The main sear 1006 includes a tab 1422 having a rearward facing flat face 1424 that engages the lock face 816 of the intermediate striker 708 when the main sear 1006 is in a before-firing position. The tab 1422 includes a forward facing ramped face 1426. The main sear 1006 includes a main-sear shelf 1428 that engages the main-sear-supporting arm 1404 of the shelf sear 1008 when the main sear 1006 is in the before-firing position, as shown in FIG. 14A.

The trigger pack 1002 includes the trigger element 1004. The trigger element 1004 includes a trigger body 1430 and a trigger slot 1432 to engage a trigger pin 1433 coupled to the lower receiver 102 about which the trigger element 1004 rotates. The trigger element 1004 further includes a shelf-sear engagement arm 1434 extending from the trigger slot 1430, the adjustment screw 910 (two are shown—one is adjusted to have effect) extending from the shelf-sear engagement arm 1434, the actuator engagement pin 1072 coupled to the trigger body 1428 frontward of the trigger slot 1432, and a trigger spring (typically a torsion spring, not shown) engaged with the trigger body 1428 urging the trigger element 1004 into the before-firing position illustrated in FIG. 14A. The trigger element 1004 also includes the trigger pull adjustment screw 914.

Figure 14B:
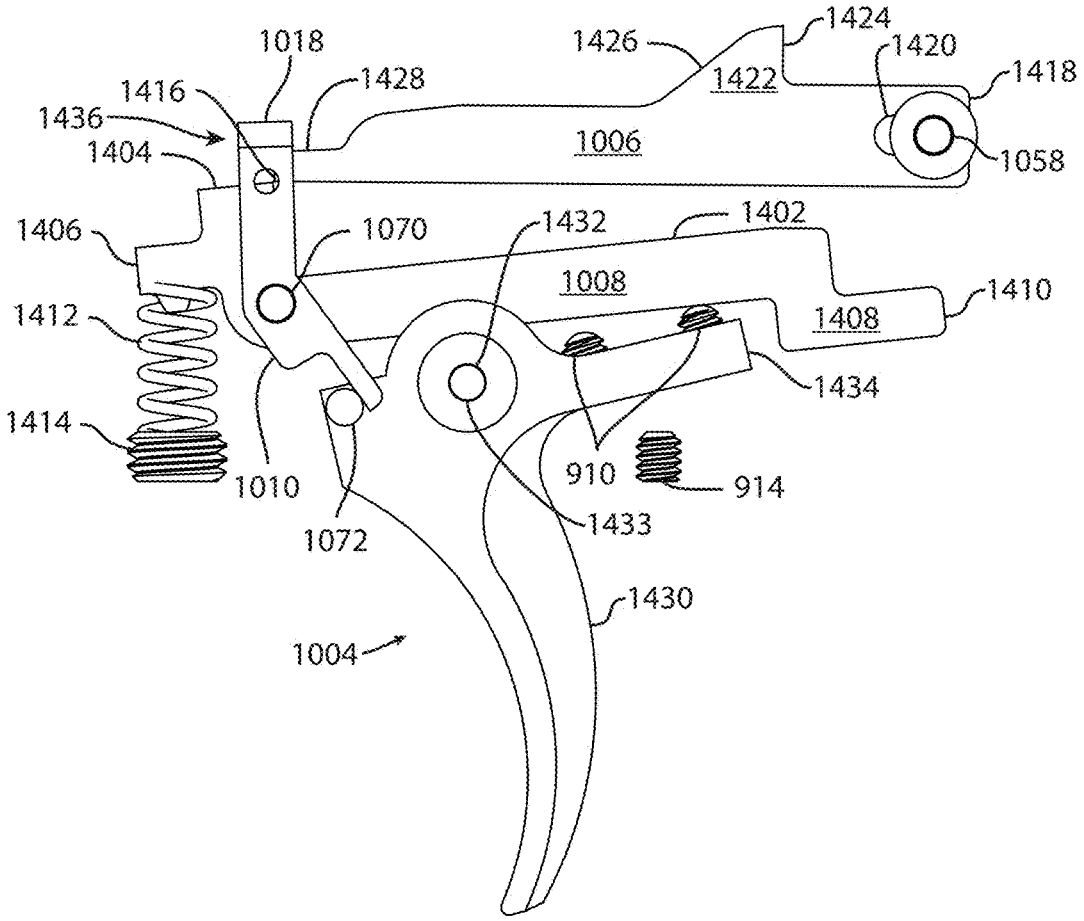
FIG. 14B shows the details of the alternative trigger pack after the trigger has been pulled.

FIG. 14B shows the details of the alternative trigger pack after the trigger has been pulled. As the trigger element 1004 is pulled, the actuator 1010 moves in tandem to a position where the curved crossbar 1018 of the actuator 1010 is located over the main-sear shelf 1428. There is a gap 1436 between the curved crossbar 1018 of the actuator 1010 and the main-sear shelf 1428 that allows the main sear 1006 to move freely. The relationship between the actuator 1010 and the trigger element 1004 is designed to put the actuator 1010 in the position shown in FIG. 14B at the time the shelf sear 1008 releases the main sear 1006, allowing the main sear 1006 to fall yet come to rest on the curved crossbar 1018 of the actuator 1010 when the action cycles. When the trigger element 1004 is released, there is built-in hysteresis that allows the shelf sear 1008 to be well under the main sear 1006 at the point that the actuator 1010 releases the main sear 1006.

Figure 14C:
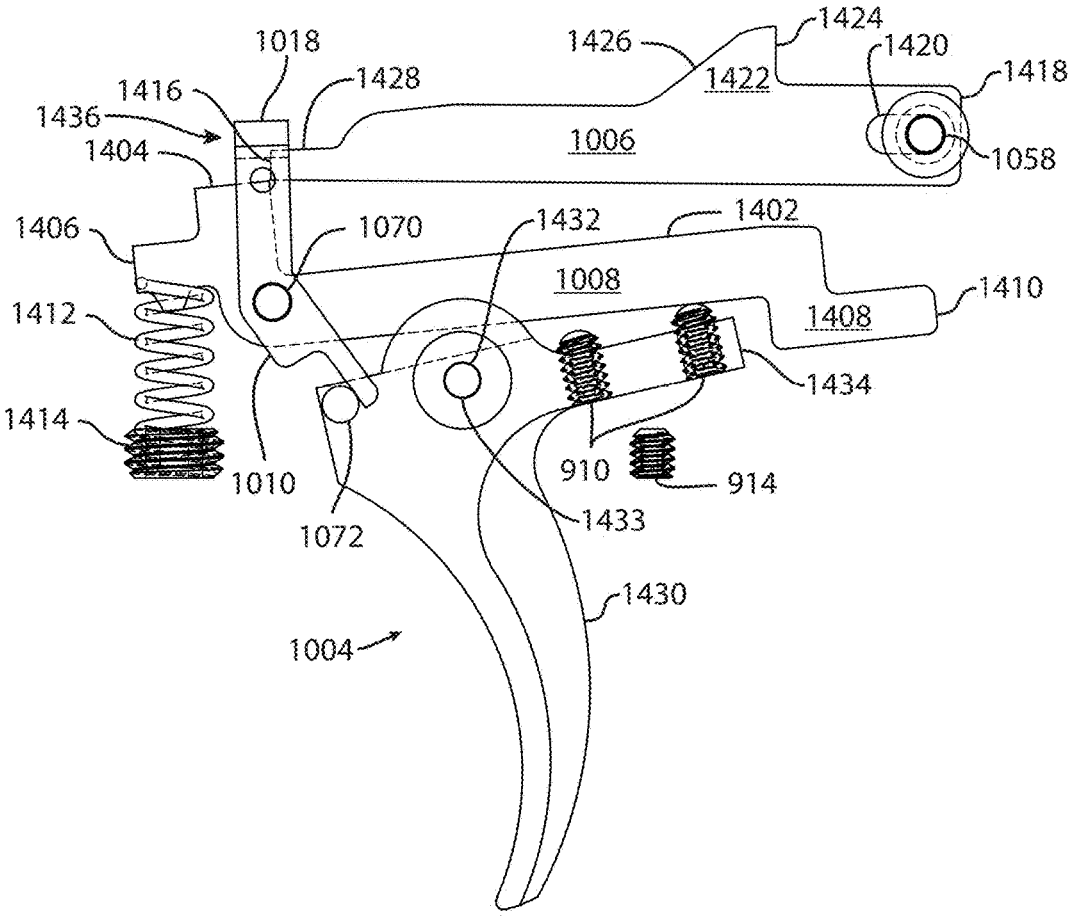
FIG. 14C shows the details of the alternative trigger pack after the trigger has been pulled with hidden surfaces shown with phantom lines.

FIG. 14C shows the details of the alternative trigger pack after the trigger has been pulled with hidden surfaces shown with phantom lines. FIG. 14C shows the alternative trigger pack 1002 in the same condition as in FIG. 14B. The difference is that FIG. 14C includes phantom lines showing some of the hidden surfaces of the shelf sear 1008, the trigger element 1004, the main sear 1006, and the actuator 1010.

Figure 14D:
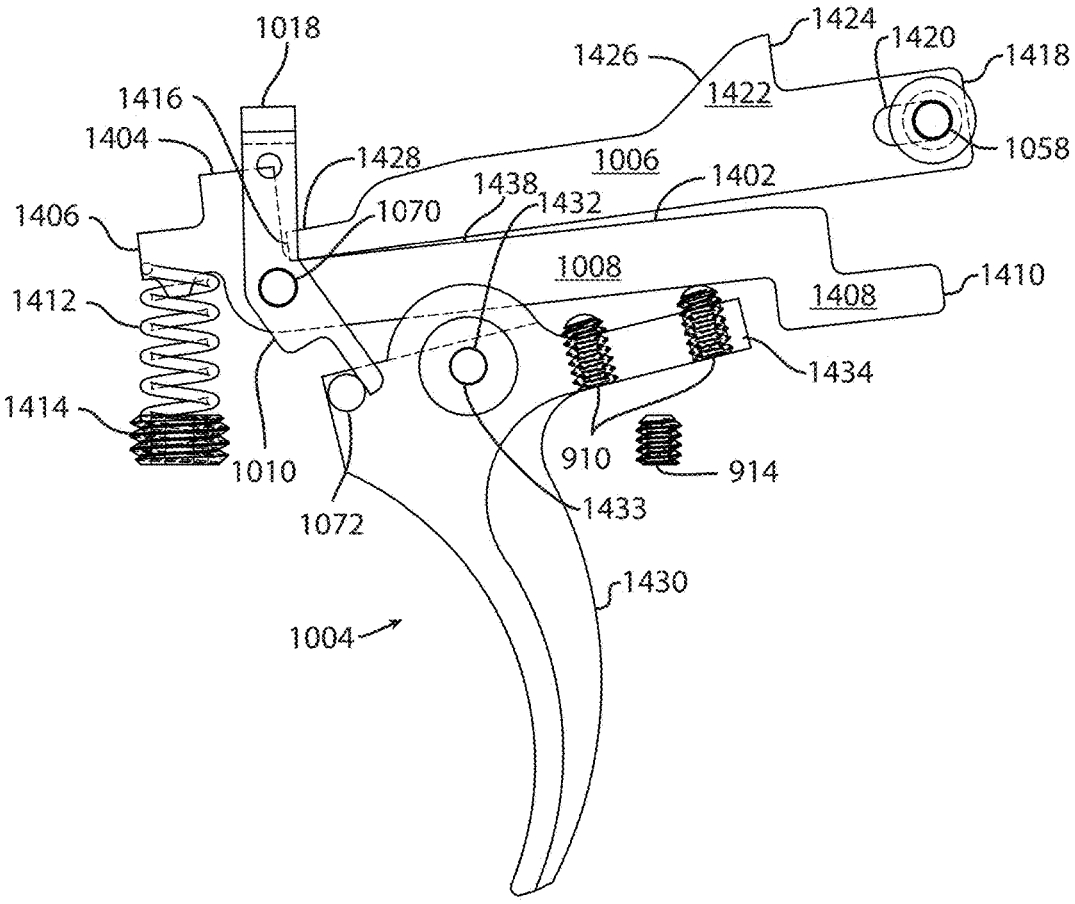
FIG. 14D shows the details of the alternative trigger pack after the main sear has been released by the shelf sear.

FIG. 14D shows the details of the alternative trigger pack after the main sear has been released by the shelf sear. In FIG. 14D, the trigger element 1004 has been pulled further than the position shown in FIG. 14C, which causes the main-sear supporting arm 1404 of the shelf sear 1008 to slip out from under the main-sear shelf 1428 of the main sear 1006. As a result, the main sear 1008 falls until the main-sear shelf rests on an upper surface 1438 of the elongated body 1402 of the shelf sear 1008. The main sear pin 1058 has moved to the rear of the main sear slot 1420.

Figure 14E:
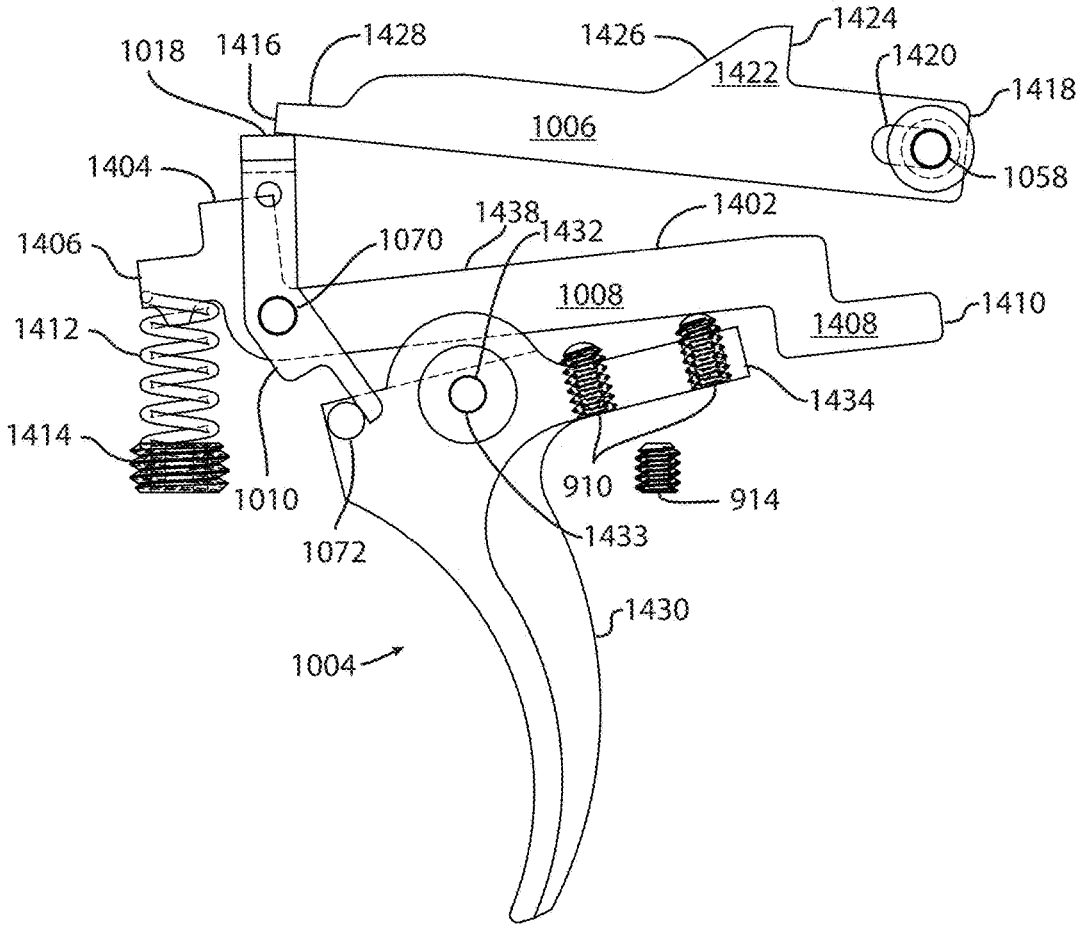
FIG. 14E shows the details of the alternative trigger pack after the bolt has cycled.

FIG. 14E shows the details of the alternative trigger pack after the bolt has cycled. As a result of the actions discussed in connection with FIGS. 10N, 10O, and 10P, the alternative trigger pack 1002 changes from the configuration shown in FIGS. 14C and 14D to that shown in FIG. 14E. From the position shown in FIGS. 14C and 14D, the lift spring 1014 lifts the main sear 1006, causes it to rotate clockwise around the main sear pin 1058, and move back within the main sear slot 1420. Forward movement of the intermediate striker 708 catches the main sear 1006 and causes it to move into the position shown in FIG. 14E.

Figure 14F:
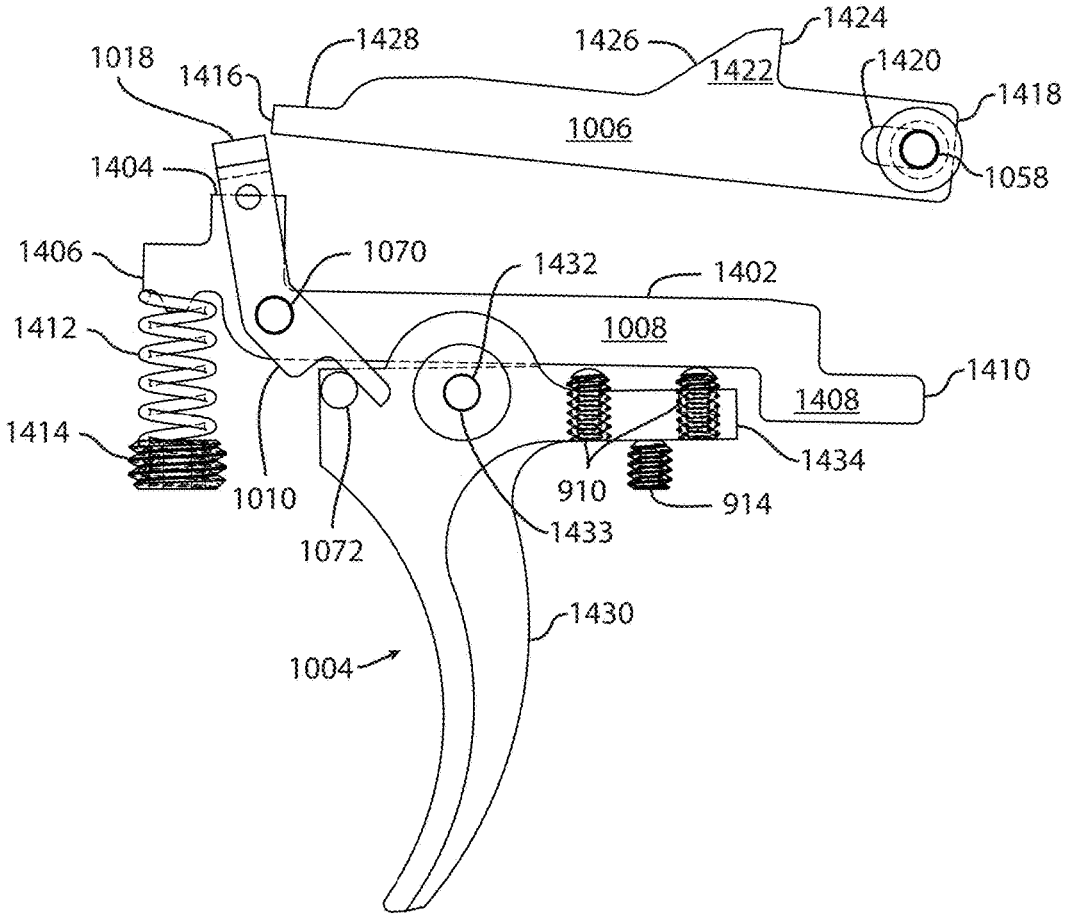
FIG. 14F shows the details of the alternative trigger pack after the trigger element has been released.

FIG. 14F shows the details of the alternative trigger pack after the trigger element has been released. When the trigger element 1004 is released, the trigger torsion spring (not shown) causes the trigger element 1004 to rotate clockwise around the trigger pin 1433. Engagement between the actuator engagement pin 1072 and the actuator 1010 causes the actuator 1010 to rotate counterclockwise so that the curved crossbar 1018 of the actuator 1010 moves out from under the main-sear shelf 1428, leaving the main sear 1006 in the position shown in FIG. 14F. From this position, the main sear 1006 will drop until the main-sear shelf 1428 rests on the main-sear supporting arm, which is the position shown in FIG. 14A. The gun 100 is then ready to fire again.

Figure 14G:
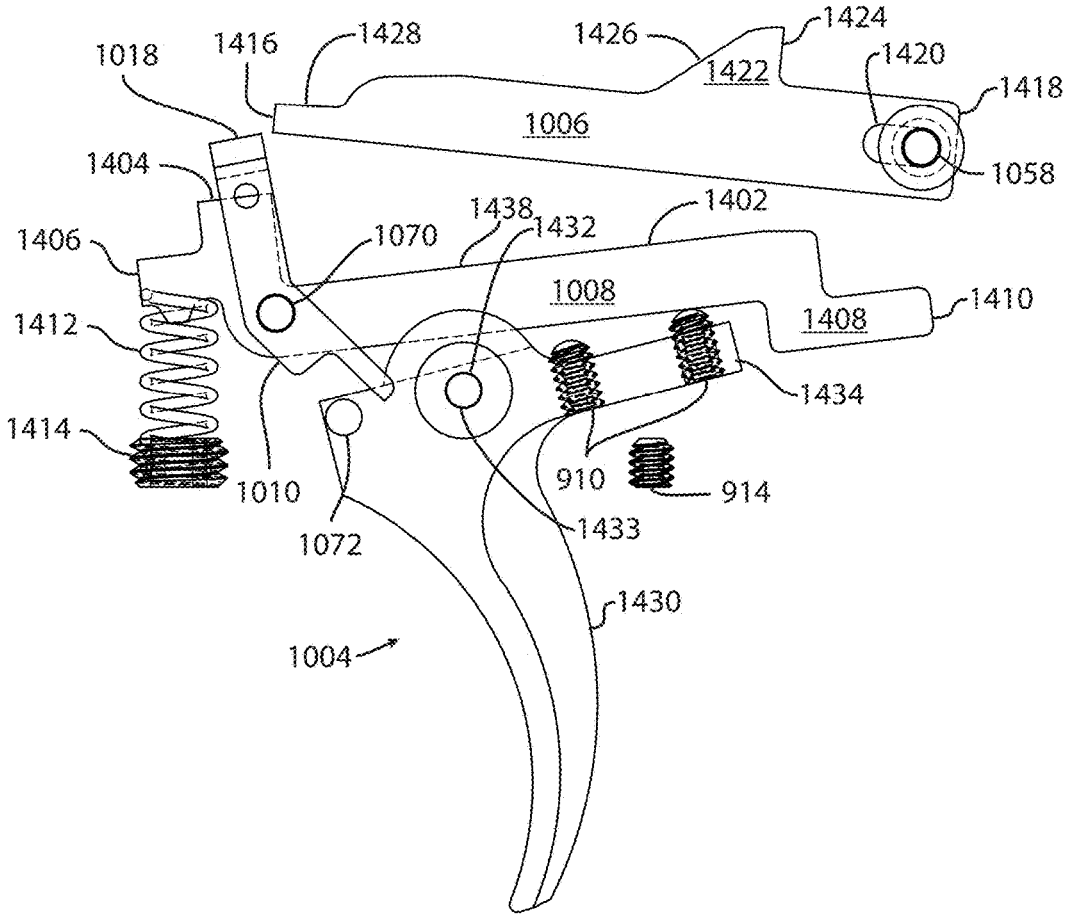
FIG. 14G shows the details of the alternative trigger pack in the automatic mode.

FIG. 14G shows the details of the alternative trigger pack in the automatic mode. In the automatic mode, the actuator 1010 is allowed to separate from the trigger element 1004 when the trigger element is held rearward. The ALC 1012 transfers the forward movement of the bolt carrier 1220 to the actuator 1010, causing the actuator 1010 to move out from under the main-sear shelf 1428 so that the main sear 1006 falls to the position shown in FIG. 14D. This results in automatic fire until the trigger element 1004 is released.

In the semi-automatic mode, the alternative trigger pack 1002 proceeds through the positions shown in the following order: FIG. 14A, FIG. 14B, FIG. 14C, FIG. 14D, FIG. 14E, FIG. 14F, finally returning to FIG. 14A.

In the automatic mode, the alternative trigger pack 1002 proceeds through the positions shown in the following order: FIG. 14A, FIG. 14B, FIG. 14C, FIG. 14D, FIG. 14E, and then repeat FIG. 14G, FIG. 14D, and FIG. 14E until the trigger element is released causing the sequence to return to FIG. 14A.

In one aspect, an apparatus includes a lower receiver having a trigger assembly. The apparatus includes an upper receiver, coupled to the lower receiver. The lower receiver has a bolt assembly and an L-shaped slot. The L-shaped slot has a long leg, a junction, and a short leg. The bolt assembly interacts with the L-shaped slot. The upper receiver has a rear end to which a compressed gas power source can be coupled. The upper receiver has a gas path from the compressed gas power source for firing a projectile through a barrel and for cocking the bolt assembly. The gas path is entirely contained by the upper receiver.

Implementations may include one or more of the following. The gas path may include a first segment. The first segment may provide a path for gas through the upper receiver toward a front end of the upper receiver, wherein the front end and rear end are on opposite ends of the upper receiver. The gas path may include a second segment coupled to the first segment. The second segment may provide a path for gas toward the rear end of the upper receiver to an input side of a valve that is actuatable by the trigger assembly. The gas path may include a third segment coupled to an output side of the valve. The third segment may provide a path for gas into a barrel coupled to the upper receiver and into the bolt assembly.

The first segment of the gas path may have an air source adapter, to which the compressed gas power source can be coupled. The air source adapter may have a boss to release gas from the compressed gas power source coupled to the air source adapter and an outlet port through which the released gas can flow. The first segment of the gas path may have a transfer tube coupled to the outlet port of the air source adapter. The transfer tube may extend through the upper receiver toward the front end of the upper receiver.

The second segment of the gas path may have a transfer block that provides a path for gas from an inlet port coupled to the transfer tube, through a transfer groove around a transfer bushing, which is coupled to the barrel, and out an outlet port toward the rear end of the lower receiver. The second segment of the gas path may have a connection from the outlet port of the transfer block to the input side of the valve.

The valve may have a valve body having an inside diameter, a striker end, and an inlet end. The valve may have a valve stem having a striker end protruding from the striker end of the valve body and having a mushroom-shaped element coupled adjacent an inlet end of the valve stem. A curved surface of the mushroom-shaped element may face the striker end of the valve stem. The valve may have a valve seal slidably coupled to the valve stem between the mushroom-shaped element and the striker end of the valve stem. The valve seal may seal against the inside diameter of the valve body. The valve may have a valve spring engaged with and urging the mushroom-shaped element against the valve seal. The valve may have an outlet port through the valve body. A path for gas through the valve from the inlet end to the outlet port may be created when pressure is exerted on the striker end of the valve stem of sufficient force to overcome the force of the valve spring holding the mushroom-shaped element against the valve seal.

The trigger assembly may be select-fire striker based and fit within select-fire hammer based trigger constraints.

The trigger assembly may include an intermediate striker. The intermediate striker may have a longitudinal body having a front end and a rear end. The intermediate striker may have a cocking cap screw projecting from and adjacent to the rear end of the longitudinal body. The intermediate striker may have a longitudinal spring guide orifice partially through the longitudinal body. The intermediate striker may have a main spring compression cavity coaxial with, and having a larger diameter than, the longitudinal spring guide orifice, and extending a main spring compression depth into the rear end of the longitudinal body. The intermediate striker may have a lock face in the longitudinal body, wherein the lock face faces the front end of the longitudinal body, is transverse to the longitudinal spring guide orifice, and is set back from the rear end of the longitudinal body. The trigger assembly may have may have a cylindrical spring guide inserted into the longitudinal spring guide orifice. The trigger assembly may have a helical main spring mounted on the spring guide and constrained on one end by an intermediate striker stop and contained on the other end by the main spring compression cavity. The trigger assembly may have a striker positioned between the intermediate striker and a valve stem on the valve.

The trigger assembly may have a trigger element. The trigger element may have a trigger body. The trigger element may have a trigger slot to engage a trigger pin coupled to the lower receiver about which the trigger element rotates. The trigger element may have a shelf-sear engagement arm extending from the trigger slot. The trigger element may have an adjustment screw extending from the shelf-sear engagement arm. The trigger element may have an auto-sear-linkage engagement pin coupled to the trigger body frontward of the trigger slot.

The trigger assembly may have a trigger spring engaged with the trigger body urging the trigger into a before-firing position.

The trigger assembly may have a shelf sear. The shelf sear may have an elongated body that rotates around an auto-sear-linkage pin coupled to the lower receiver. The shelf sear may have a main-sear-supporting arm adjacent to a front end of the shelf sear elongated body. The shelf sear may have an L-shaped element adjacent to a rear end of the shelf sear elongated body.

The trigger assembly may have a shelf sear spring coupled to the front end of the shelf sear elongated body that urges the shelf sear to rotate about the auto-sear-linkage pin.

The trigger assembly may have a main sear. The main sear may have a main sear front end and a main sear rear end. The main sear may have a hook-shaped cutout adjacent the main sear front end. The main sear may have a slot engaged with a main sear pin coupled to the lower receiver. The main sear may have a tab having a rearward facing flat face that engages the lock face of the intermediate striker when the main sear is in a before-firing position, and a forward facing ramped face. The main sear may have a main-sear shelf that engages the main-sear-supporting arm of the shelf sear when the main sear is in the before-firing position.

The trigger assembly may have a main sear spring coupled adjacent to the main sear rear end that urges the main sear to move and rotate about the main sear pin as constrained by the slot in the main sear.

The trigger assembly may have an auto sear. The auto sear may have a lower-case-h-shaped auto-sear body having a main body, a cross piece extending from the main body, and an end piece extending from the cross piece. The auto sear may have a shelf in an area between the main body and the cross piece. The auto sear may have an auto-sear pin coupled to the end piece.

The trigger assembly may have a trigger-to-auto-sear linkage coupled to and rotatable around the auto-sear-linkage pin. The trigger-to-auto-sear linkage may have a pusher arm extending from the auto-sear-linkage pin into an area between the main body and the end piece of the auto sear. The trigger-to-auto-sear linkage may have a pinned arm from the auto-sear-linkage pin at an obtuse angle from the pusher arm, the pinned arm having a trigger-to-auto-sear-linkage slot that engages with the auto-sear-linkage engagement pin.

Moving the trigger body from a before-firing position to an after-firing position may cause the adjustment screw extending from the shelf-sear engagement arm to engage the shelf sear and cause the shelf sear to rotate about the auto-sear-linkage engagement pin so that the main-sear-supporting arm no longer supports the main sear, and the trigger-to-auto-sear linkage to rotate around the auto-sear-linkage pin as constrained by the trigger-to-auto-sear-linkage slot such that the pusher arm of the trigger-to-auto-sear linkage pushes the auto sear from a before-firing position to an after-firing position.

As a result of the main-sear-supporting arm no longer supporting the main sear, the intermediate striker may cause the main sear to rotate such that the tab on the main sear no longer engages the lock face of the intermediate striker, allowing the intermediate striker to move to cause the striker to engage the valve stem to open the valve. After the intermediate striker moves, the main sear spring may cause the main sear to return to its before-firing position. The intermediate striker, upon being urged rearward by the bolt assembly in a cocking action, may engage the forward facing ramped face of the main sear tab, causing the main sear to deflect out of the path of the intermediate striker. The intermediate striker may compress the main spring. The intermediate striker may move in a forward direction causing the lock face of the intermediate striker to engage the rearward facing flat face of the main sear tab, causing the main sear to move forwardly, causing the hook-shaped cutout of the main sear to engage with the shelf of the auto sear. Releasing the trigger may cause the trigger body to move from the after-firing position to the before-firing position, causing the trigger-to-auto-sear linkage to rotate and push the auto sear from the after-firing position to the before-firing position, which allows the main sear to drop until the main sear engages the main sear supporting arm of the shelf sear.

The apparatus may include a selector switch having a lever element coupled to a barrel element. The barrel element may have a shelf-sear detent and a selector-switch-to-auto-sear-linkage detent. The selector switch may have three selectable positions. The selector switch may have a safety position in which the shelf-sear detent does not face the shelf sear, preventing the shelf sear from moving in response to movement of the trigger body. The selector switch may have a semi-automatic position in which the shelf-sear detent faces the shelf sear and in which the selector-switch-to-auto-sear-linkage detent faces a selector-switch-to-auto-sear linkage. The selector switch may have an automatic position in which the shelf-sear detent faces the shelf sear and in which the selector-switch-to-auto-sear-linkage detent does not face the selector-switch-to-auto-sear linkage. The apparatus may include a selector-switch-to-auto-sear linkage rotatably coupled to the auto-sear pin and may have a bolt-engaging arm and a selector-switch arm that engages with the barrel element of the selector switch. The apparatus may include a selector-switch-to-auto-sear-linkage spring that urges the selector-switch-to-auto-sear linkage into engagement with the barrel element of the selector switch. Moving the selector switch to the automatic position may prevent the selector-switch-to-auto-sear-linkage detent from engaging the selector-switch-to-auto-sear linkage so that the bolt-engaging arm is in a bolt-engaging position. Moving the selector switch to the semi-automatic position may cause the selector-switch-to-auto-sear-linkage detent to engage the selector-switch-to-auto-sear linkage so that bolt-engaging arm is in a non-bolt-engaging position. The bolt assembly engaging the bolt-engaging arm of the selector-switch-to-auto-sear linkage after the bolt assembly achieves a bolt lock condition may cause the auto sear to move from the after-firing-position to the before-firing position.

The trigger assembly may include a trigger element. The trigger element may have a trigger body. The trigger element may have a trigger slot to engage a trigger pin coupled to the lower receiver about which the trigger element rotates. The trigger element may have a shelf-sear engagement arm extending from the trigger slot. The trigger element may have an adjustment screw extending from the shelf-sear engagement arm. The trigger element may have an actuator engagement pin coupled to the trigger body frontward of the trigger slot.

The trigger assembly may include a trigger spring engaged with the trigger body urging the trigger body into a before-firing position;

The trigger assembly may include a shelf sear. The shelf sear may have an elongated body that rotates around a shelf sear pivot pin coupled to the lower receiver. The shelf sear may have a main-sear-supporting arm adjacent to a front end of the shelf sear elongated body. The shelf sear may have an L-shaped element adjacent to a rear end of the shelf sear elongated body.

The trigger assembly may include a shelf sear spring coupled to the front end of the shelf sear elongated body that urges the shelf sear to rotate about the shelf sear pivot pin.

The trigger assembly may include a main sear. The main sear may have a main sear front end and a main sear rear end. The main sear may have a slot engaged with a main sear pin coupled to the lower receiver. The main sear may have a tab having a rearward facing flat face that engages the lock face of the intermediate striker when the main sear is in a before-firing position, and a forward facing ramped face. The main sear may have a main-sear shelf that engages the main-sear-supporting arm of the shelf sear when the main sear is in the before-firing position.

The trigger assembly may have a lift spring coupled adjacent to the main sear front end that urges the main sear to rotate about the main sear pin as constrained by the slot in the main sear;

The trigger assembly may have an actuator. The actuator may have a curved crossbar. The actuator may have a first bent arm coupled to a first end of the curved crossbar. The first bent arm may have a first bent arm narrow section. The actuator may have a second bent arm coupled to a second end of the curved crossbar. The second bent arm may have a second bent arm narrow section. The actuator may be rotatably coupled to the shelf sear by the shelf sear pivot pin passing through a first bent arm pivot hole on the first bent arm and a second bent arm pivot hole on the second bent arm.

The trigger assembly may have an auto link connector (ALC). The ALC may have a pinned arm coupled to an ALC pin hole on the first bent arm of the actuator. The ALC may have a selector switch engagement arm. The ALC may have a bolt engagement arm.

Moving the trigger body from a before-firing position to an after-firing position may cause the adjustment screw extending from the shelf-sear engagement arm to engage the shelf sear and cause the shelf sear to rotate about the shelf sear pivot pin so that the main-sear-supporting arm no longer supports the main sear, and the actuator to rotate around the shelf sear pivot pin as constrained by interaction between the actuator engagement pin and the narrow portion of the first bent arm from a before-firing position to an after-firing position.

As a result of the main-sear-supporting arm no longer supporting the main sear, the intermediate striker may cause the main sear to rotate such that the tab on the main sear no longer engages the lock face of the intermediate striker, allowing the intermediate striker to move to cause the striker to engage the valve stem to open the valve. After the intermediate striker moves, the lift spring may cause the main sear to move into a position to intercept the intermediate striker. The intermediate striker, upon being urged rearward by the bolt assembly in a cocking action, may engage the forward facing ramped face of the main sear tab, causing the main sear to deflect out of the path of the intermediate striker. The intermediate striker may compress the main spring. The intermediate striker may move in a forward direction causing the lock face of the intermediate striker to engage the rearward facing flat face of the main sear tab, causing the main sear to move forwardly, causing the main sear to engage with the curved crossbar on the actuator. Releasing the trigger may cause the trigger body to move from the after-firing position to the before-firing position, causing the actuator to rotate from the after-firing position to the before-firing position, which allows the main sear to drop until the main sear engages the main sear supporting arm of the shelf sear.

The apparatus may include a selector switch having a lever element coupled to a barrel element. The barrel element may have a shelf-sear detent and an ALC detent. The selector switch may have three selectable positions. The selector switch may have a safety position in which the shelf-sear detent does not face the shelf sear, preventing the shelf sear from moving in response to movement of the trigger body. The selector switch may have a semi-automatic position in which the shelf-sear detent faces the shelf sear and in which the ALC detent does not face the ALC. The selector switch may have an automatic position in which the shelf-sear detent faces the shelf sear and in which the ALC detent faces the ALC.

Moving the selector switch to the automatic position may allow the ALC detent to engage the ALC so that the bolt engagement arm is in a bolt-engaging position. Moving the selector switch to the semi-automatic position may prevent the ALC detent from engaging the ALC so that bolt engagement arm is in a non-bolt-engaging position. The bolt assembly engaging the bolt engagement arm of the ALC after the bolt assembly achieves a bolt lock condition may cause the actuator to move from the after-firing-position to the before-firing position.

The bolt assembly may include a first part and a second part that are separated by a small gap just prior to actuation of the trigger assembly, and become separated by a large gap, larger than the small gap, over a projectile-firing period of time immediately after the trigger assembly is actuated, the increase in the gap size being caused by movement of the second part in response to gas entering the small gap from the output side of the valve. The first part and the second part may move together in a cocking action once they are separated by the large gap. The projectile-firing period of time may be adjusted to be a multiple of a transit time of the projectile through the barrel. The first part may include a bolt lock piston. The second part may include a bolt probe. The second part may include a bolt lock regulator body coaxial to and fixedly coupled to the bolt probe. The second part may include a bolt lock bushing coaxial to the bolt probe, laterally fixed to the bolt probe, and rotatable about the bolt probe. The second part may include a cam pin fixedly coupled to the bolt lock bushing. The second part may include a torsion spring coupled between the bolt lock regulator body and the bolt lock bushing that biases the bolt lock bushing to rotate about the bolt probe.

The bolt assembly may include a cylindrical bolt carrier fixedly coupled to the bolt lock piston. The cylindrical bolt carrier may have a cam slot. The cam pin may extend through the cam slot and the L-shaped slot. The cylindrical bolt carrier may contain the bolt lock regulator body, the bolt lock bushing, and the bolt probe.

The torsion spring may bias the cam pin within cam slot and the L-shaped slot along the long leg of the L-shaped slot, toward the junction, and, guided by the cam slot, into the short leg.

The bolt probe may be coupled to a source of pressurized gas at one end and to a poppet valve within the bolt lock regulator body at the other end. The poppet valve may separate a pressurized chamber in the bolt lock regulator body from a pressurizable chamber between the bolt lock regulator body and the bolt lock piston. The poppet valve may include a spring and a hollow set screw. Rotation of the hollow set screw may adjust a tension in the spring and a pressure required to open the poppet valve so that the pressurized chamber communicates with the unpressurized chamber. The hollow set screw may provide gaseous communication from the pressurizable chamber to the gap between the bolt lock regulator body and the bolt lock piston.

In one aspect, an apparatus includes a lower receiver having a trigger assembly wherein the trigger assembly is select-fire striker based and fits within select-fire hammer based trigger constraints. The apparatus includes an upper receiver, coupled to the lower receiver, having a bolt assembly and an L-shaped slot, wherein the L-shaped slot has a long leg, a junction, and a short leg, and wherein the bolt assembly interacts with the L-shaped slot. The upper receiver has a rear end to which a compressed gas power source can be coupled. The apparatus includes a gas path from the compressed gas power source for firing a projectile through a barrel and for cocking the bolt assembly.

In one aspect, an apparatus includes a lower receiver having a trigger assembly. The apparatus includes an upper receiver, coupled to the lower receiver, having a bolt assembly and an L-shaped slot, wherein the L-shaped slot has a long leg, a junction, and a short leg, and wherein the bolt assembly interacts with the L-shaped slot. The upper receiver has a rear end to which a compressed gas power source can be coupled. The apparatus includes a gas path from the compressed gas power source for firing a projectile through a barrel and for cocking the bolt assembly. The bolt assembly includes a first part and a second part are separated by a small gap just prior to actuation of the trigger assembly, and become separated by a large gap, larger than the small gap, over a projectile-firing period of time immediately after the trigger assembly is actuated. The increase in the gap size is caused by movement of the second part in response to gas entering the small gap from the output side of the valve. The first part and the second part move together in a cocking action once they are separated by the large gap.

The word "coupled" herein means a direct connection or an indirect connection.

The text above describes one or more specific embodiments of a broader invention. The invention also is carried out in a variety of alternate embodiments and thus is not limited to those described here. The foregoing description of an embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a lower receiver having a trigger assembly;

an upper receiver, coupled to the lower receiver, having a bolt assembly and an L-shaped slot, wherein the L-shaped slot has a long leg, a junction, and a short leg, and wherein the bolt assembly interacts with the L-shaped slot;

the upper receiver having a rear end configured to couple with a compressed gas power source; and a gas path from the compressed gas power source for firing a projectile through a barrel and for cocking the bolt assembly, the gas path entirely contained within the upper receiver;

wherein the gas path comprises:

a first segment, wherein the first segment provides a path for gas through the upper receiver past the bolt assembly toward a front end of the upper receiver, wherein the front end and rear end are on opposite ends of the upper receiver, a second segment coupled to the first segment, wherein the second segment provides a path for gas extending toward the rear end for the upper receiver to an input side of a valve that is actuatable by the trigger assembly, and a third segment coupled to an output side of the valve, wherein the third segment provides a path for gas into a barrel coupled to the upper receiver and into the bolt assembly.

2. The apparatus of claim 1 wherein:

the first segment of the gas path has:

an air source adapter, to which the compressed gas power source can be coupled, the air source adapter having a boss to release gas from the compressed gas power source coupled to the air source adapter and an outlet port through which the released gas can flow, and a transfer tube coupled to the outlet port of the air source adapter, the transfer tube extending through the upper receiver toward the front end of the upper receiver.

3. The apparatus of claim 2 wherein:

the second segment of the gas path has:

a transfer block that provides a path for gas from an inlet port coupled to the transfer tube, through a transfer groove around a transfer bushing, which is coupled to the barrel, and out an outlet port toward the rear end of the lower receiver; and a connection from the outlet port of the transfer block to the input side of the valve.

4. The apparatus of claim 3 wherein the valve has:

a valve body having an inside diameter, a striker-proximate end, and an inlet end;

a valve stem having a striker end protruding from the striker-proximate end of the valve body and having a mushroom-shaped element coupled adjacent an inlet end of the valve stem, a curved surface of the mushroom-shaped element facing the striker end of the valve stem;

a valve seal slidably coupled to the valve stem between the mushroom-shaped element and the striker end of the valve stem, wherein the valve seal seals against the inside diameter of the valve body;

a valve spring engaged with and urging the mushroom-shaped element against the valve seal; and an outlet port through the valve body, wherein a path for gas through the valve from the inlet end to the outlet port is created when pressure is exerted on the striker end of the valve stem of sufficient force to overcome the force of the valve spring holding the mushroom-shaped element against the valve seal.

5. The apparatus of claim 1 wherein the trigger assembly is select-fire striker based and fits within select-fire hammer based trigger constraints.

6. The apparatus of claim 1 wherein the trigger assembly comprises:

an intermediate striker having:

a longitudinal body having a front end and a rear end;

a cocking cap screw projecting from and adjacent to the rear end of the longitudinal body, a longitudinal spring guide orifice partially through the longitudinal body, a main spring compression cavity coaxial with, and having a larger diameter than, the longitudinal spring guide orifice, and extending a main spring compression depth into the rear end of the longitudinal body, a lock face in the longitudinal body, wherein the lock face faces the front end of the longitudinal body, is transverse to the longitudinal spring guide orifice, and is set back from the rear end of the longitudinal body;

a cylindrical spring guide inserted into the longitudinal spring guide orifice;

a helical main spring mounted on the spring guide and constrained on one end by an intermediate striker stop and contained on the other end by the main spring compression cavity; and a striker positioned between the intermediate striker and a valve stem on the valve.

7. The apparatus of claim 6 wherein the trigger assembly comprises:

a trigger element having:

a trigger body, a trigger slot to engage a trigger pin coupled to the lower receiver about which the trigger element rotates, a shelf-sear engagement arm extending from the trigger slot, an adjustment screw extending from the shelf-sear engagement arm, and an auto-sear-linkage engagement pin coupled to the trigger body frontward of the trigger slot;

a trigger spring engaged with the trigger body urging the trigger into a before-firing position;

a shelf sear having:

an elongated body that rotates around an auto-sear-linkage pin coupled to the lower receiver, a main-sear-supporting arm adjacent to a front end of the shelf sear elongated body, an L-shaped element adjacent to a rear end of the shelf sear elongated body;

a shelf sear spring coupled to the front end of the shelf sear elongated body that urges the shelf sear to rotate about the auto-sear-linkage pin;

a main sear having:

a main sear front end and a main sear rear end, a hook-shaped cutout adjacent the main sear front end, a slot engaged with a main sear pin coupled to the lower receiver, a tab having:

a rearward facing flat face that engages the lock face of the intermediate striker when the main sear is in a before-firing position, and a forward facing ramped face, and a main-sear shelf that engages the main-sear-supporting arm of the shelf sear when the main sear is in the before-firing position;

a main sear spring coupled adjacent to the main sear rear end that urges the main sear to move and rotate about the main sear pin as constrained by the slot in the main sear;

an auto sear having:

a lower-case-h-shaped auto-sear body having a main body, a cross piece extending from the main body, and an end piece extending from the cross piece, a shelf in an area between the main body and the cross piece, and an auto-sear pin coupled to the end piece;

a trigger-to-auto-sear linkage coupled to and rotatable around the auto-sear-linkage pin, the trigger-to-auto-sear linkage having:

a pusher arm extending from the auto-sear-linkage pin into an area between the main body and the end piece of the auto sear;

a pinned arm from the auto-sear-linkage pin at an obtuse angle from the pusher arm, the pinned arm having a trigger-to-auto-sear-linkage slot that engages with the auto-sear-linkage engagement pin;

wherein:

moving the trigger body from a before-firing position to an after-firing position causes:

the adjustment screw extending from the shelf-sear engagement arm to engage the shelf sear and cause the shelf sear to rotate about the auto-sear-linkage engagement pin so that the main-sear-supporting arm no longer supports the main sear, and the trigger-to-auto-sear linkage to rotate around the auto-sear-linkage pin as constrained by the trigger-to-auto-sear-linkage slot such that the pusher arm of the trigger-to-auto-sear linkage pushes the auto sear from a before-firing position to an after-firing position;

as a result of the main-sear-supporting arm no longer supporting the main sear, the intermediate striker causes the main sear to rotate such that the tab on the main sear no longer engages the lock face of the intermediate striker, allowing the intermediate striker to move to cause the striker to engage the valve stem to open the valve;

after the intermediate striker moves, the main sear spring causes the main sear to return to its before-firing position;

the intermediate striker, upon being urged rearward by the bolt assembly in a cocking action, engages the forward facing ramped face of the main sear tab, causing the main sear to deflect out of the path of the intermediate striker;

the intermediate striker compresses the main spring;

the intermediate striker moves in a forward direction causing the lock face of the intermediate striker to engage the rearward facing flat face of the main sear tab, causing the main sear to move forwardly, causing the hook-shaped cutout of the main sear to engage with the shelf of the auto sear;

releasing the trigger causes the trigger body to move from the after-firing position to the before-firing position, causing the trigger-to-auto-sear linkage to rotate and push the auto sear from the after-firing position to the before-firing position, which allows the main sear to drop until the main sear engages the main sear supporting arm of the shelf sear.

8. The apparatus of claim 7 further comprising:

a selector switch having a lever element coupled to a barrel element, the barrel element having a shelf-sear detent and a selector-switch-to-auto-sear-linkage detent, the selector switch having three selectable positions:

a safety position in which the shelf-sear detent does not face the shelf sear, preventing the shelf sear from moving in response to movement of the trigger body, a semi-automatic position in which the shelf-sear detent faces the shelf sear and in which the selector-switch-to-auto-sear-linkage detent faces a selector-switch-to-auto-sear linkage, and an automatic position in which the shelf-sear detent faces the shelf sear and in which the selector-switch-to-auto-sear-linkage detent does not face the selector-switch-to-auto-sear linkage;

the selector-switch-to-auto-sear linkage rotatably coupled to the auto-sear pin and having a bolt-engaging arm and a selector-switch arm that engages with the barrel element of the selector switch;

a selector-switch-to-auto-sear-linkage spring that urges the selector-switch-to-auto-sear linkage into engagement with the barrel element of the selector switch;

wherein:

moving the selector switch to the automatic position prevents the selector-switch-to-auto-sear-linkage detent from engaging the selector-switch-to-auto-sear linkage so that the bolt-engaging arm is in a bolt-engaging position;

moving the selector switch to the semi-automatic position causes the selector-switch-to-auto-sear-linkage detent to engage the selector-switch-to-auto-sear linkage so that bolt-engaging arm is in a non-bolt-engaging position; and the bolt assembly engaging the bolt-engaging arm of the selector-switch-to-auto-sear linkage after the bolt assembly achieves a bolt lock condition causes the auto sear to move from the after-firing-position to the before-firing position.

9. The apparatus of claim 6 wherein the trigger assembly comprises:

a trigger element having:

a trigger body, a trigger slot to engage a trigger pin coupled to the lower receiver about which the trigger element rotates, a shelf-sear engagement arm extending from the trigger slot, an adjustment screw extending from the shelf-sear engagement arm, and an actuator engagement pin coupled to the trigger body frontward of the trigger slot;

a trigger spring engaged with the trigger body urging the trigger body into a before-firing position;

a shelf sear having:

an elongated body that rotates around a shelf sear pivot pin coupled to the lower receiver, a main-sear-supporting arm adjacent to a front end of the shelf sear elongated body, an L-shaped element adjacent to a rear end of the shelf sear elongated body;

a shelf sear spring coupled to the front end of the shelf sear elongated body that urges the shelf sear to rotate about the shelf sear pivot pin;

a main sear having:

a main sear front end and a main sear rear end, a slot engaged with a main sear pin coupled to the lower receiver, a tab having:

a rearward facing flat face that engages the lock face of the intermediate striker when the main sear is in a before-firing position, and a forward facing ramped face, and a main-sear shelf that engages the main-sear-supporting arm of the shelf sear when the main sear is in the before-firing position;

a lift spring coupled adjacent to the main sear front end that urges the main sear to rotate about the main sear pin as constrained by the slot in the main sear;

an actuator having:

a curved crossbar, a first bent arm coupled to a first end of the curved crossbar, wherein the first bent arm has a first bent arm narrow section, a second bent arm coupled to a second end of the curved crossbar, wherein the second bent arm has a second bent arm narrow section, and the actuator being rotatably coupled to the shelf sear by the shelf sear pivot pin passing through a first bent arm pivot hole on the first bent arm and a second bent arm pivot hole on the second bent arm;

an auto link connector (ALC) having:

a pinned arm coupled to an ALC pin hole on the first bent arm of the actuator, a selector switch engagement arm, and a bolt engagement arm;

wherein:

moving the trigger body from a before-firing position to an after-firing position causes:

the adjustment screw extending from the shelf-sear engagement arm to engage the shelf sear and cause the shelf sear to rotate about the shelf sear pivot pin so that the main-sear-supporting arm no longer supports the main sear, and the actuator to rotate around the shelf sear pivot pin as constrained by interaction between the actuator engagement pin and the narrow portion of the first bent arm from a before-firing position to an after-firing position;

as a result of the main-sear-supporting arm no longer supporting the main sear, the intermediate striker causes the main sear to rotate such that the tab on the main sear no longer engages the lock face of the intermediate striker, allowing the intermediate striker to move to cause the striker to engage the valve stem to open the valve;

after the intermediate striker moves, the lift spring causes the main sear to move into a position to intercept the intermediate striker;

the intermediate striker, upon being urged rearward by the bolt assembly in a cocking action, engages the forward facing ramped face of the main sear tab, causing the main sear to deflect out of the path of the intermediate striker;

the intermediate striker compresses the main spring;

the intermediate striker moves in a forward direction causing the lock face of the intermediate striker to engage the rearward facing flat face of the main sear tab, causing the main sear to move forwardly, causing the main sear to engage with the curved crossbar on the actuator;

releasing the trigger causes the trigger body to move from the after-firing position to the before-firing position, causing the actuator to rotate from the after-firing position to the before-firing position, which allows the main sear to drop until the main sear engages the main sear supporting arm of the shelf sear.

10. The apparatus of claim 9 further comprising:

a selector switch having a lever element coupled to a barrel element, the barrel element having a shelf-sear detent and an ALC detent, the selector switch having three selectable positions:

a safety position in which the shelf-sear detent does not face the shelf sear, preventing the shelf sear from moving in response to movement of the trigger body, a semi-automatic position in which the shelf-sear detent faces the shelf sear and in which the ALC detent does not face the ALC, and an automatic position in which the shelf-sear detent faces the shelf sear and in which the ALC detent faces the ALC;

wherein:

moving the selector switch to the automatic position allows the ALC detent to engage the ALC so that the bolt engagement arm is in a bolt-engaging position;

moving the selector switch to the semi-automatic position prevents the ALC detent from engaging the ALC so that bolt engagement arm is in a non-bolt-engaging position; and the bolt assembly engaging the bolt engagement arm of the ALC after the bolt assembly achieves a bolt lock condition causes the actuator to move from the after-firing-position to the before-firing position.

11. The apparatus of claim 1 wherein the bolt assembly comprises:

a first part and a second part that:

are separated by a small gap just prior to actuation of the trigger assembly, and become separated by a large gap, larger than the small gap, over a projectile-firing period of time immediately after the trigger assembly is actuated, the increase in the gap size being caused by movement of the second part in response to gas entering the small gap from the output side of the valve; and wherein the first part and the second part move together in a cocking action once they are separated by the large gap.

12. The apparatus of claim 11 wherein the projectile-firing period of time is adjusted to be a multiple of a transit time of the projectile through the barrel.

13. The apparatus of claim 11 wherein the first part comprises a bolt lock piston.

14. The apparatus of claim 11 wherein the second part comprises:

a bolt probe;

a bolt lock regulator body coaxial to and fixedly coupled to the bolt probe;

a bolt lock bushing coaxial to the bolt probe, laterally fixed to the bolt probe, and rotatable about the bolt probe;

a cam pin fixedly coupled to the bolt lock bushing; and a torsion spring coupled between the bolt lock regulator body and the bolt lock bushing that biases the bolt lock bushing to rotate about the bolt probe.

15. The apparatus of claim 14 wherein the bolt assembly further comprises a cylindrical bolt carrier fixedly coupled to the bolt lock piston, wherein the cylindrical bolt carrier has a cam slot, wherein the cam pin extends through the cam slot and the L-shaped slot, and wherein the cylindrical bolt carrier contains the bolt lock regulator body, the bolt lock bushing, and the bolt probe.

16. The apparatus of claim 15 wherein the torsion spring biases the cam pin within cam slot and the L-shaped slot along the long leg of the L-shaped slot, toward the junction, and, guided by the cam slot, into the short leg.

17. The apparatus of claim 14 wherein the bolt probe is coupled to a source of pressurized gas at one end and to a poppet valve within the bolt lock regulator body at the other end, the poppet valve separating a pressurized chamber in the bolt lock regulator body from a pressurizable chamber between the bolt lock regulator body and the bolt lock piston.

18. The apparatus of claim 17 wherein the poppet valve comprises a spring and a hollow set screw, wherein rotation of the hollow set screw adjusts a tension in the spring and a pressure required to open the poppet valve so that the pressurized chamber communicates with the unpressurized chamber.

19. The apparatus of claim 18 wherein the hollow set screw provides gaseous communication from the pressurizable chamber to the gap between the bolt lock regulator body and the bolt lock piston.

20. An apparatus comprising:

a lower receiver having a trigger assembly wherein the trigger assembly is select-fire striker based and fits within select-fire hammer based trigger constraints;

an upper receiver, coupled to the lower receiver, having a bolt assembly and an L-shaped slot, wherein the L-shaped slot has a long leg, a junction, and a short leg, and wherein the bolt assembly interacts with the L-shaped slot;

the upper receiver having a rear end to which a compressed gas power source can be coupled; and a gas path from the compressed gas power source for firing a projectile through a barrel and for cocking the bolt assembly.

21. An apparatus comprising:

a lower receiver having a trigger assembly;

an upper receiver, coupled to the lower receiver, having a bolt assembly and an L-shaped slot, wherein the L-shaped slot has a long leg, a junction, and a short leg, and wherein the bolt assembly interacts with the L-shaped slot;

the upper receiver having a rear end to which a compressed gas power source can be coupled; and a gas path from the compressed gas power source for firing a projectile through a barrel and for cocking the bolt assembly;

wherein the bolt assembly comprises:

a first part and a second part that:

are separated by a small gap just prior to actuation of the trigger assembly, and become separated by a large gap, larger than the small gap, over a projectile-firing period of time immediately after the trigger assembly is actuated, the increase in the gap size being caused by movement of the second part in response to gas entering the small gap from the output side of the valve; and wherein the first part and the second part move together in a cocking action once they are separated by the large gap.

* * * * *